US009648423B2

(12) United States Patent
Katayama et al.

(10) Patent No.: US 9,648,423 B2
(45) Date of Patent: May 9, 2017

(54) SPEAKER DEVICE AND AUDIO SIGNAL PROCESSING METHOD

(71) Applicant: Yamaha Corporation, Hamamatsu-shi, Shizuoka (JP)

(72) Inventors: Masaki Katayama, Hamamatsu (JP); Susumu Takumai, Hamamatsu (JP); Keiichi Imaoka, Shizuoka (JP)

(73) Assignee: Yamaha Corporation, Hamamatsu-shi (JP)

( * ) Notice: Subject to any disclaimer, the term of this patent is extended or adjusted under 35 U.S.C. 154(b) by 0 days.

(21) Appl. No.: 14/428,227

(22) PCT Filed: Aug. 19, 2014

(86) PCT No.: PCT/JP2014/071686
§ 371 (c)(1),
(2) Date: Mar. 13, 2015

(87) PCT Pub. No.: WO2015/025858
PCT Pub. Date: Feb. 26, 2015

(65) Prior Publication Data

US 2015/0237446 A1 Aug. 20, 2015

(30) Foreign Application Priority Data

Aug. 19, 2013 (JP) ..... 2013-169755
Dec. 26, 2013 (JP) ..... 2013-269162
(Continued)

(51) Int. Cl.
*H04R 5/00* (2006.01)
*H04R 3/12* (2006.01)
(Continued)

(52) U.S. Cl.
CPC ..... *H04R 3/12* (2013.01); *H04R 1/323* (2013.01); *H04R 1/326* (2013.01); *H04S 3/008* (2013.01);
(Continued)

(58) Field of Classification Search
CPC .. H04S 2420/01; H04S 2400/01; H04S 7/304; H04S 3/004; H04S 2400/11;
(Continued)

(56) References Cited

U.S. PATENT DOCUMENTS

2007/0076905 A1 4/2007 Konagai et al.
2007/0110268 A1 5/2007 Konagai et al.
(Continued)

FOREIGN PATENT DOCUMENTS

CN 1883228 A 12/2006
CN 1898988 A 1/2007
(Continued)

OTHER PUBLICATIONS

International Search Report (PCT/ISA/210) dated Sep. 16, 2014 with English translation (five pages).
(Continued)

*Primary Examiner* — Sunita Joshi
(74) *Attorney, Agent, or Firm* — Crowell & Moring LLP

(57) ABSTRACT

A speaker apparatus includes an input portion to which audio signals of a plurality of channels are input, a plurality of speakers, a directivity controlling portion that delays the audio signals of the plurality of channels input to the input portion and distributes the delayed audio signals to the plurality of speakers so that the plurality of speakers output a plurality of sound beams, and a localization adding portion that applies a filtering processing based on a head-related transfer function to at least one of the audio signals of the plurality of channels input to the input portion and inputs the processed audio signal to the plurality of speakers.

29 Claims, 50 Drawing Sheets

(30) Foreign Application Priority Data

Dec. 26, 2013 (JP) ..... 2013-269163
Dec. 27, 2013 (JP) ..... 2013-272352
Dec. 27, 2013 (JP) ..... 2013-272528

(51) Int. Cl.
*H04R 1/32* (2006.01)
*H04S 3/00* (2006.01)
*H04S 7/00* (2006.01)
*H04R 5/02* (2006.01)
*H04R 29/00* (2006.01)

(52) U.S. Cl.
CPC ..... *H04S 7/30* (2013.01); *H04R 29/002* (2013.01); *H04R 2203/12* (2013.01); *H04R 2430/20* (2013.01); *H04S 2400/01* (2013.01); *H04S 2420/01* (2013.01)

(58) Field of Classification Search
CPC . H04S 7/30; H04S 5/005; H04S 7/303; H04S 1/005; H04S 2400/05; H04S 2420/13; H04S 7/302; H04R 3/12; H04R 5/02; H04R 2203/12
USPC ..... 381/17, 23.1, 300, 309, 1, 23, 72, 18, 2, 381/22, 26, 27, 57, 61, 71.6
See application file for complete search history.

(56) References Cited

U.S. PATENT DOCUMENTS

2007/0165878 A1 7/2007 Konagai
2007/0165890 A1* 7/2007 Fusakawa ..... H04S 1/002 381/309
2008/0226084 A1* 9/2008 Konagai ..... H04S 3/008 381/17
2009/0010455 A1* 1/2009 Suzuki ..... H04R 1/403 381/97
2009/0129602 A1 5/2009 Konagai et al.
2010/0226499 A1 9/2010 De Bruijn et al.
2010/0310080 A1* 12/2010 Fukuyama ..... H04R 3/12 381/17

FOREIGN PATENT DOCUMENTS

CN 1906972 A 1/2007
CN 101267687 A 9/2008
JP 2005-159518 A 6/2005
JP 2006-340330 A 12/2006
JP 2007-110744 A 4/2007
JP 2007-266967 A 10/2007
JP 2008-227803 A 9/2008
JP 2009-17137 A 1/2009
JP 2009-218888 A 9/2009
JP 2009-531926 A 9/2009
JP 2010-213031 A 9/2010
JP 2012-235456 A 11/2012

OTHER PUBLICATIONS

Japanese-language Written Opinion (PCT/ISA/237) dated Sep. 16, 2014 (five pages).
Chinese Office Action issued in counterpart Chinese Application No. 201480002397.6 dated Mar. 21, 2016, with English translation (twenty (20) pages).
Chinese Office Action issued in counterpart Chinese Application No. 201480002397.6 dated Nov. 10, 2016 with English-language translation (thirteen (13) pages).

* cited by examiner

| SPECIFIED ANGLE | RATIO | GAIN ADJUSTING PORTION 1096FR | GAIN ADJUSTING PORTION 1095FR |
|---|---|---|---|
| FR ANGLE | 100 | 0 | 1.0 |
| ⋮ | ⋮ | ⋮ | ⋮ |
| C ANGLE | 0 | 1.0 | 0 |

| SPECIFIED ANGLE | FILTER COEFFICIENT |
|---|---|
| 0° | HRTF 0° |
| ⋮ | ⋮ |
| 100° | HTRF 180° |

SPEAKER DEVICE AND AUDIO SIGNAL PROCESSING METHOD

TECHNICAL FIELD

The present invention relates to a speaker apparatus outputting a sound beam having a directivity and a sound for making a virtual sound source perceived.

BACKGROUND ART

An array speaker apparatus outputting a sound beam having a directivity by delaying audio signals and distributing the delayed audio signals to a plurality of speaker units is conventionally known (see Patent Document 1).

In the array speaker apparatus of Patent Document 1, a sound source is localized by making a sound beam of each channel reflected on a wall to reach a listener from around the listener.

Besides, in the array speaker apparatus of Patent Document 1, with respect to a channel whose sound beam cannot reach the listener due to, for example, the shape of the room, filtering processing based on a head-related transfer function is carried out for performing processing for localizing a virtual sound source.

More specifically, in the array speaker apparatus described in Patent Document 1, a head-related transfer function corresponding to the head shape of a listener is convolved to an audio signal for changing the frequency characteristic. The listener perceives a virtual sound source by hearing a sound whose frequency characteristic has been thus changed (a sound for making a virtual sound source perceived). Thus, the audio signal is virtually localized.

Besides, another array speaker apparatus outputting a sound beam having a directivity by delaying audio signals and distributing the delayed audio signals to a plurality of speaker units is known (see, for example, Patent Documents 2 and 3).

In an array speaker apparatus of Patent Document 2, a sound beam of a C channel and a sound beam reaching a listener after being reflected on a wall are used for outputting the same signal at a prescribed ratio, so as to localize a phantom sound source. A phantom sound source means a virtual sound source localized, when sounds of the same channel are allowed to reach a listener from right and left different directions, in a middle direction between these different directions.

Furthermore, in an array speaker apparatus of Patent Document 3, a sound beam having been reflected once on a wall disposed on the right or left side of a listener and a sound beam having been reflected twice on walls disposed on the right or left side and behind the listener are used for localizing a phantom sound source in the middle between a localization direction of a front channel and the localization direction of a surround channel.

CITATION LIST

Patent Document

Patent Document 1: JP-A-2008-227803
Patent Document 2: JP-A-2005-159518
Patent Document 3: JP-A-2010-213031

SUMMARY OF THE INVENTION

Problems to be Solved by the Invention

Even if a sound beam of a given channel can be made to reach a listener, however, there is a case where a sound source cannot be distinctively localized depending on the listening environment. For example, under an environment where a listening position is away from a wall or an environment where a wall material with a low acoustic reflectivity is used, a sufficient localization feeling cannot be obtained.

On the other hand, it is more difficult to obtain a distance feeling by using a virtual sound source than by using a sound beam. Besides, in the localization based on a virtual sound source, since the localization feeling is weaken when a listening position is shifted from a regulated position, a region where the localization feeling can be attained is narrow. In addition, since a head-related transfer function is set on the basis of the shape of a model head, there are individual differences in the localization feeling.

Furthermore, when the filtering processing based on a head-related transfer function is performed on merely a specific channel as described in Patent Document 1, there arise a channel using merely a sound beam and a channel using merely a virtual sound source, and hence a difference is caused in the localization feeling between the channels, which may degrade a surround feeling in some cases.

Besides, respective sound beams are not completely the same, among channels, in the sound volume or the frequency characteristic of the beam reflected on a wall. Accordingly, it is difficult to localize a phantom sound source based on a sound beam distinctively in an intended direction.

Furthermore, in the array speaker apparatus of Patent Document 1, merely with respect to a channel whose sound beam cannot reach a listener, an audio signal is virtually localized to exclusively output a sound beam and a sound for making a virtual sound source perceived, and for improving the localization feeling, the sound beam and the sound for making a virtual sound source perceived can be simultaneously output.

It has been conventionally proposed to add a sound field effect to sounds of a content. The sound field effect refers to an effect in which a listener is allowed to experience a sense of presence as if he/she was in another space like an actual concert hall although he/she is actually in his/her own room by superimposing, onto sounds of a content, sounds simulating an initial reflected sound and a rear reverberation sound generated in an acoustic space like a concert hall.

Here, the initial reflected sound refers to a sound, among from the whole sounds output from a sound source, reaching a listener after being reflected several times on an inside wall or the like of the concert hall, and reaches the listener later than a sound reaching the listener directly from the sound source. Since the initial reflected sound is reflected by a smaller number of times than the rear reverberation sound, its reflection pattern is different depending on the reaching direction. Accordingly, the initial reflected sound has a different frequency characteristic depending on the reaching direction.

The rear reverberation sound refers to a sound reaching a listener after being reflected on an inside wall or the like of the concert hall by a larger number of times than the initial reflected sound, and reaches the listener later than the initial reflected sound. Since the rear reverberation sound is reflected by a larger number of times than the initial reflected sound, its reflection pattern is substantially uniform regardless of the reaching direction. Accordingly, the rear reverberation sound has substantially the same frequency component regardless of the reaching direction. Hereinafter, a sound simulating an actual initial reflected sound is designated simply as an initial reflected sound, and a sound simulating an actual rear reverberation sound is designated simply as a rear reverberation sound.

In a speaker apparatus that outputs both a sound having a directivity and a sound for making a virtual sound source perceived by using the same channel, however, if the initial reflected sound and the rear reverberation sound are superimposed on the sound having a directivity and the sound for making a virtual sound source perceived, there arise the following problems:

If the initial reflected sound having a different frequency characteristic depending on the reaching direction is superimposed on the sound for making a virtual sound source perceived, the frequency characteristic of the head-related transfer function added for generating a virtual sound source is changed, and hence the localization becomes indistinctive. Besides, if the rear reverberation sound having substantially the same frequency component regardless of the reaching direction is superimposed on the sound beam having a directivity, audio signals of the respective channels tend to be similar to one another, and hence, sound images are combined to one another, resulting in making the localization indistinctive.

Besides, the sound beam described in Patent Document 1 cannot generate a surround sound field as desired by a listener under some environment. The sound beam is difficult to reach a listener under an environment where a distance from a wall is large or an environment where a wall is difficult to reflect the sound beam. In such a case, the listener has a difficulty in perceiving a sound source.

On the other hand, in the method using a virtual sound source, the localization feeling cannot be sufficiently provided in some cases as compared with the method using a sound beam. For example, in the method using a virtual sound source, if a listening position is shifted, the localization feeling is liable to be weakened. Besides, since the method using a virtual sound source is based on the shape of the head of a listener, there are individual differences in the localization feeling.

Accordingly, an object of the present invention is to provide a speaker apparatus capable of distinctively localizing a sound source by employing localization based on a virtual sound source while taking advantages of the characteristic of a sound beam.

Besides, another object of the present invention is to provide a speaker apparatus capable of distinctively localizing a sound source in an intended direction even if a sound beam is used.

Still another object of the present invention is to provide a speaker apparatus that outputs a sound for making a virtual sound source perceived and does not impair the localization feeling even when a sound field effect is added.

Still another object of the present invention is to provide a speaker apparatus that shows a higher effect to make a listener perceive a sound source than that attained by a conventional method using a sound beam alone and a conventional method using a virtual sound source alone.

Means for Solving the Problems

The speaker apparatus of the present invention includes an input portion to which audio signals of a plurality of channels are input; a plurality of speakers; a directivity controlling portion that delays the audio signals of the plurality of channels input to the input portion and distributes the delayed audio signals to the plurality of speakers so that the plurality of speakers output a plurality of sound beams; and a localization adding portion that applies a filtering processing based on a head-related transfer function to at least one of the audio signals of the plurality of channels input to the input portion and inputs the processed audio signal to the plurality of speakers.

Besides, the audio signal processing method of the present invention includes an input step of inputting audio signals of a plurality of channels; a directivity controlling step of delaying the audio signals of the plurality of channels input in the input step and distributing the delayed audio signals to the plurality of speakers so that a plurality of speakers output a plurality of sound beams; and a localization adding step of applying a filtering processing based on a head-related transfer function to at least one of the audio signals of the plurality of channels input in the input step and inputting the processed signal to the plurality of speakers.

Advantageous Effects of the Invention

According to a speaker apparatus and an audio signal processing method of the present invention, a localization feeling is provided by using both a sound beam and a virtual sound source, and therefore, a sound source can be distinctively localized by employing localization based on a virtual sound source while taking advantages of the characteristic of a sound beam.

According to the speaker apparatus and the audio signal processing method of the present invention, even when a sound beam is used, a sound source can be distinctively localized in an intended direction.

According to the speaker apparatus and the audio signal processing method of the present invention, even when a sound field effect is added, the frequency characteristic of a head-related transfer function can be retained so as not to impair the localization feeling because the characteristic of an initial reflected sound having a different frequency characteristic depending on the reaching direction is not added to a sound for making a virtual sound source perceived.

According to the speaker apparatus and the audio signal processing method of the present invention, since a localization feeling is provided by using both a sound beam and a virtual sound source, the localization feeling is stronger than that provided by a conventional method using a sound beam alone or by a conventional method using a virtual sound source alone.

MODE FOR CARRYING OUT THE INVENTION

First Embodiment

Figure 1:
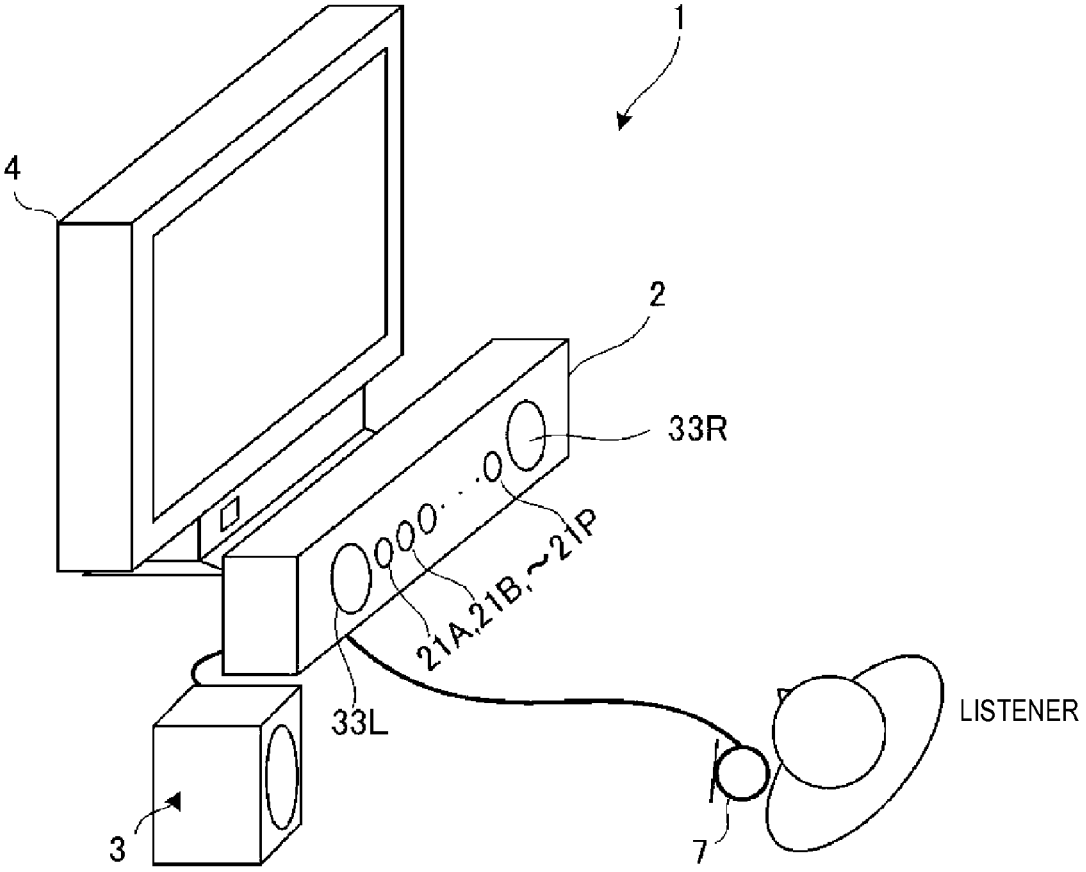
FIG. 1 is a schematic diagram illustrating the constitution of an AV system.

FIG. 1 is a schematic diagram of an AV system 1 including an array speaker apparatus 2 of the present embodiment. The AV system 1 includes the array speaker apparatus 2, a subwoofer 3, a television 4 and a microphone 7. The array speaker apparatus 2 is connected to the subwoofer 3 and the television 4. To the array speaker apparatus 2, audio signals in accordance with images reproduced by the television 4 and audio signals from a content player not shown are input.

The array speaker apparatus 2 has, as illustrated in FIG. 1, for example, a rectangular parallelepiped housing, and is installed in the vicinity of the television 4 (in a position below a display screen of the television 4). The array speaker apparatus 2 includes, on a front surface thereof (a surface opposing a listener), for example, sixteen speaker units 21A to 21P, a woofer 33L and a woofer 33R. In this example, the speaker units 21A to 21P, the woofer 33L and the woofer 33R correspond to "a plurality of speakers" of the present invention.

The speaker units 21A to 21P are linearly arranged along the lateral direction when seen from a listener. The speaker unit 21A is disposed in the leftmost position when seen from the listener, and the speaker unit 21P is disposed in the rightmost position when seen from the listener. The woofer 33L is disposed on the further left side of the speaker unit 21A. The woofer 33R is disposed on the further right side of the speaker unit 21P.

It is noted that the number of speaker units is not limited to sixteen but may be, for example, eight or the like. Besides, the arrangement is not limited to the linear lateral arrangement but may be, for example, lateral arrangement in three lines or the like.

The subwoofer 3 is disposed in the vicinity of the array speaker apparatus 2. In the example illustrated in FIG. 1, it is disposed on the left side of the array speaker apparatus 2, but the installation position is not limited to this exemplified position.

Besides, to the array speaker apparatus 2, the microphone 7 to be used for measuring a listening environment is connected. The microphone 7 is installed in a listening position. The microphone 7 is used in measuring the listening environment, and need not be installed in actually viewing a content.

Figure 2:
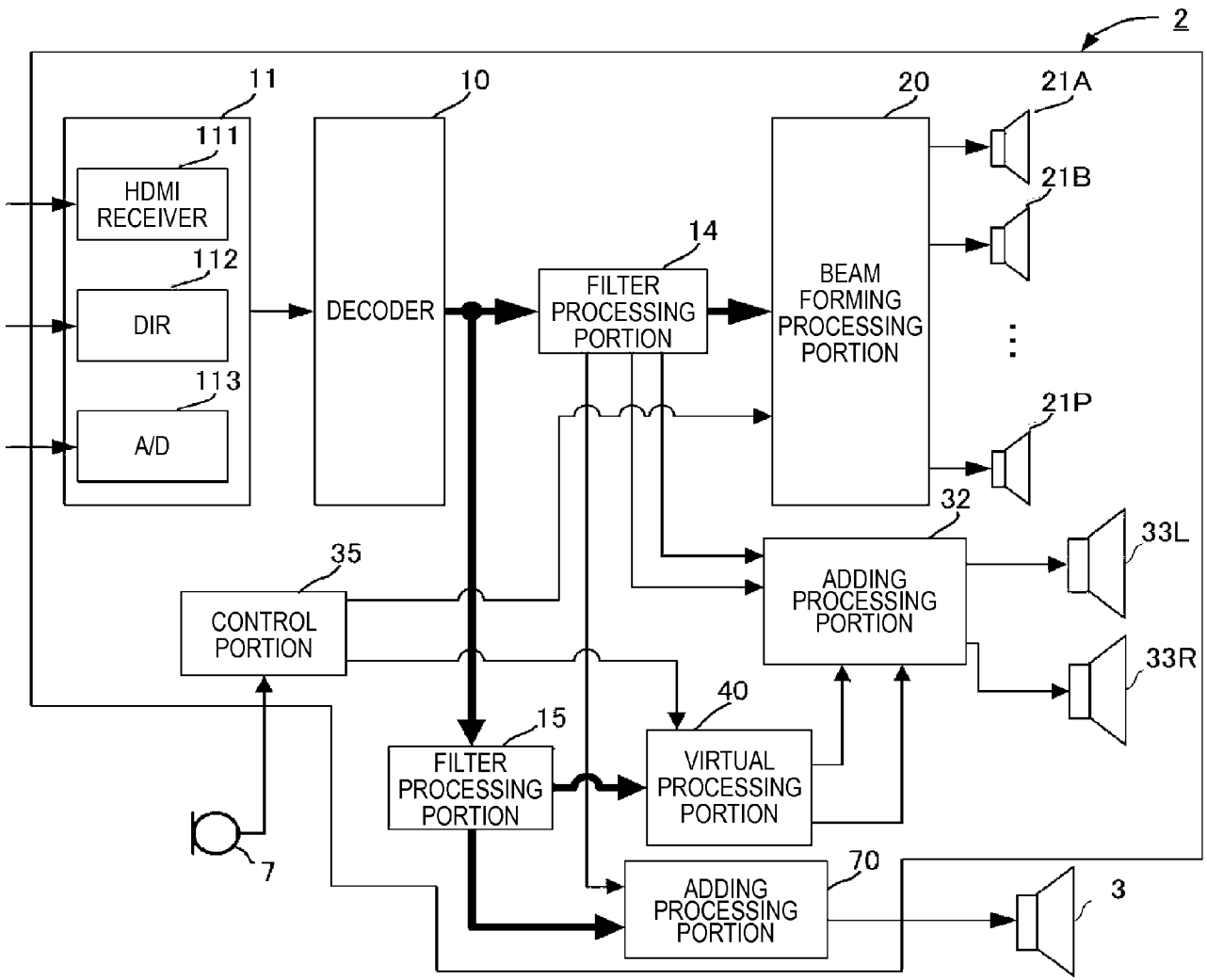
FIG. 2 is a block diagram illustrating the configuration of an array speaker apparatus.

FIG. 2 is a block diagram illustrating the configuration of the array speaker apparatus 2. The array speaker apparatus 2 includes an input portion 11, a decoder 10, a filtering processing portion 14, a filtering processing portion 15, a beam forming processing portion 20, an adding processing portion 32, an adding processing portion 70, a virtual processing portion 40 and a control portion 35.

The input portion 11 includes an HDMI receiver 111, a DIR 112 and an A/D conversion portion 113. The HDMI receiver 111 receives, as an input, an HDMI signal according to the HDMI standard and outputs it to the decoder 10. The DIR 112 receives, as an input, a digital audio signal (SPDIF) and outputs it to the decoder 10. The A/D conversion portion 113 receives, as an input, an analog audio signal, converts it into a digital audio signal and outputs the converted signal to the decoder 10.

The decoder 10 includes a DSP and decodes a signal input thereto. The decoder 10 receives, as an input, a signal of various formats such as AAC (registered trademark), Dolby Digital (registered trademark), DTS (registered trademark), MPEG-1/2, MPEG-2 multi-channel and MP3, converts the signal into a multi-channel audio signal (a digital audio signal of an FL channel, an FR channel, a C channel, an SL channel and an SR channel: it is noted that simple designation of an audio signal used hereinafter refers to a digital audio signal), and outputs the converted signal. A thick solid line of FIG. 2 indicates a multi-channel audio signal. It is noted that the decoder 10 also has a function to expand, for example, a stereo-channel audio signal into a multi-channel audio signal.

The multi-channel audio signal output from the decoder 10 is input to the filtering processing portion 14 and the filtering processing portion 15. The filtering processing portion 14 extracts, from the multi-channel audio signal output from the decoder 10, a band suitable to each of the speaker units, and outputs the resultant.

Figure 3A:
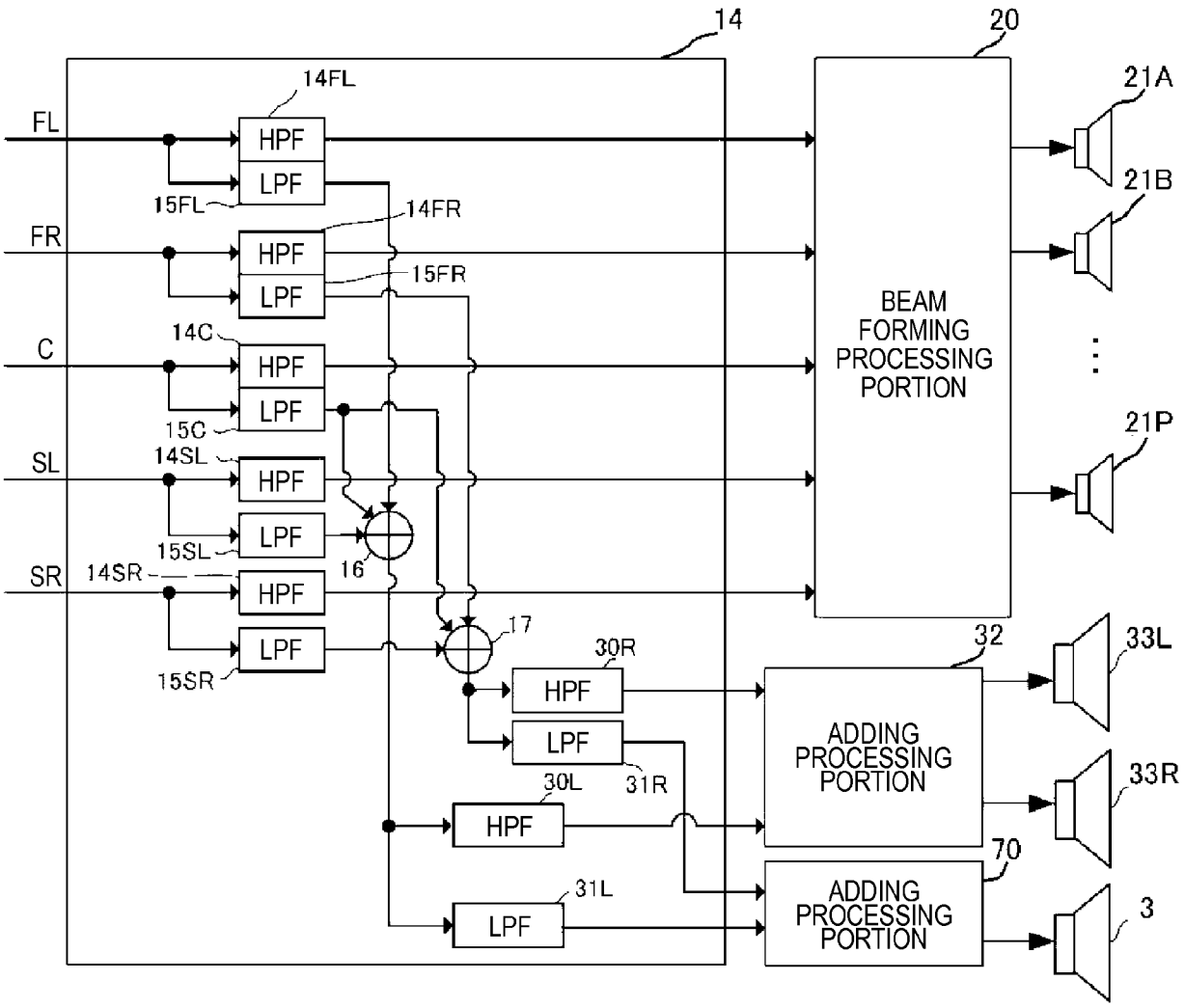
FIGS. 3(A) and 3(B) are block diagrams illustrating the configurations of filter processing portions.
Figure 3B:
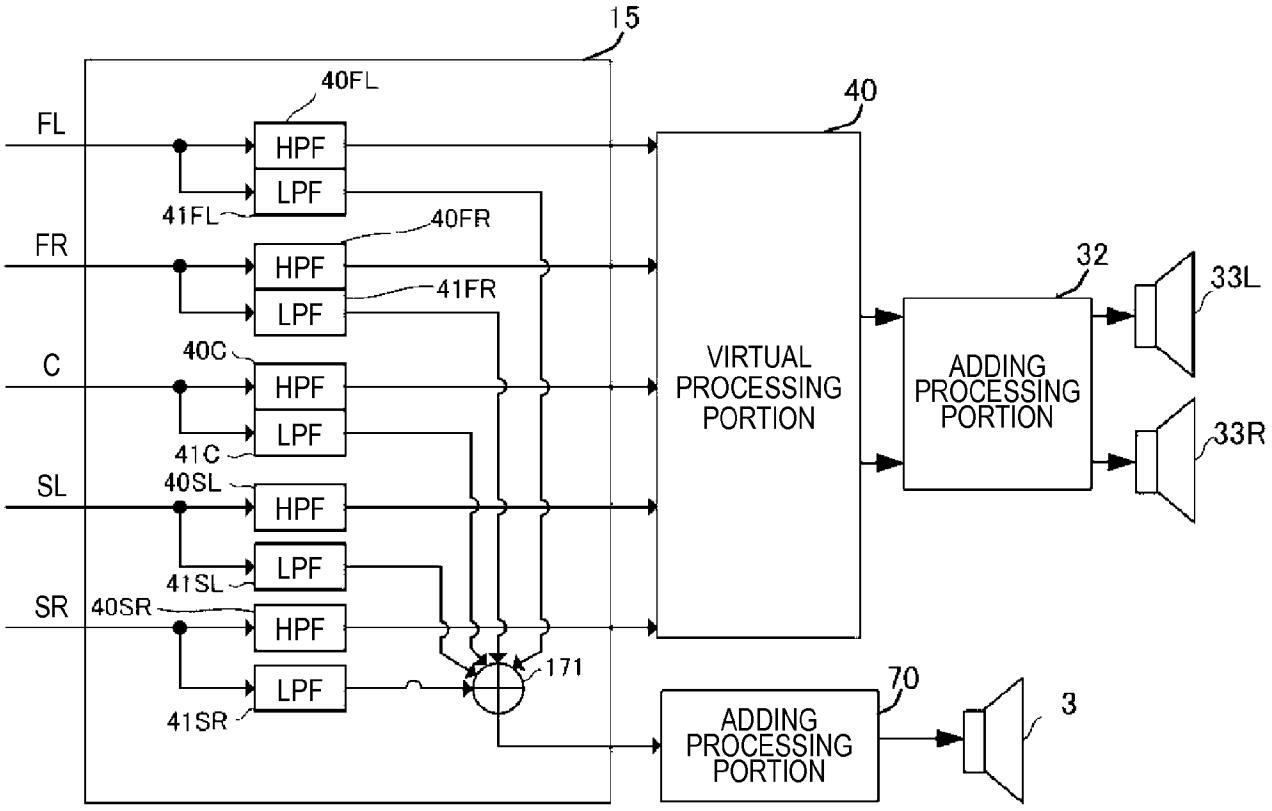

FIG. 3(A) is a block diagram illustrating the configuration of the filtering processing portion 14, and FIG. 3(B) is a block diagram illustrating the configuration of the filtering processing portion 15.

The filtering processing portion 14 includes an HPF 14FL, an HPF 14FR, an HPF 14C, an HPF 14SL and an HPF 14SR respectively receiving, as inputs, digital audio signals of the FL channel, the FR channel, the C channel, the SL channel and the SR channel. The filtering processing portion 14 further includes an LPF 15FL, an LPF 15FR, an LPF 15C, an LPF 15SL and an LPF 15SR respectively receiving, as inputs, the digital audio signals of the FL channel, the FR channel, the C channel, the SL channel and the SR channel.

Each of the HPF 14FL, the HPF 14FR, the HPF 14C, the HPF 14SL and the HPF 14SR extracts a high frequency component of the audio signal of the corresponding channel input thereto, and outputs the resultant. The cut-off frequency of the HPF 14FL, HPF 14FR, the HPF 14C, the HPF 14SL and the HPF 14SR is set in accordance with the lower limit (of, for example, 200 Hz) of the reproduction frequency of the speaker units 21A to 21P. The output signals from the HPF 14FL, the HPF 14FR, the HPF 14C, the HPF 14SL and the HPF 14SR are output to the beam forming processing portion 20.

Each of the LPF 15FL, the LPF 15FR, the LPF 15C, the LPF 15SL and the LPF 15SR extracts a low frequency component (of, for example, lower than 200 Hz) of the audio signal of the corresponding channel input thereto, and outputs the resultant. The cut-off frequency of the LPF 15FL, LPF 15FR, the LPF 15C, the LPF 15SL and the LPF 15SR corresponds to the cut-off frequency of the HPF 14FL, the HPF 14FR, the HPF 14C, the HPF 14SL and the HPF 14SR (and is, for example, 200 Hz).

The output signals from the LPF 15FL, the LPF 15C and the LPF 15SL are added up by an adding portion 16 to generate an L channel audio signal. The L channel audio signal is further input to an HPF 30L and an LPF 31L.

The HPF 30L extracts a high frequency component of the audio signal input thereto and outputs the resultant. The LPF 31L extracts a low frequency component of the audio signal input thereto and outputs the resultant. The cut-off frequency of the HPF 30L and the LPF 31L corresponds to a cross-over frequency (of, for example, 100 Hz) between the woofer 33L and the subwoofer 3. It is noted that the cross-over frequency may be configured to be changeable by a listener.

The output signals from the LPF 15FR, the LPF 15C and the LPF 15SR are added up by an adding portion 17 to generate an R channel audio signal. The R channel audio signal is further input to an HPF 30R and an LPF 31R.

The HPF 30R extracts a high frequency component of the audio signal input thereto and outputs the resultant. The LPF 31R extracts a low frequency component of the audio signal input thereto and outputs the resultant. The cut-off frequencies of the HPF 30R and the HPF 31R corresponds to a cross-over frequency (of, for example, 100 Hz) between the woofer 33R and the subwoofer 3. As described above, the cross-over frequency may be configured to be changeable by a listener.

The audio signal output from the HPF 30L is input to the woofer 33L via an adding processing portion 32. Similarly, the audio signal output from the HPF 30R is input to the woofer 33R via the adding processing portion 32.

The audio signal output from the LPF 31L and the audio signal output from the LPF 31R are added up to be converted into a monaural signal by an adding processing portion 70, and the resultant is input to the subwoofer 3. Although not illustrated in the drawing, the adding processing portion 70 also receives, as an input, an LFE channel signal to be added to the audio signal output from the LPF 31L and the audio signal output from the LPF 31R, and the resultant is output to the subwoofer 3.

On the other hand, the filtering processing portion 15 includes an HPF 40FL, an HPF 40FR, an HPF 40C, an HPF 40SL and an HPF 40SR respectively receiving, as inputs, the digital audio signals of the FL channel, the FR channel, the C channel, the SL channel and the SR channel. The filtering processing portion 15 further includes an LPF 41FL, an LPF 41FR, an LPF 41C, an LPF 41SL and an LPF 41SR respectively receiving, as inputs, the digital audio signals of the FL channel, the FR channel, the C channel, the SL channel and the SR channel.

Each of the HPF 40FL, the HPF 40FR, the HPF 40C, the HPF 40SL and the HPF 40SR extracts a high frequency component of the audio signal of the corresponding channel input thereto, and outputs the resultant. The cut-off frequency of the HPF 40FL, HPF 40FR, the HPF 40C, the HPF 40SL and the HPF 40SR corresponds to the cross-over frequency (of, for example, 100 Hz) between the woofers 33R and 33L and the subwoofer 3. The cross-over frequency can be configured to be changeable by a listener as described above. The cut-off frequency of the HPF 40FL, the HPF 40FR, HPF 40C, the HPF 40SL and the HPF 40SR may be the same as the cut-off frequency of the HPF 14FL, the HPF 14FR, the HPF 14C, the HPF 14SL and the HPF 14SR. In an alternative aspect, the filtering processing portion 15 may include merely the HPF 40FL, the HPF 40FR, the HPF 40C, the HPF 40SL and the HPF 40SR so as not to output a low frequency component to the subwoofer 3. The audio signals output from the HPF 40FL, the HPF 40FR, the HPF 40C, the HPF 40SL and the HPF 40SR are output to the virtual processing portion 40.

Each of the LPF 41FL, the LPF 41FR, the LPF 41C, the LPF 41SL and the LPF 41SR extracts a low frequency component of the audio signal of the corresponding channel input thereto, and outputs the resultant. The cut-off frequency of the LPF 41FL, LPF 41FR, the LPF 41C, the LPF 41SL and the LPF 41SR corresponds to the above-described cross-over frequency (and is, for example, 100 Hz). The audio signals output from the LPF 41FL, the LPF 41FR, the LPF 41C, the LPF 41SL and the LPF 41SR are added up by an adder 171 to be converted into a monaural signal, and the resultant is input to the subwoofer 3 via the adding processing portion 70. In the adding processing portion 70, the audio signals output from the LPF 41FL, the LPF 41FR, the LPF 41C, the LPF 41SL and the LPF 41SR are added to the audio signals output from the LPF 31R and the LPF 31L, and the above-described LFE channel audio signal. Incidentally, the adding processing portion 70 may include a gain adjusting portion for changing an addition ratio among these signals.

Figure 4:
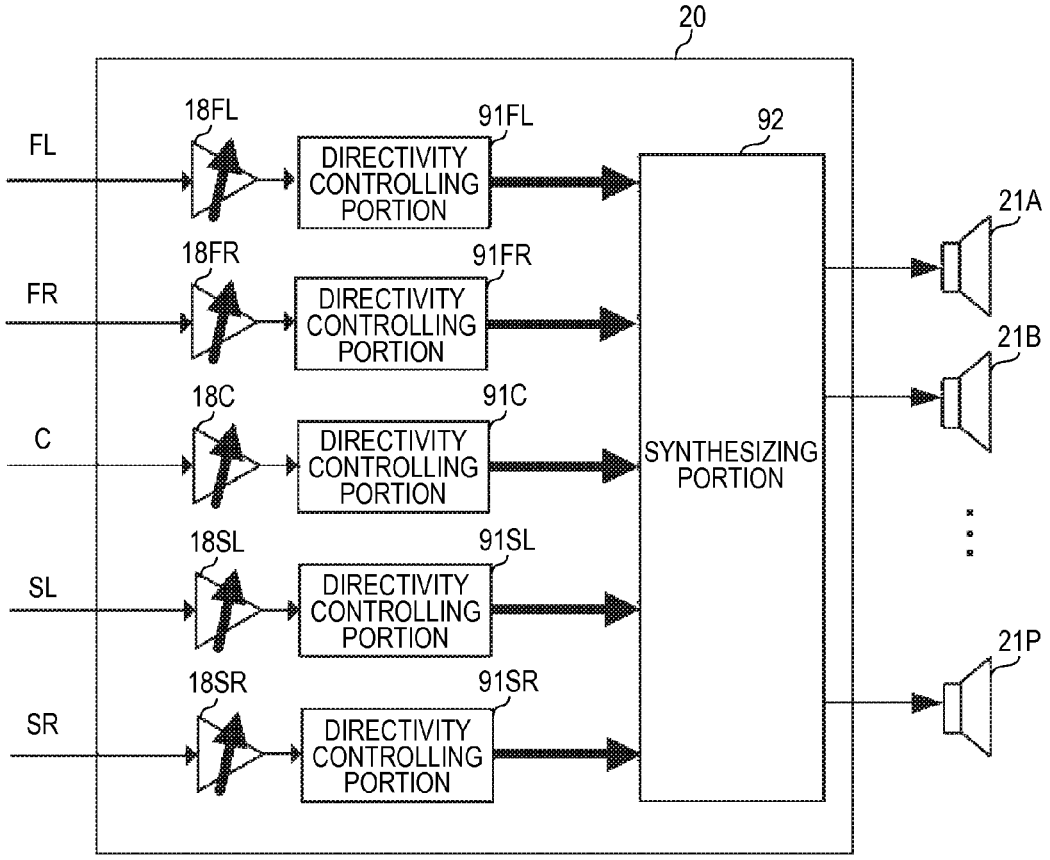
FIG. 4 is a block diagram illustrating the configuration of a beam forming processing portion.

Next, the beam forming processing portion 20 will be described. FIG. 4 is a block diagram illustrating the configuration of the beam forming processing portion 20. The beam forming processing portion 20 includes a gain adjusting portion 18FL, a gain adjusting portion 18FR, a gain adjusting portion 18C, a gain adjusting portion 18SL and a gain adjusting portion 18SR respectively receiving, as inputs, the digital audio signals of the FL channel, the FR channel, the C channel, the SL channel and the SR channel.

Each of the gain adjusting portion 18FL, the gain adjusting portion 18FR, the gain adjusting portion 18C, the gain adjusting portion 18SL and the gain adjusting portion 18SR adjusts a gain of the audio signal of the corresponding channel so as to control the volume level of the audio signal. The audio signals of the respective channels having been adjusted in the gain are respectively input to a directivity controlling portion 91FL, a directivity controlling portion 91FR, a directivity controlling portion 91C, a directivity controlling portion 91SL and a directivity controlling portion 91SR. Each of the directivity controlling portion 91FL, the directivity controlling portion 91FR, the directivity controlling portion 91C, the directivity controlling portion 91SL and the directivity controlling portion 91SR distributes the audio signal of the corresponding channel to the speaker units 21A to 21P. The distributed audio signals for the speaker units 21A to 21P are synthesized in a synthesizing portion 92 to be supplied to the speaker units 21A to 21P. At this point, the directivity controlling portion 91FL, the directivity controlling portion 91FR, the directivity controlling portion 91C, the directivity controlling portion 91SL and the directivity controlling portion 91SR adjust a delay amount of the audio signal to be supplied to each of the speaker units.

Sounds output from the speaker units 21A to 21P are mutually strengthened in a portion where they have the same phase, so as to be output as a sound beam having a directivity. For example, if sounds are output from all the speakers at the same timing, a sound beam having a directivity toward the front of the array speaker apparatus 2 is output. The directivity controlling portion 91FL, the directivity controlling portion 91FR, the directivity controlling portion 91C, the directivity controlling portion 91SL and the directivity controlling portion 91SR can change the outputting direction of a sound beam by changing the delay amounts to be given to the respective audio signals.

Besides, the directivity controlling portion 91FL, the directivity controlling portion 91FR, the directivity controlling portion 91C, the directivity controlling portion 91SL and the directivity controlling portion 91SR can also form a sound beam focused on a prescribed position by giving delay amounts so that the sounds output respectively from the speaker units 21A to 21P may have the same phase in the prescribed position.

Figure 5A:
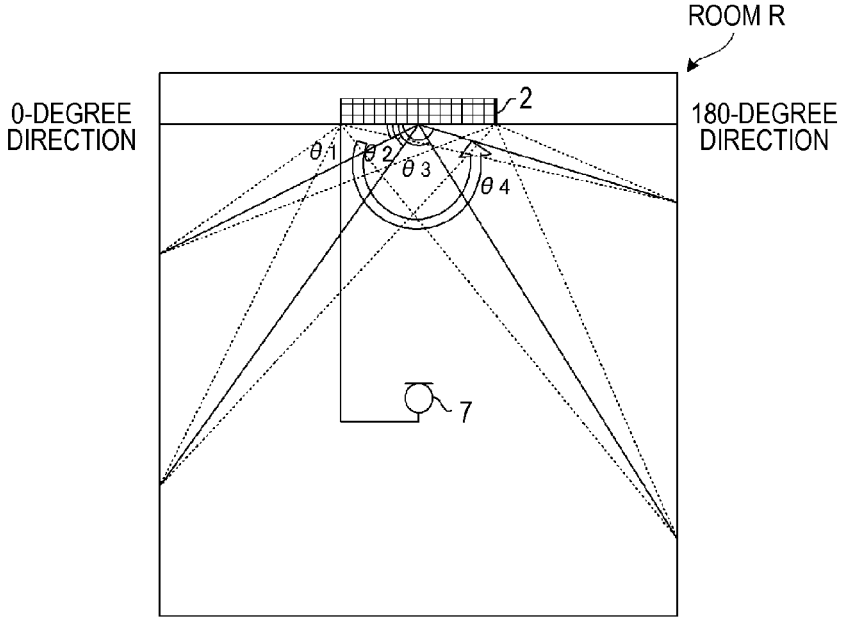
FIGS. 5(A), 5(B) and 5(C) are diagrams illustrating the relationship between a sound beam and channel setting.
Figure 5B:
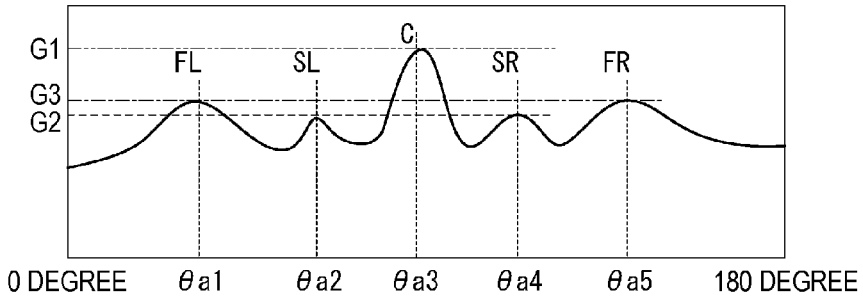
Figure 5C:
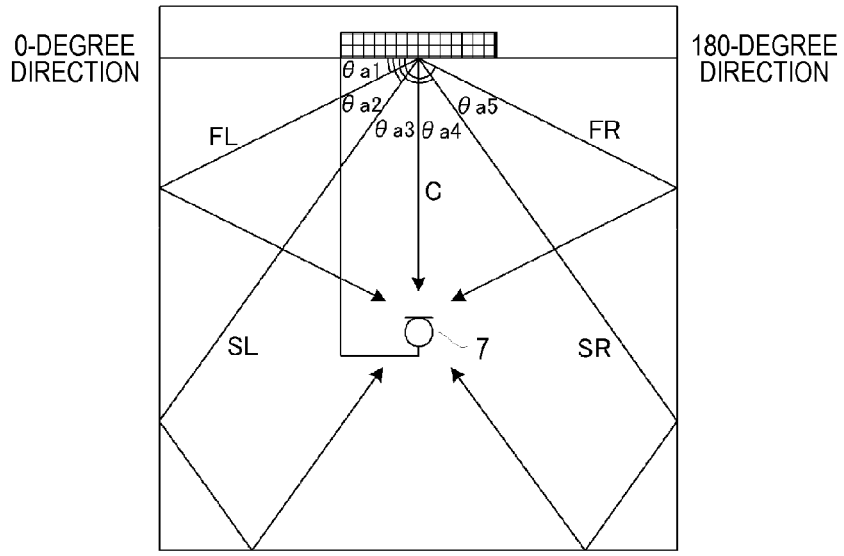

A sound beam can be caused to reach the listening position directly from the array speaker apparatus 2 or after being reflected on a wall or the like of the room. For example, as illustrated in FIG. 5(C), a sound beam of a C channel audio signal can be output in a front direction so that the sound beam of the C channel may reach the listening position from the front. Besides, sound beams of an FL channel audio signal and an FR channel audio signal can be output in leftward and rightward directions of the array speaker apparatus 2 so that these sound beams may be reflected on walls disposed on the left and right sides of the listening position to reach the listening position respectively from a left direction and a right direction. Furthermore, sound beams of an SL channel audio signal and an SR channel audio signal can be output in leftward and rightward directions so that these sound beams may be reflected twice on walls disposed on the right and left sides of and a wall behind the listening position to reach the listening position respectively from a left backward direction and a right backward direction.

These outputting directions of the sound beams can be automatically set by measuring the listening environment by using the microphone 7. As illustrated in FIG. 5(A), when a listener installs the microphone 7 in the listening position and operates a remote controller or a body operation portion not shown for instructing the setting of sound beams, the control portion 35 causes the beam forming processing portion 20 to output a sound beam of a test signal (of, for example, white noise).

The control portion 35 turns the sound beam from a left direction parallel to the front surface of the array speaker apparatus 2 (designated as the 0-degree direction) to a right direction parallel to the front surface of the array speaker apparatus 2 (designated as the 180-degree direction). When the sound beam is turned in front of the array speaker apparatus 2, the sound beam is reflected on a wall of the room R in accordance with a turning angle θ of the sound beam and picked up by the microphone 7 at a prescribed angle.

The control portion 35 analyzes the level of an audio signal input thereto from the microphone 7 as follows:

The control portion 35 stores the level of an audio signal input from the microphone 7 in a memory (not shown) in correspondence with an output angle of the sound beam. Then, the control portion 35 assigns, on the basis of a peak of the audio signal level, each channel of the multi-channel audio signal to the output angle of the sound beam. For example, the control portion 35 detects peaks beyond a prescribed threshold value in data of the sound picked up. The control portion 35 assigns an output angle of the sound beam corresponding to the highest level among these peaks as the output angle of the sound beam of the C channel. For example, in FIG. 5(B), an angle θ3*a* corresponding to the highest level is assigned as the output angle of the sound beam of the C channel. Besides, the control portion 35 assigns peaks, adjacent on both sides of the peak having been set for the C channel, as the output angles of the sound beams of the SL channel and the SR channel. For example, in FIG. 5(B), an angle θ2*a* close to the C channel on a side closer to the 180-degree direction is assigned as the output angle of the sound beam of the SL channel, and an angle θ4*a* close to the C channel on a side closer to the 180-degree direction is assigned as the output angle of the sound beam of the SR channel. Furthermore, the control portion 35 assigns the outermost peaks as the output angles of the sound beams of the FL channel and the FR channel. For example, in the example of FIG. 5(B), an angle θ1*a* closest to the 0-degree direction is assigned as the sound beam of the FL channel, and an angle θ5*a* closest to the 0-degree direction is assigned as the output angle of the sound beam of the FR channel. In this manner, the control portion 35 realizes detection portion for detecting differences in the level of sound beams of the respective channels reaching the listening position and a beam angle setting portion for setting output angles of the sound beams on the basis of peaks of the level measured by the detection portion.

In this manner, the setting for causing the sound beams to reach the position of a listener (the microphone 7) from around as illustrated in FIG. 5(C) is performed.

Figure 6:
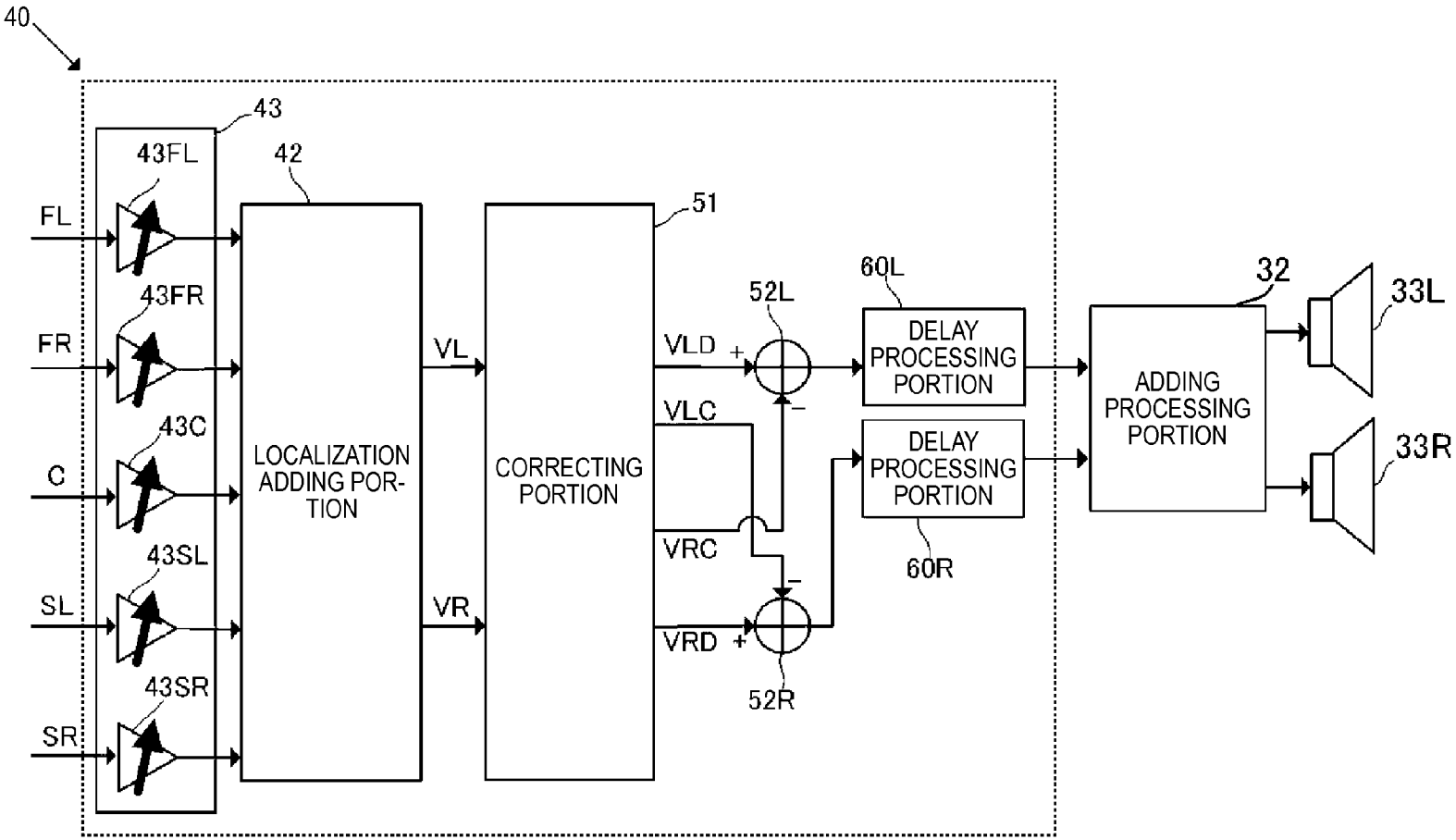
FIG. 6 is a block diagram illustrating the configuration of a virtual processing portion.

Next, the virtual processing portion 40 will be described. FIG. 6 is a block diagram illustrating the configuration of the virtual processing portion 40. The virtual processing portion 40 includes a level adjusting portion 43, a localization adding portion 42, a correcting portion 51, a delay processing portion 60L and a delay processing portion 60R.

The level adjusting portion 43 includes a gain adjusting portion 43FL, a gain adjusting portion 43FR, a gain adjusting portion 43C, a gain adjusting portion 43SL and a gain adjusting portion 43SR respectively receiving, as inputs, the digital audio signals of the FL channel, the FR channel, the C channel, the SL channel and the SR channel.

Each of the gain adjusting portion 43FL, the gain adjusting portion 43FR, the gain adjusting portion 43C, the gain adjusting portion 43SL and the gain adjusting portion 43SR controls the level of the audio signal of the corresponding channel by adjusting the gain of the audio signal. The gain of each gain adjusting portion is set by the control portion 35, working as a setting portion, on the basis of a detection result of a test sound beam. For example, the sound beam of the C channel is a direct sound as illustrated in FIG. 5(B), and hence is at the highest level. Accordingly, the gain of the gain adjusting portion 43C is set to be the lowest. Besides, since the sound beam of the C channel is a direct sound and hence there is a low possibility that it is varied depending upon the environment of the room, it may be set to, for example, a fixed value. With respect to the other gain adjusting portions, gains are set in accordance with level differences from the C channel. For example, assuming that a detection level G1 of the C channel is 1.0 and the gain of the gain adjusting portion 43C is set to 0.1, if a detection level G3 of the FR channel is 0.6, the gain of the gain adjusting portion 43FR is set to 0.4, and if a detection level G2 of the SR channel is 0.4, the gain of the gain adjusting portion 43SR is set to 0.6. In this manner, the gains for the respective channels are adjusted. Incidentally, the sound beam of the test signal is turned by the control portion 35 for detecting the difference in the level of the sound beams of the respective channels reaching the listening position in the example illustrated in FIGS. 5(A), 5(B) and 5(C), but in one aspect, a listener may instruct, manually by using a user interface not shown, the control portion 35 to output a sound beam so as to detect differences in the level of the sound beams of the respective channels reaching the listening position. Besides, for the setting of the gain adjusting portion 43FL, the gain adjusting portion 43FR, the gain adjusting portion 43C, the gain adjusting portion 43SL and the gain adjusting portion 43SR, the level of each channel may be measured separately from the levels detected with the test sound beam swept. Specifically, this method can be performed by outputting a test sound beam in a direction determined, for each channel, by the test sound beam swept, and analyzing a sound picked up in the listening position by the microphone 7.

The audio signal of each channel having been adjusted in the gain is input to the localization adding portion 42. The localization adding portion 42 performs processing for localizing the input audio signal of each channel in a prescribed position as a virtual sound source. In order to localize the audio signal as a virtual sound source, a head-related transfer function (hereinafter referred to as the HRTF) corresponding to a transfer function between a prescribed position and an ear of a listener is employed.

The HRTF corresponds to an impulse response expressing the loudness, the reaching time, the frequency characteristic and the like of a sound emitted from a virtual speaker placed in a given position to right and left ears. The localization adding portion 42 can allow a listener to localize a virtual sound source by adding an HRTF to the audio signal of each channel input thereto and emitting the resultant from the woofer 33L or the woofer 33R.

Figure 7A:
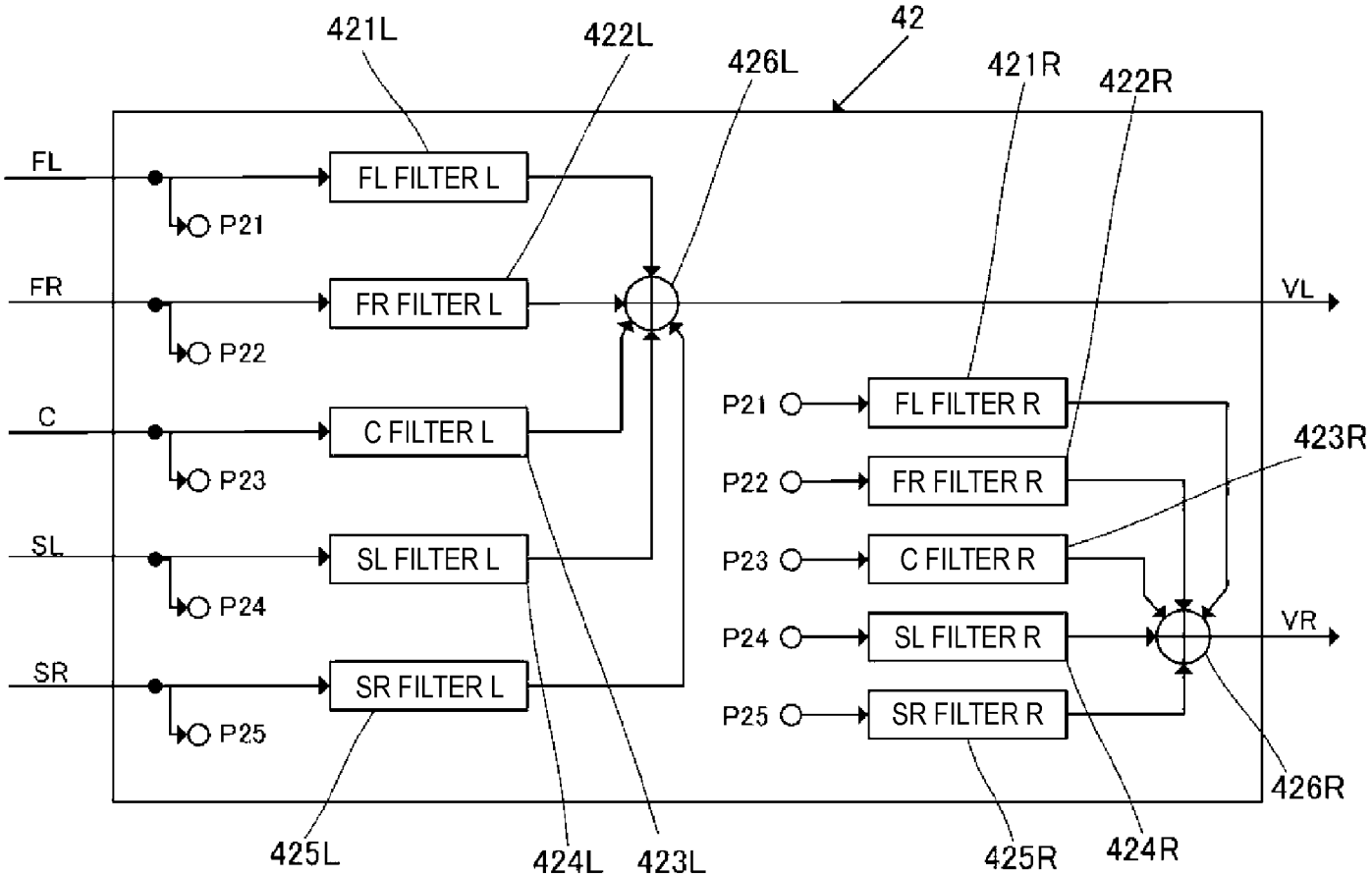
FIGS. 7(A) and 7(B) are block diagrams illustrating the configurations of a localization adding portion and a correcting portion.

FIG. 7(A) is a block diagram illustrating the configuration of the localization adding portion 42. The localization adding portion 42 includes an FL filter 421L, an FR filter 422L, a C filter 423L, an SL filter 424L and an SR filter 425L, and an FL filter 421R, an FR filter 422R, a C filter 423R, an SL filter 424R and an SR filter 425R for convolving the impulse response of the HRTF to the audio signals of the respective channels.

For example, an audio signal of the FL channel is input to the FL filter 421L and the FL filter 421R. The FL filter 421L applies, to the audio signal of the FL channel, an HRTF corresponding to a path from the position of a virtual sound source VSFL (see FIG. 8(A)) disposed on a left forward side of a listener to his/her left ear. The FL filter 421R applies, to the audio signal of the FL channel, an HRTF corresponding to a path from the position of the virtual sound source VSFL to the listener's right ear. With respect to each of the other channels, an HRTF corresponding to a path from the position of a virtual sound source disposed around the listener to his/her right or left ear is similarly applied.

An adding portion 426L synthesizes the audio signals to which the HRTFs have been applied by the FL filter 421L, the FR filter 422L, the C filter 423L, the SL filter 424L and the SR filter 425L, and outputs the resultant as an audio signal VL to the correcting portion 51. An adding portion 426R synthesizes the audio signals to which the HRTFs have been applied by the FL filter 421R, the FR filter 422R, the C filter 423R, the SL filter 424R and the SR filter 425R, and outputs the resultant as an audio signal VR to the correcting portion 51.

Figure 7B:
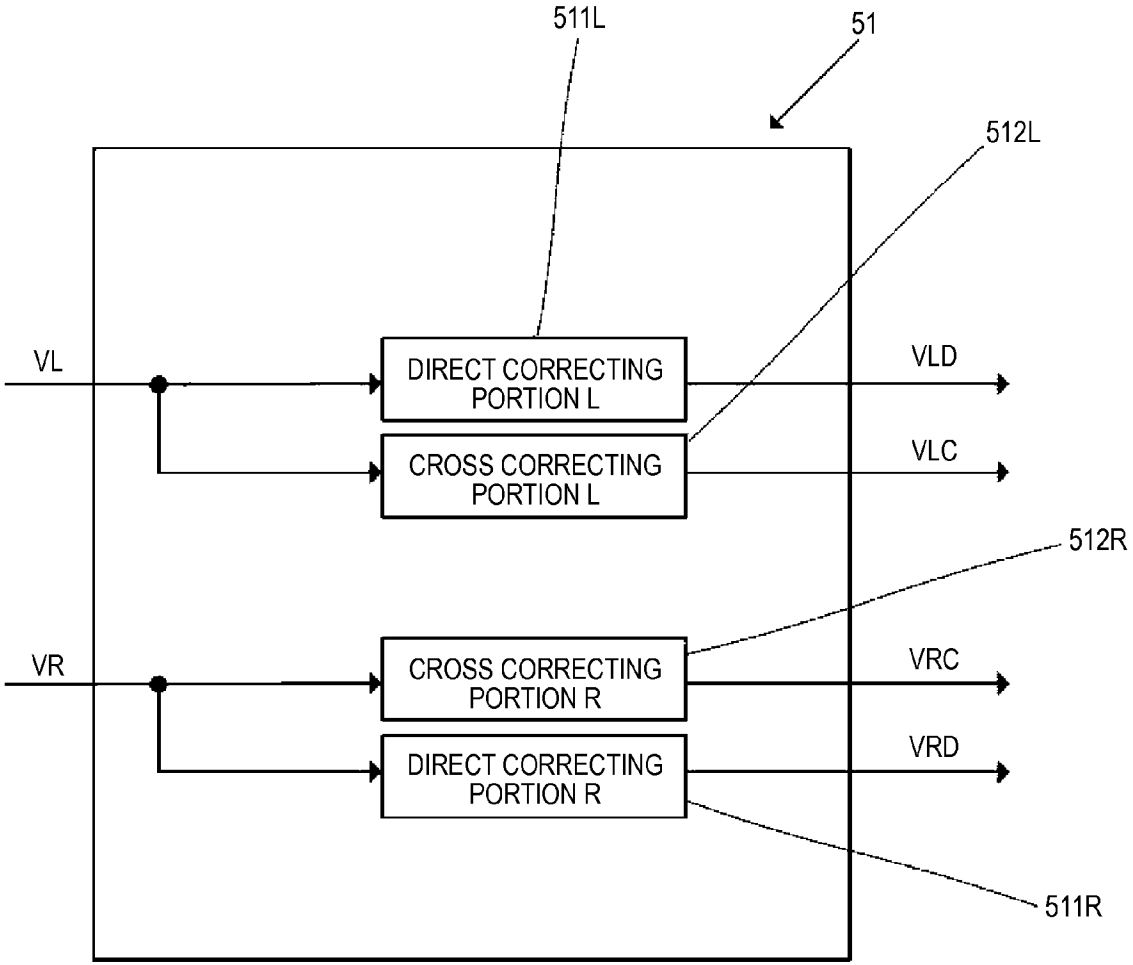

The correcting portion 51 performs crosstalk cancellation processing. FIG. 7(B) is a block diagram illustrating the configuration of the correcting portion 51. The correcting portion 51 includes a direct correcting portion 511L, a direct correcting portion 511R, a cross correcting portion 512L and a cross correcting portion 512R.

The audio signal VL is input to the direct correcting portion 511L and the cross correcting portion 512L. The audio signal VR is input to the direct correcting portion 511R and the cross correcting portion 512R.

The direct correcting portion 511L performs processing for causing a listener to perceive as if a sound output from the woofer 33L was emitted in the vicinity of his/her left ear. The direct correcting portion 511L has a filter coefficient set for making the frequency characteristic of the sound output from the woofer 33L flat in the position of the left ear. The direct correcting portion 511L processes the audio signal VL input thereto with this filter, so as to output an audio signal VLD. The direct correcting portion 511R has a filter coefficient set for making the frequency characteristic of a sound output from the woofer 33R flat in the position of the listener's right ear. The direct correcting portion 511R processes the audio signal VL input thereto with this filter, so as to output an audio signal VRD.

The cross correcting portion 512L has a filter coefficient set for adding a frequency characteristic of a sound routing around from the woofer 33L to the right ear. The sound (VLC) routing around from the woofer 33L to the right ear is reversed in phase by a synthesizing portion 52R to emit the resultant from the woofer 33R, and thus, the sound from the woofer 33L can be inhibited from being heard by the right ear. In this manner, the listener is made to perceive as if the sound emitted from the woofer 33R was emitted in the vicinity of his/her right ear.

The cross correcting portion 512R has a filter coefficient set for adding a frequency characteristic of a sound routing around from the woofer 33R to the left ear. The sound (VRC) routing around from the woofer 33R to the left ear is reversed in phase by a synthesizing portion 52L to emit the resultant from the woofer 33L, and thus, the sound from the woofer 33R can be inhibited from being heard by the left ear. In this manner, the listener is made to perceive as if the sound emitted from the woofer 33L was emitted in the vicinity of his/her left ear.

The audio signal output from the synthesizing portion 52L is input to the delay processing portion 60L. The audio signal having been delayed by a prescribed time by the delay processing portion 60L is input to the adding processing portion 32. Besides, the audio signal output from the synthesizing portion 52R is input to the delay processing portion 60R. The audio signal having been delayed by a prescribed time by the delay processing portion 60R is input to the adding processing portion 32.

The delay time caused by each of the delay processing portion 60L and the delay processing portion 60R is set to be, for example, longer than the longest delay time given by the directivity controlling portions of the beam forming processing portion 20. Thus, a sound for making a virtual sound source perceived does not impede the formation of a sound beam. Incidentally, in one aspect, a delay processing portion may be provided in a stage following the beam forming processing portion 20 for adding a delay to a sound beam so that the sound beam may not impede a sound for localizing a virtual sound source.

The audio signal output from the delay processing portion 60L is input to the woofer 33L via the adding processing portion 32. In the adding processing portion 32, the audio signal output from the delay processing portion 60L and the audio signal output from the HPF 30L are added up. Incidentally, the adding processing portion 32 may include a constitution of a gain adjusting portion for changing an addition ratio between these audio signals. Similarly, the audio signal output from the delay processing portion 60R is input to the woofer 33R via the adding processing portion 32. In the adding processing portion 32, the audio signal output from the delay processing portion 60R and the audio signal output from the HPF 30R are added up. The adding processing portion 32 may include a constitution of a gain adjusting portion for changing an addition ratio between these audio signals.

Figure 8A:
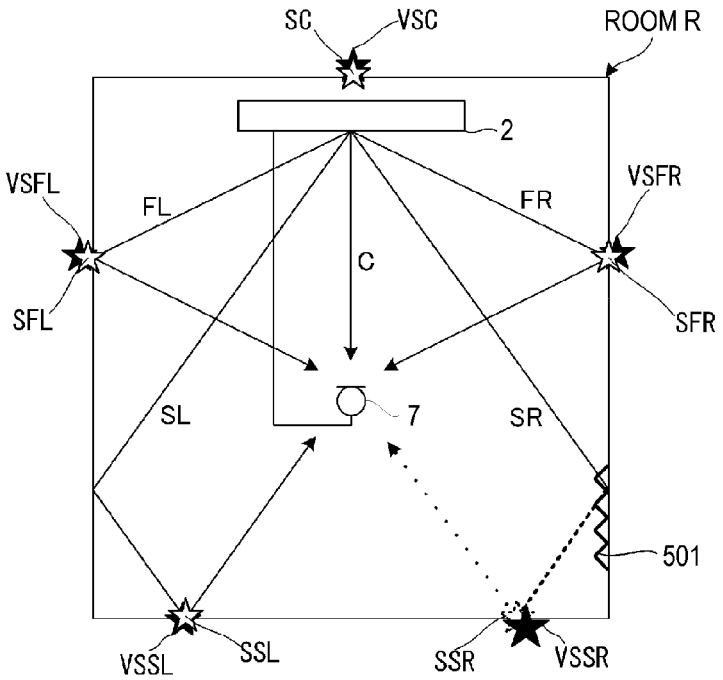
FIGS. 8(A), 8(B) and 8(C) are diagrams for explaining a sound field generated by the array speaker apparatus.

Next, a sound field generated by the array speaker apparatus 2 will be described with reference to FIG. 8(A). In FIG. 8(A), a solid arrow indicates the path of a sound beam output from the array speaker apparatus 2. In FIG. 8(A), a white star indicates the position of a sound source generated based on a sound beam, and a black star indicates the position of a virtual sound source.

In the example illustrated in FIG. 8(A), the array speaker apparatus 2 outputs five sound beams in the same manner as in the example illustrated in FIG. 5(C). For an audio signal of the C channel, a sound beam focused on a position behind the array speaker apparatus 2 is set. Thus, a listener perceives that a sound source SC is disposed in front of him/her.

Similarly, for an audio signal of the FL channel, a sound beam focused on a position on a wall of the room R on the left forward side is set, and the listener perceives that a sound source SFL is disposed on the wall on the left forward side of the listener. For an audio signal of the FR channel, a sound beam focused on a position on a wall of the room R on the right forward side is set, and the listener perceives that a sound source SFR is disposed on the wall on the right forward side of the listener. For an audio signal of the SL channel, a sound beam focused on a position on a wall of the room R on the left backward side is set, and the listener perceives that a sound source SSL is disposed on the wall on the left backward side of the listener. For an audio signal of the SR channel, a sound beam focused on a position on a wall on the right backward side is set, and the listener perceives that a sound source SSR is disposed on the wall on the right backward side of the listener.

Besides, the localization adding portion 42 sets positions of virtual sound sources in substantially the same positions as the sound sources SFL, SFR, SC, SSL and SSR described above. Accordingly, the listener perceives virtual sound sources VSC, VSFL, VSFR, VSSL and VSSR in positions substantially the same as the positions of the sound sources SFL, SFR, SC, SSL and SSR as illustrated in FIG. 8(A). Incidentally, there is no need to set the positions of the virtual sound sources in the same positions as the focal points of the sound beams, but they may be set in precedently determined directions. For example, the virtual sound source VSFL is set to 30 degrees to the left, the virtual sound source VSFR is set to 30 degrees to the right, the virtual sound source VSSL is set to 120 degrees to the left, and the virtual sound source VSSR is set to 120 degrees to the right, or the like.

In this manner, in the array speaker apparatus 2, the localization feeling based on the sound beams can be compensated by the virtual sound sources, and hence, the localization feeling can be improved as compared with a case where the sound beams alone are used or a case where the virtual sound sources alone are used. In particular, since the sound source SSL and the sound source SSR of the SL channel and the SR channel are generated by causing the sound beams to be reflected twice on the walls, a distinctive localization feeling cannot be attained in some cases as compared with that of the channels on the front side. In the array speaker apparatus 2, however, the localization feeling can be compensated by the virtual sound source VSSL and the virtual sound source VSSR generated by the woofer 33L and the woofer 33R by using the sounds directly reaching the ears of the listener, and therefore, the localization feeling of the SL channel and the SR channel cannot be impaired.

Then, as described above, the control portion 35 of the array speaker apparatus 2 detects the differences in the level of the sound beams of the respective channels reaching the listening position, and sets the levels in the gain adjusting portion 43FL, the gain adjusting portion 43FR, the gain adjusting portion 43C, the gain adjusting portion 43SL and the gain adjusting portion 43SR of the level adjusting portion 43 on the basis of the detected level differences. Thus, the levels (or the level ratios) between the respective channels of the localization adding portion 42 and the respective channels of the sound beams are adjusted.

Figure 8B:
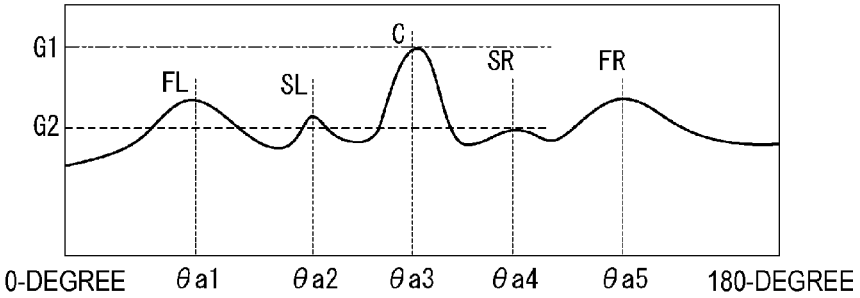

For example, there is a curtain 501 having a low acoustic reflectivity on the right side wall of the room R of FIG. 8(A), and a sound beam is difficult to be reflected on this wall. Accordingly, as illustrated in FIG. 8(B), the peak level at the angle θa4 is lower than those at the other angles. In this case, the level of the sound beam of the SR channel reaching the listening position is lower than those of the other channels.

Therefore, the control portion 35 sets the gain of the gain adjusting portion 43SR to be higher than those of the other gain adjusting portions, and sets the level in the localization adding portion to be higher for the SR channel than for the other channels, so as to enhance the effect of the localization addition based on the virtual sound source. In this manner, the control portion 35 sets the level ratios employed in the level adjusting portion 43 on the basis of the level differences detected by using the test sound beam. As a result, the localization feeling is strongly compensated by using a virtual sound source for a channel of which the localization feeling based on a sound beam is low. Also in this case, since the sound beam itself is output, there presents a localization feeling based on the sound beam, and hence, audibility connection among the channels can be retained without causing an uncomfortable feeling due to a virtual sound source generated for merely a specific channel.

Figure 8C:
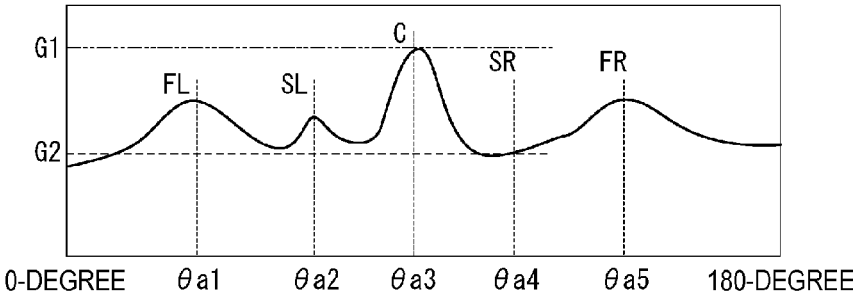

Incidentally, even if the number of detected peaks is smaller than the number of channels as illustrated in FIG. 8(C), the array speaker apparatus 2 preferably estimates a reaching angle of a sound beam so as to assign output angles of the sound beams of all the channels. For example, although no peak is detected, in the example illustrated in FIG. 8(C), at an angle where the SR channel should be assigned, the SR channel is assigned to the angle θa4, which is symmetrical to the angle θa2 with respect to the center angle of the angle θa3 corresponding to the highest level, for outputting the sound beam of the SR channel. Then, the control portion 35 sets the gain of the gain adjusting portion 43SR to be high in accordance with the level difference between the detection level G1 at the angle θa3 and the detection level G2 at the angle θa4. In this manner, since the sound beam itself is output also for the channel in which the effect of the localization addition based on a virtual sound source is set to be strong, the sound of the sound beam of this channel can be heard to some extent. Accordingly, the audibility connection among the channels can be retained without causing an uncomfortable feeling due to the virtual sound source generated for merely the specific channel.

Incidentally, in the present embodiment, although the gains of the respective gain adjusting portions of the level adjusting portion 43 are adjusted to control the level ratios between the respective channels of the localization adding portion 42 and the respective channels of the sound beam, in one aspect, the level ratios between the respective channels of the localization adding portion and the respective channels of the sound beam may be controlled by adjusting the gains of the gain adjusting portion 18FL, the gain adjusting portion 18FR, the gain adjusting portion 18C, the gain adjusting portion 18SL and the gain adjusting portion 18SR of the beam forming processing portion 20.

Figure 9A:
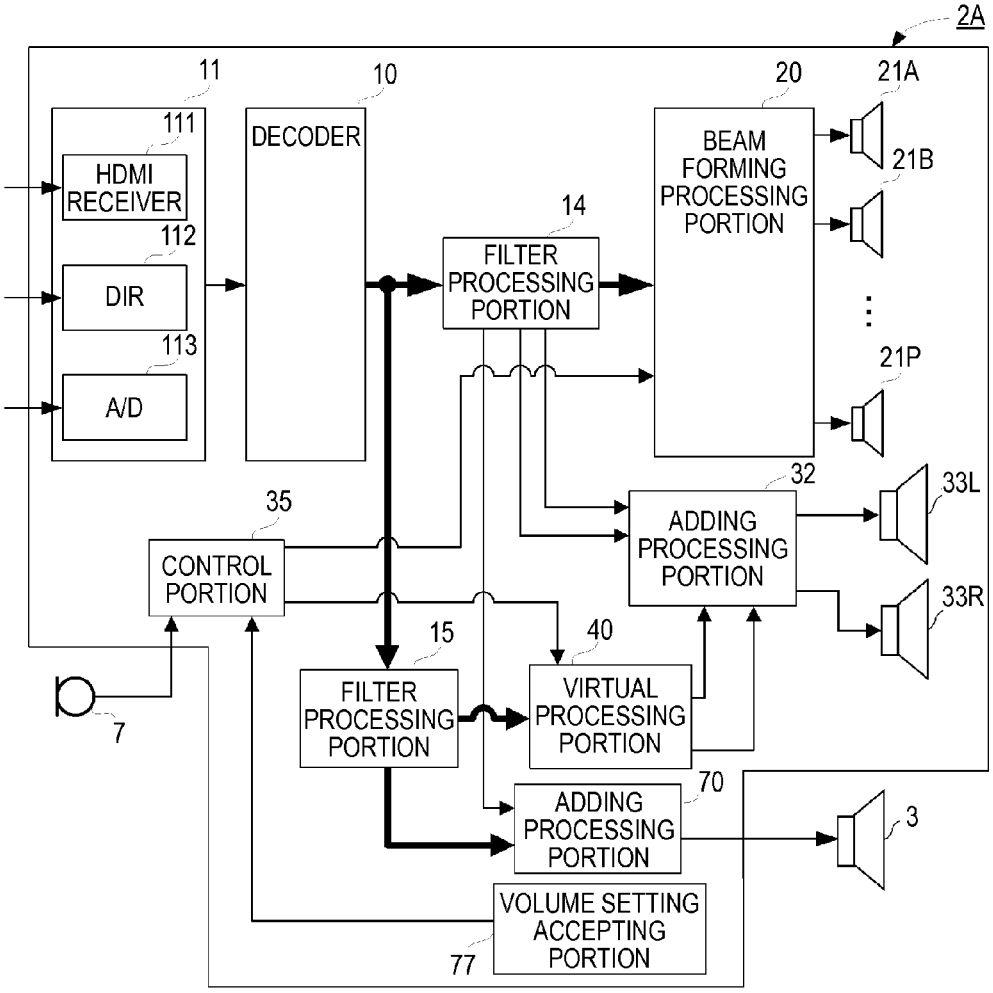
FIG. 9(A) is a block diagram illustrating the configuration of an array speaker apparatus according to Modification 1.

Next, FIG. 9(A) is a block diagram illustrating the configuration of an array speaker apparatus 2A according to Modification 1. Like reference numerals are used to refer to the constitution common to the array speaker apparatus 2 illustrated in FIG. 2 so as to herein omit the description.

The array speaker apparatus 2A further includes a volume setting accepting portion 77. The volume setting accepting portion 77 accepts the setting of a master volume from a listener. The control portion 35 adjusts the gain of a power amplifier not shown (such as an analog amplifier) in accordance with the setting of the master volume accepted by the volume setting accepting portion 77. Thus, the sound volumes of all the speaker units are changed all at once.

Figure 9B:
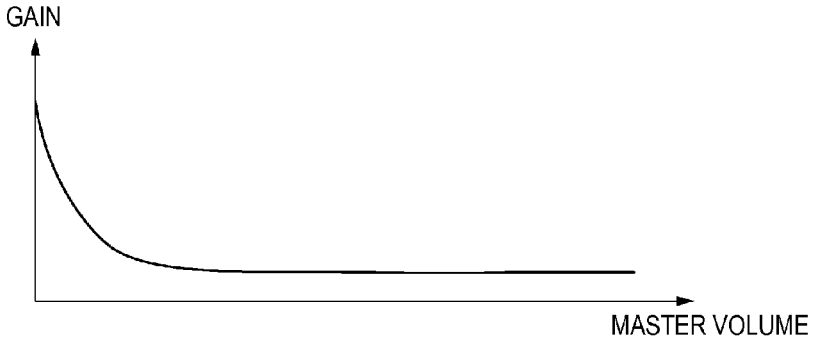
FIG. 9(B) is a diagram illustrating the relationship between a master volume and a gain in the array speaker apparatus of Modification 1.

Then, the control portion 35 sets the gains of all the gain adjusting portions of the level adjusting portion 43 in accordance with the setting of the master volume accepted by the volume setting accepting portion 77. For example, as illustrated in FIG. 9(B), the gains of all the gain adjusting portions of the level adjusting portion 43 are set to be higher as the value of the master volume is lower. When the master volume is set to be thus low, there is a possibility that the level of a reflected sound of a sound beam from a wall may be lowered to degrade the surround feeling. Therefore, the control portion 35 sets the level in the localization adding portion 42 to be higher as the value of the master volume is lower, so as to retain the surround feeling by enhancing the effect of the localization addition based on a virtual sound source.

Figure 10A:
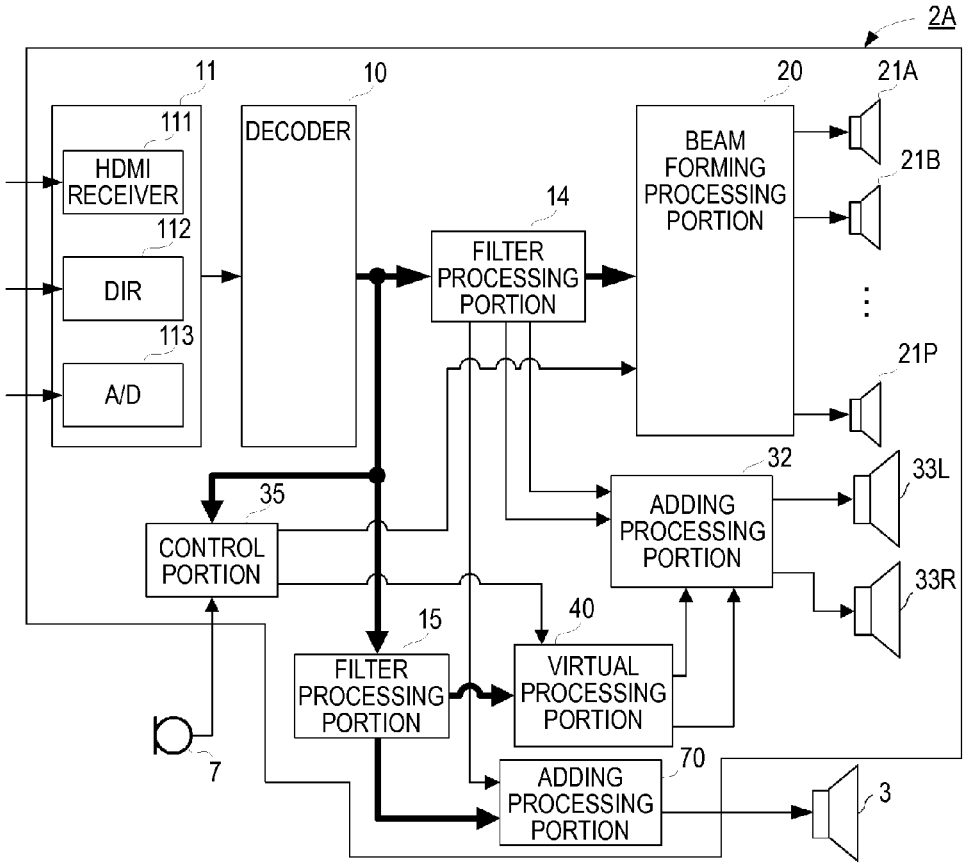
FIG. 10(A) is a block diagram illustrating the configuration of an array speaker apparatus according to Modification 2.

Next, FIG. 10(A) is a block diagram illustrating the configuration of an array speaker apparatus 2B according to Modification 2. Like reference numerals are used to refer to the constitution common to the array speaker apparatus 2 illustrated in FIG. 2 so as to herein omit the description.

In the array speaker apparatus 2B, the control portion 35 receives, as inputs, audio signals of the respective channels for comparing the levels of the audio signals of the respective channels (namely, works as comparison portion). The control portion 35 dynamically sets the gains of the respective gain adjusting portions of the level adjusting portion 43 on the basis of the comparison result.

Figure 10B:
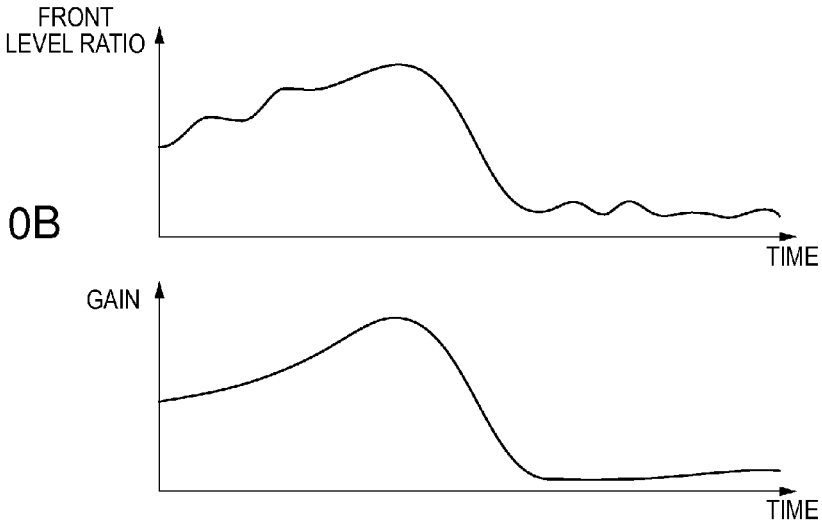
FIG. 10(B) is a diagram illustrating the relationships between time and a front level ratio and a gain.

For example, if a signal at a high level is input for merely a specific channel, it can be determined that the signal of this specific channel has a sound source, and hence the gain of the gain adjusting portion corresponding to this channel is set to be high for adding a distinctive localization feeling. Besides, the control portion 35 can calculate a level ratio (a front level ratio) between the front channels and the surround channels as illustrated in FIG. 10(B), so as to set the gains of the gain adjusting portions of the level adjusting portion 43 in accordance with the front level ratio. Specifically, if the level of the surround channels is relatively high, the control portion 35 sets the gains (of the gain adjusting portion 43SL and the gain adjusting portion 43SR) of the level adjusting portion 43 to be high, and if the level of the surround channels is relatively low, it sets the gains (of the gain adjusting portion 43SL and the gain adjusting portion 43SR) of the level adjusting portion 43 to be low. Accordingly, if the level of the surround channels is relatively high, the effect of the localization addition based on a virtual sound source is enhanced for enhancing the effect attained by the surround channels. On the other hand, if the level of the front channels is relatively high, the level attained by the sound beams is set to be high for enhancing the effect of the front channels obtained by using the sound beam, and thus, an auditory region where the localization feeling can be obtained can be made relatively large as compared with that attained by the localization based on a virtual sound source.

Incidentally, if the gains (of the gain adjusting portion 43SL and the gain adjusting portion 43SR) of the level adjusting portion 43 are set to be low when the level of the surround channels is relatively low, the surround channels using the sound beams may be more difficult to hear in some cases, and therefore, in one aspect, the gains (of the gain adjusting portion 43SL and the gain adjusting portion 43SR) of the level adjusting portion 43 may be set to be high when the level of the surround channels is relatively low and the gains (of the gain adjusting portion 43SL and the gain adjusting portion 43SR) of the level adjusting portion 43 may be set to be low when the level of the surround channels is relatively high.

Besides, the comparison in the level among the channels and the calculation of the level ratio between the front channels and the surround channels may be performed over the whole frequency band in one aspect, and the audio signals of the respective channels may be divided into prescribed bands for comparing the levels or calculating a level ratio between the front channels and the surround channels with respect to each of the divided bands in another aspect. For example, since the lower limit of the reproduction frequency of the speaker units 21A to 21P for outputting the sound beams is 200 Hz, the level ratio between the front channels and the surround channels is calculated in a band equal to or higher than 200 Hz.

Figure 11A:
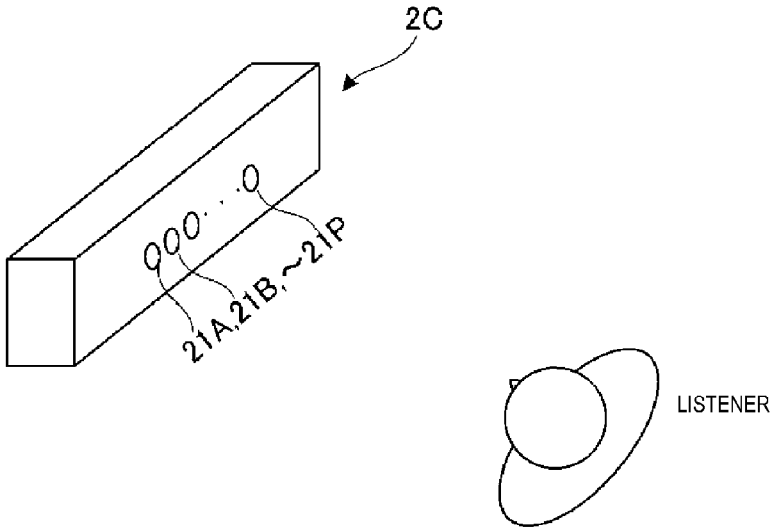
FIGS. 11(A) and 11(B) are diagrams of array speaker apparatuses according to Modification 3.

Next, FIG. 11(A) is a diagram illustrating an array speaker apparatus 2C according to Modification 3. The description of the constitution common to the array speaker apparatus 2 will be herein omitted.

The array speaker apparatus 2C is different from the array speaker apparatus 2 in that sounds output from the woofer 33L and the woofer 33R are respectively output from the speaker unit 21A and the speaker unit 21P.

The array speaker apparatus 2C outputs a sound for making a virtual sound source perceived from the speaker unit 21A and the speaker unit 21P, which are disposed at both ends of the speaker units 21A to 21P.

The speaker units 21A and the speaker unit 21P are speaker units disposed at the outermost ends of the array speaker, and are disposed in the leftmost position and the rightmost position when seen from a listener. Accordingly, the speaker unit 21A and the speaker unit 21P are suitable for respectively outputting the sounds of an L channel and an R channel, and are suitable as speaker units for outputting a sound for making a virtual sound source perceived.

Figure 11B:
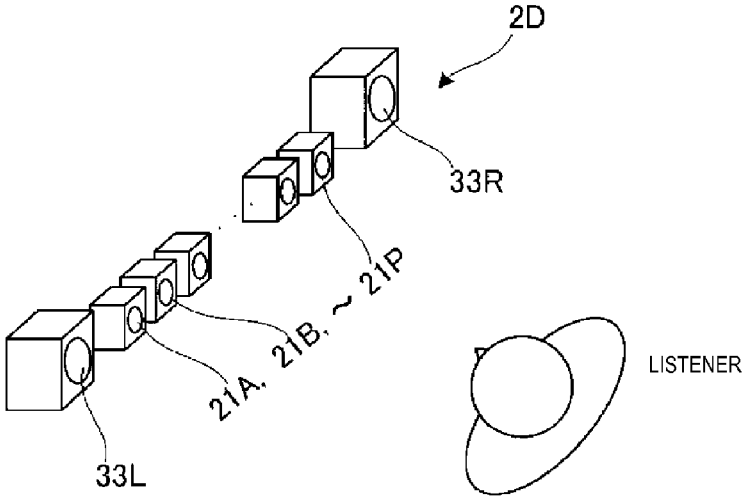

Besides, there is no need for the array speaker apparatus 2 to include all of the speaker units 21A to 21P, the woofer 33L and the woofer 33R in one housing. For example, in one aspect, respective speaker units may be provided with individual housings so as to arrange the housings as a speaker set 2D illustrated in FIG. 11(B).

No matter which of the aspects is employed, as long as input audio signals of a plurality of channels are delayed and distributed to a plurality of speakers and any of the input audio signals of the plurality of channels is subjected to the filtering processing based on a head-related transfer function before inputting it to the plurality of speakers, it is included in the technical scope of the present invention.

Second Embodiment

Figure 12:
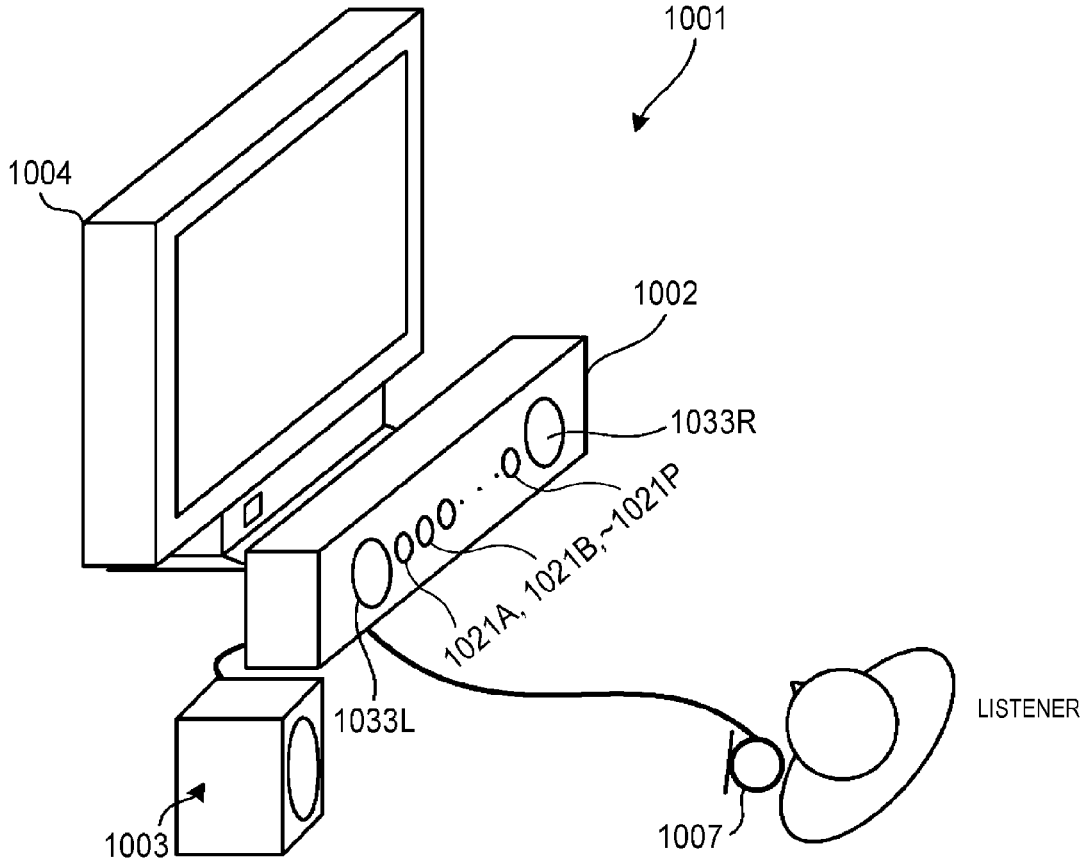
FIG. 12 is a schematic diagram illustrating the constitution of an AV system.

FIG. 12 is a schematic diagram of an AV system 1001 including an array speaker apparatus 1002 according to a second embodiment. The AV system 1001 includes the array speaker apparatus 1002, a subwoofer 1003, a television 1004 and a microphone 1007. The array speaker apparatus 1002 is connected to the subwoofer 1003 and the television 1004. To the array speaker apparatus 1002, audio signals in accordance with images reproduced by the television 1004 and audio signals from a content player not shown are input.

The array speaker apparatus 1002 has, as illustrated in FIG. 12, a rectangular parallelepiped housing, and is installed in the vicinity of the television 1004 (in a position below a display screen of the television 1004). The array speaker apparatus 1002 includes, on a front surface thereof (a surface opposing a listener), for example, sixteen speaker units 1021A to 1021P, a woofer 1033L and a woofer 1033R.

The speaker units 1021A to 1021P are linearly arranged along the lateral direction when seen from a listener. The speaker unit 1021A is disposed in the leftmost position when seen from the listener, and the speaker unit 1021P is disposed in the rightmost position when seen from the listener. The woofer 1033L is disposed on the further left side of the speaker unit 1021A. The woofer 1033R is disposed on the further right side of the speaker unit 1021P. In this example, the speaker units 1021A to 1021P, the woofer 1033L and the woofer 1033R correspond to "a plurality of speakers" of the present invention.

It is noted that the number of speaker units is not limited to sixteen but may be, for example, eight or the like. Besides, the arrangement is not limited to the linear lateral arrangement but may be, for example, lateral arrangement in three lines.

The subwoofer 1003 is disposed in the vicinity of the array speaker apparatus 1002. In the example illustrated in FIG. 12, it is disposed on the left side of the array speaker apparatus 1002, but the installation position is not limited to this exemplified position.

Besides, to the array speaker apparatus 1002, the microphone 1007 for measuring a listening environment is connected. The microphone 1007 is installed in a listening position. The microphone 1007 is used in measuring the listening environment, and need not be installed in actually viewing a content.

Figure 13:
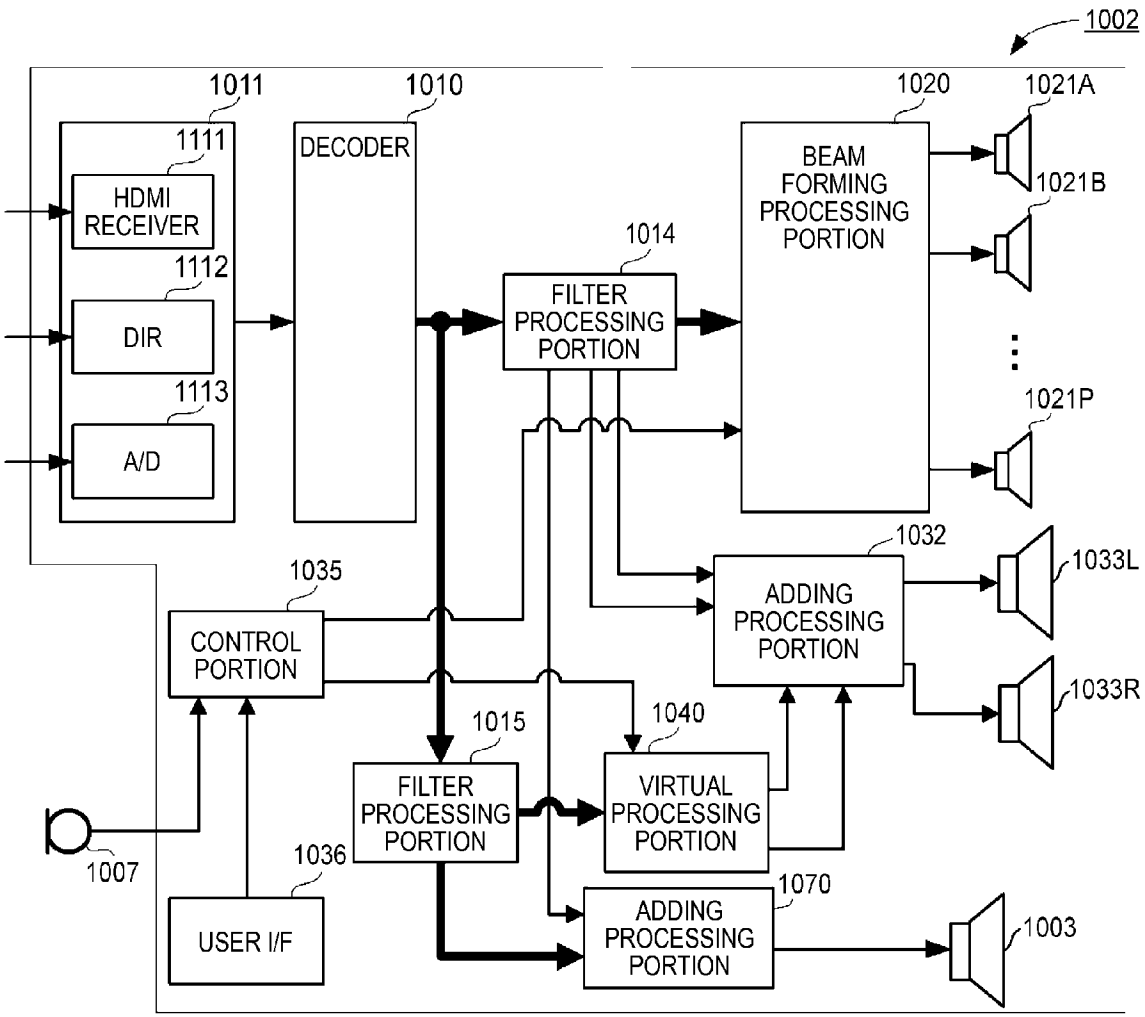
FIG. 13 is a block diagram illustrating the configuration of an array speaker apparatus.

FIG. 13 is a block diagram illustrating the configuration of the array speaker apparatus 1002. The array speaker apparatus 1002 includes an input portion 1011, a decoder 1010, a filtering processing portion 1014, a filtering processing portion 1015, a beam forming processing portion 1020, an adding processing portion 1032, an adding processing portion 1070, a virtual processing portion 1040, a control portion 1035, and a user I/F 1036.

The input portion 1011 includes an HDMI receiver 1111, a DIR 1112 and an A/D conversion portion 1113. The HDMI receiver 1111 receives, as an input, an HDMI signal according to the HDMI standard and outputs it to the decoder 1010. The DIR 1112 receives, as an input, a digital audio signal (SPDIF) and outputs it to the decoder 1010. The A/D conversion portion 1113 receives, as an input, an analog audio signal, converts it into a digital audio signal and outputs the converted signal to the decoder 1010.

The decoder 1010 includes a DSP and decodes a signal input thereto. The decoder 1010 receives, as an input, a signal of various formats such as AAC (registered trademark), Dolby Digital (registered trademark), DTS (registered trademark), MPEG-1/2, MPEG-2 multi-channel and MP3, converts the signal into a multi-channel audio signal (a digital audio signal of an FL channel, an FR channel, a C channel, an SL channel and an SR channel: it is noted that simple designation of an audio signal used hereinafter refers to a digital audio signal), and outputs the converted signal. A thick solid line of FIG. 13 indicates a multi-channel audio signal. It is noted that the decoder 1010 also has a function to expand, for example, a stereo-channel audio signal into a multi-channel audio signal.

The multi-channel audio signal output from the decoder 1010 is input to the filtering processing portion 1014 and the filtering processing portion 1015. The filtering processing portion 1014 extracts, from the multi-channel audio signal output from the decoder 1010, a band suitable to each of the speaker units, and outputs the resultant.

Figure 14A:
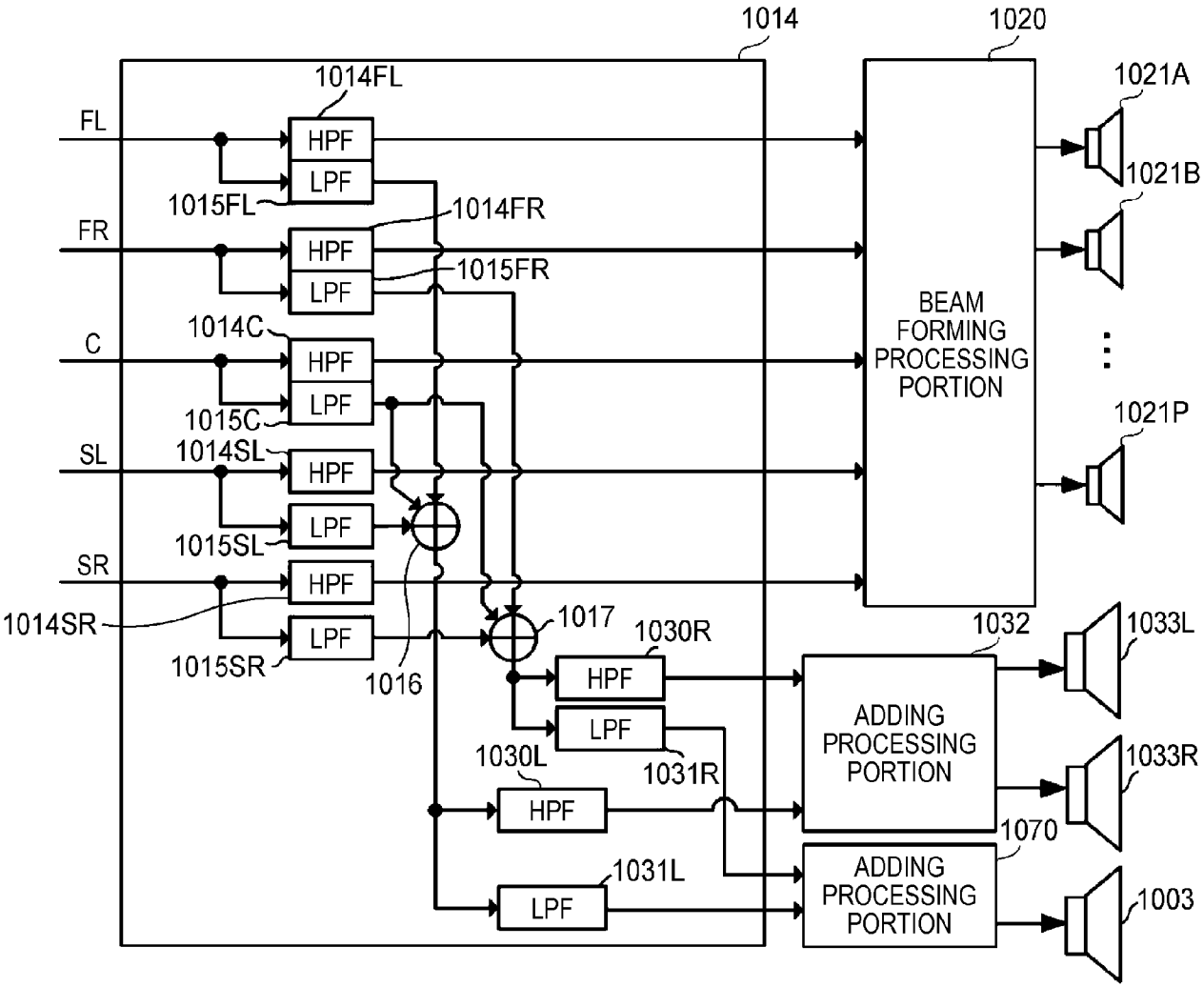
FIGS. 14(A) and 14(B) are block diagrams illustrating the configurations of filter processing portions.
Figure 14B:
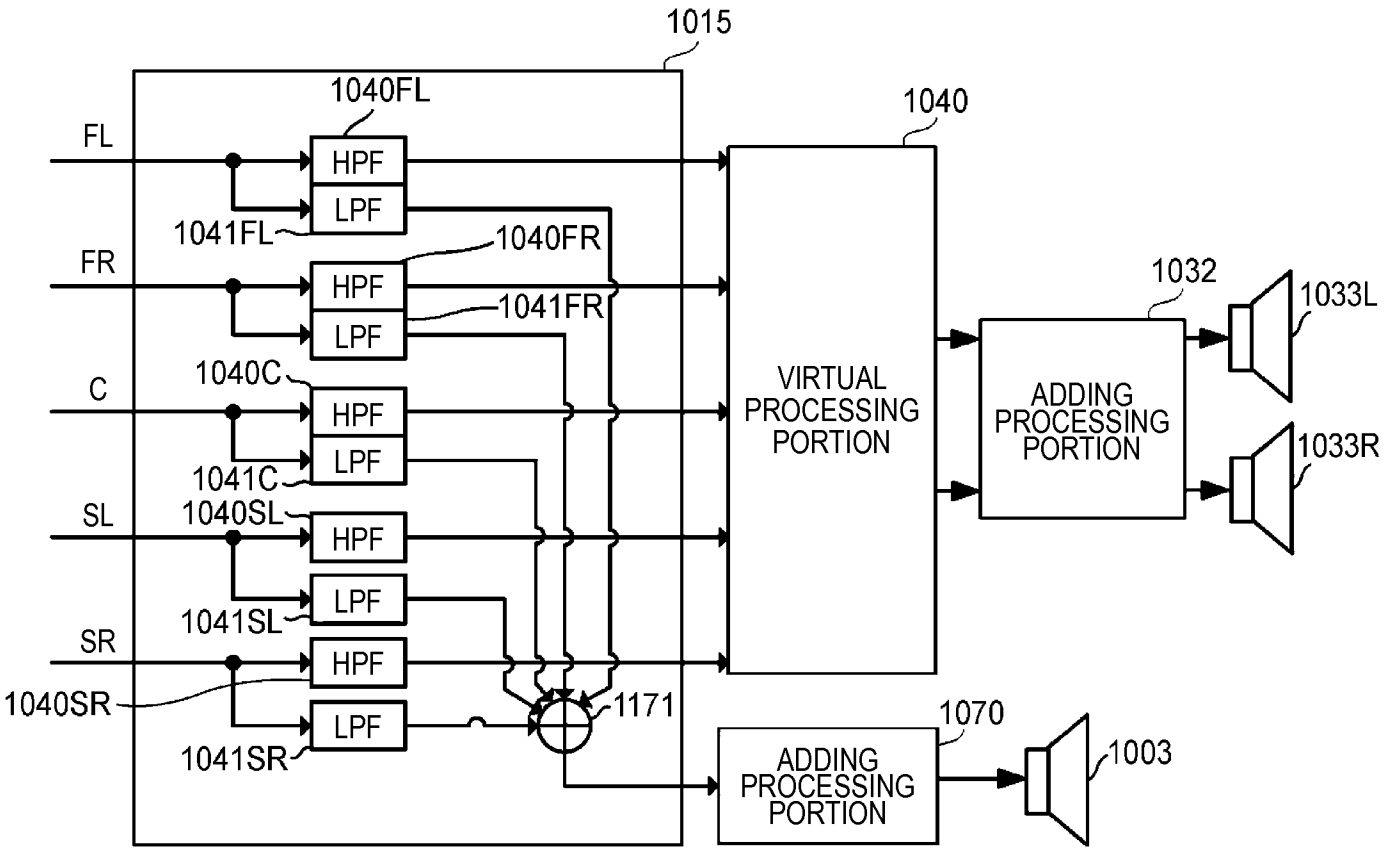

FIG. 14(A) is a block diagram illustrating the configuration of the filtering processing portion 1014, and FIG. 14(B) is a block diagram illustrating the configuration of the filtering processing portion 1015.

The filtering processing portion 1014 includes an HPF 1014FL, an HPF 1014FR, an HPF 1014C, an HPF 1014SL and an HPF 1014SR respectively receiving, as inputs, digital audio signals of the FL channel, the FR channel, the C channel, the SL channel and the SR channel. The filtering processing portion 1014 further includes an LPF 1015FL, an LPF 1015FR, an LPF 1015C, an LPF 1015SL and an LPF 1015SR respectively receiving, as inputs, the digital audio signals of the FL channel, the FR channel, the C channel, the SL channel and the SR channel.

Each of the HPF 1014FL, the HPF 1014FR, the HPF 1014C, the HPF 1014SL and the HPF 1014SR extracts a high frequency component of the audio signal of the corresponding channel input thereto, and outputs the resultant. The cut-off frequency of the HPF 1014FL, HPF 1014FR, the HPF 1014C, the HPF 1014SL and the HPF 1014SR is set in accordance with the lower limit (of, for example, 200 Hz) of the reproduction frequency of the speaker units 1021A to 1021P. The output signals from the HPF 1014FL, the HPF 1014FR, the HPF 1014C, the HPF 1014SL and the HPF 1014SR are output to the beam forming processing portion 1020.

Each of the LPF 1015FL, the LPF 1015FR, the LPF 1015C, the LPF 1015SL and the LPF 1015SR extracts a low frequency component (of, for example, lower than 200 Hz) of the audio signal of the corresponding channel input thereto, and outputs the resultant. The cut-off frequency of the LPF 1015FL, LPF 1015FR, the LPF 1015C, the LPF 1015SL and the LPF 1015SR corresponds to the cut-off frequency of the HPF 1014FL, the HPF 1014FR, the HPF 1014C, the HPF 1014SL and the HPF 1014SR (and is, for example, 200 Hz).

The output signals from the LPF 1015FL, the LPF 1015C and the LPF 1015SL are added up by an adding portion 1016 to generate an L channel audio signal. The L channel audio signal is further input to an HPF 1030L and an LPF 1031L.

The HPF 1030L extracts a high frequency component of the audio signal input thereto and outputs the resultant. The LPF 1031L extracts a low frequency component of the audio signal input thereto and outputs the resultant. The cut-off frequency of the HPF 1030L and the LPF 1031L corresponds to a cross-over frequency (of, for example, 100 Hz) between the woofer 1033L and the subwoofer 1003. It is noted that the cross-over frequency may be configured to be changeable by a listener with the user I/F 1036.

The output signals from the LPF 1015FR, the LPF 1015C and the LPF 1015SR are added up by an adding portion 1017 to generate an R channel audio signal. The R channel audio signal is further input to an HPF 1030R and an LPF 1031R.

The HPF 1030R extracts a high frequency component of the audio signal input thereto and outputs the resultant. The LPF 1031R extracts a low frequency component of the audio signal input thereto and outputs the resultant. The cut-off frequency of the HPF 1030R corresponds to a cross-over frequency (of, for example, 100 Hz) between the woofer 1033R and the subwoofer 1003. As described above, the cross-over frequency may be configured to be changeable by a listener with the user I/F 1036.

The audio signal output from the HPF 1030L is input to the woofer 1033L via an adding processing portion 1032. Similarly, the audio signal output from the HPF 1030R is input to the woofer 1033R via the adding processing portion 1032.

The audio signal output from the LPF 1031L and the audio signal output from the LPF 1031R are added up to be converted into a monaural signal by an adding processing portion 1070, and the resultant is input to the subwoofer 1003. Although not illustrated in the drawing, the adding processing portion 1070 also receives, as an input, an LFE channel signal to be added to the audio signal output from the LPF 1031L and the audio signal output from the LPF 1031R, and the resultant is output to the subwoofer 1003.

On the other hand, the filtering processing portion 1015 includes an HPF 1040FL, an HPF 1040FR, an HPF 1040C, an HPF 1040SL and an HPF 1040SR respectively receiving, as inputs, digital audio signals of the FL channel, the FR channel, the C channel, the SL channel and the SR channel. The filtering processing portion 1015 further includes an LPF 1041FL, an LPF 1041FR, an LPF 1041C, an LPF 1041SL and an LPF 1041SR respectively receiving, as inputs, the digital audio signals of the FL channel, the FR channel, the C channel, the SL channel and the SR channel.

Each of the HPF 1040FL, the HPF 1040FR, the HPF 1040C, the HPF 1040SL and the HPF 1040SR extracts a high frequency component of the audio signal of the corresponding channel input thereto, and outputs the resultant. The cut-off frequency of the HPF 1040FL, HPF 1040FR, the HPF 1040C, the HPF 1040SL and the HPF 1040SR corresponds to the cross-over frequency (of, for example, 100 Hz) between the woofers 1033R and 1033L and the subwoofer 1003. The cross-over frequency can be configured to be changeable by a listener with the user I/F 1036 as described above. The cut-off frequency of the HPF 1040FL, the HPF 1040FR, HPF 1040C, the HPF 1040SL and the HPF 1040SR may be the same as the cut-off frequency of the HPF 1014FL, the HPF 1014FR, the HPF 1014C, the HPF 1014SL and the HPF 1014SR. In an alternative aspect, the filtering processing portion 1015 may include merely the HPF 1040FL, the HPF 1040FR, the HPF 1040C, the HPF 1040SL and the HPF 1040SR so as not to output a low frequency component to the subwoofer 1003. The output signals from the HPF 1040FL, the HPF 1040FR, the HPF 1040C, the HPF 1040SL and the HPF 1040SR are output to the virtual processing portion 1040.

Each of the LPF 1041FL, the LPF 1041FR, the LPF 1041C, the LPF 1041SL and the LPF 1041SR extracts a low frequency component of the audio signal of the corresponding channel input thereto, and outputs the resultant. The cut-off frequency of the LPF 1041FL, LPF 1041FR, the LPF 1041C, the LPF 1041SL and the LPF 1041SR corresponds to the above-described cross-over frequency (and is, for example, 100 Hz). The audio signals output from the LPF 1041FL, the LPF 1041FR, the LPF 1041C, the LPF 1041SL and the LPF 1041SR are added up by an adding portion 1171 to be converted into a monaural signal, and the resultant is input to the subwoofer 1003 via the adding processing portion 1070. In the adding processing portion 1070, the audio signals output from the LPF 1041FL, the LPF 1041FR, the LPF 1041C, the LPF 1041SL and the LPF 1041SR are added to the audio signals output from the LPF 1031R and the LPF 1031L, and the above-described LFE channel audio signal. Incidentally, the adding processing portion 1070 may include a gain adjusting portion for changing an addition ratio among these signals.

Figure 15:
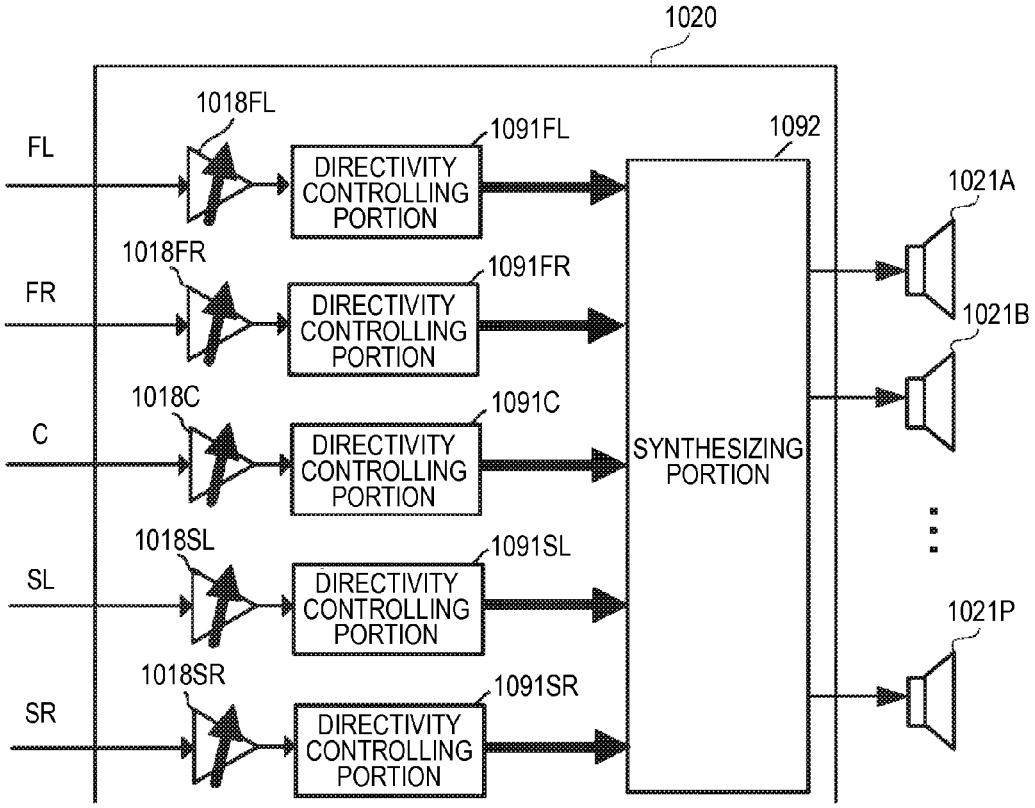
FIG. 15 is a block diagram illustrating the configuration of a beam forming processing portion.

Next, the beam forming processing portion 1020 will be described. FIG. 15 is a block diagram illustrating the configuration of the beam forming processing portion 1020. The beam forming processing portion 1020 includes a gain adjusting portion 1018FL, a gain adjusting portion 1018FR, a gain adjusting portion 1018C, a gain adjusting portion 1018SL and a gain adjusting portion 1018SR respectively receiving, as inputs, the digital audio signals of the FL channel, the FR channel, the C channel, the SL channel and the SR channel.

Each of the gain adjusting portion 1018FL, the gain adjusting portion 1018FR, the gain adjusting portion 1018C, the gain adjusting portion 1018SL and the gain adjusting portion 1018SR adjusts a gain of the audio signal of the corresponding channel. The audio signals of the respective channels having been adjusted in the gain are respectively input to a directivity controlling portion 1091FL, a directivity controlling portion 1091FR, a directivity controlling portion 1091C, a directivity controlling portion 1091SL and a directivity controlling portion 1091SR. Each of the directivity controlling portion 1091 FL, the directivity controlling portion 1091FR, the directivity controlling portion 1091C, the directivity controlling portion 1091SL and the directivity controlling portion 1091SR distributes the audio signal of the corresponding channel to the speaker units 1021A to 1021P. The distributed audio signals for the speaker units 1021A to 1021P are synthesized in a synthesizing portion 1092 to be supplied to the speaker units 1021A to 1021P. At this point, the directivity controlling portion 1091FL, the directivity controlling portion 1091FR, the directivity controlling portion 1091C, the directivity controlling portion 1091SL and the directivity controlling portion 1091SR adjust a delay amount of the audio signal to be supplied to each of the speaker units.

Sounds output from the speaker units 1021A to 1021P are mutually strengthened in a portion where they have the same phase, so as to be output as a sound beam having a directivity. For example, if sounds are output from all the speakers at the same timing, a sound beam having a directivity toward the front of the array speaker apparatus 1002 is output. The directivity controlling portion 1091FL, the directivity controlling portion 1091FR, the directivity controlling portion 1091C, the directivity controlling portion 1091SL and the directivity controlling portion 1091SR can change the outputting direction of a sound beam by changing the delay amounts to be given to the respective audio signals.

Besides, the directivity controlling portion 1091FL, the directivity controlling portion 1091FR, the directivity controlling portion 1091C, the directivity controlling portion 1091SL and the directivity controlling portion 1091SR can also form a sound beam focused on a prescribed position by giving delay amounts so that the sounds output respectively from the speaker units 1021A to 1021P may have the same phase in the prescribed position.

Figure 16A:
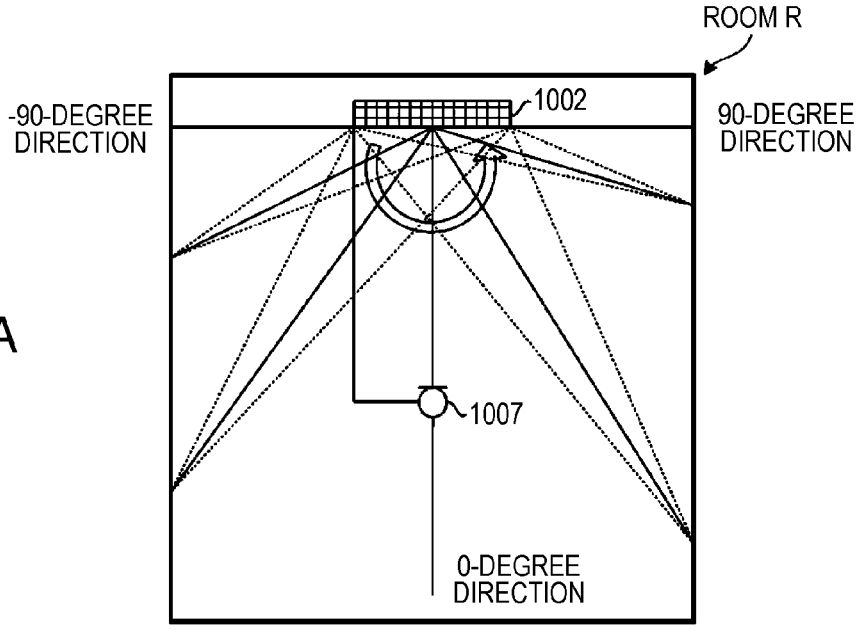
FIGS. 16(A), 16(B) and 16(C) are diagrams illustrating the relationship between a sound beam and channel setting.
Figure 16B:
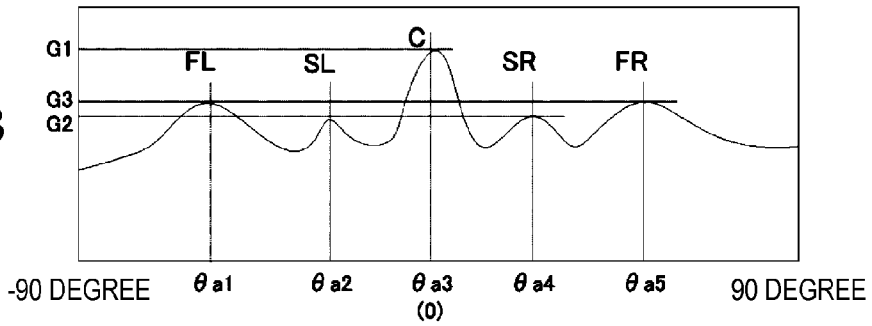
Figure 16C:
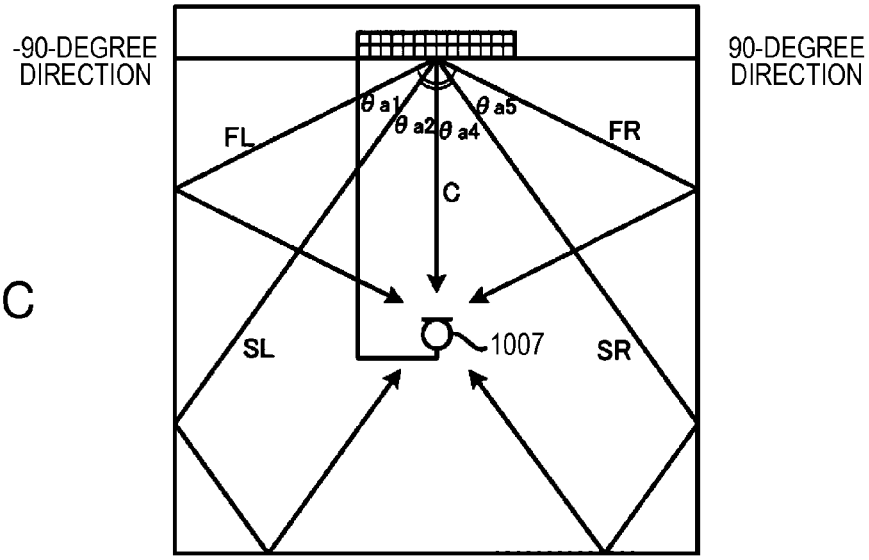

A sound beam can be caused to reach the listening position directly from the array speaker apparatus 1002 or after being reflected on a wall or the like of the room. For example, as illustrated in FIG. 16(C), a sound beam of a C channel audio signal can be output in a front direction so that the sound beam of the C channel can reach the listening position from the front. Besides, sound beams of an FL channel audio signal and an FR channel audio signal can be output in leftward and rightward directions of the array speaker apparatus 1002 so that these sound beams can be reflected on walls disposed on the left and right sides of the listening position to reach the listening position respectively from a left direction and a right direction. Furthermore, sound beams of an SL channel audio signal and an SR channel audio signal can be output in leftward and rightward directions so that these sound beams can be reflected twice on walls disposed on the right and left sides of and a wall behind the listening position to reach the listening position respectively from a left backward direction and a right backward direction.

These outputting directions of the sound beams can be automatically set by measuring the listening environment by using the microphone 1007. As illustrated in FIG. 16(A), when a listener installs the microphone 1007 in the listening position and operates the user I/F 1036 (or a remote controller not shown) for instructing the setting of a sound beam, the control portion 1035 causes the beam forming processing portion 1020 to output a sound beam of a test signal (of, for example, white noise).

The control portion 1035 turns the sound beam from a left direction parallel to the front surface of the array speaker apparatus 1002 (designated as the −90-degree direction) to a right direction parallel to the front surface of the array speaker apparatus 1002 (designated as the 0-degree direction). When the sound beam is turned in front of the array speaker apparatus 1002, the sound beam is reflected on a wall of the room R in accordance with a turning angle θ of the sound beam and picked up by the microphone 1007 at a prescribed angle.

The control portion 1035 stores the level of an audio signal input from the microphone 1007 in a memory (not shown) in correspondence with an output angle of the sound beam. Then, the control portion 1035 assigns, on the basis of a peak component of the audio signal level, each channel of the multi-channel audio signal to the output angle of the sound beam. For example, the control portion 1035 detects peaks beyond a prescribed threshold value in data of the sound picked up. The control portion 1035 assigns an output angle of the sound beam corresponding to the highest level among these peaks as the output angle of the sound beam of the C channel. For example, in FIG. 16(B), an angle θ3*a* corresponding to the highest level is assigned as the output angle of the sound beam of the C channel. Besides, the control portion 1035 assigns peaks, adjacent on both sides of the peak having been set for the C channel, as the output angles of the sound beams of the SL channel and the SR channel. For example, in FIG. 16(B), an angle θ2*a* close to the C channel on a side closer to the −90-degree direction is assigned as the output angle of the sound beam of the SL channel, and an angle θ4*a* close to the C channel on a side closer to the 90-degree direction is assigned as the output angle of the sound beam of the SR channel. Furthermore, the control portion 1035 assigns the outermost peaks as the output angles of the sound beams of the FL channel and the FR channel. For example, in the example of FIG. 16(B), an angle θ1*a* closest to the −90-degree direction is assigned as the sound beam of the FL channel, and an angle θ5*a* closest to the 90-degree direction is assigned as the output angle of the sound beam of the FR channel. In this manner, the control portion 1035 realizes a detection portion for detecting a level of the sound beam of each channel reaching the listening position and beam angle setting portion for setting output angles of the sound beam on the basis of the peak of the level measured by the detection portion.

In this manner, the setting for causing the sound beams to reach the position of a listener (the microphone 1007) from around as illustrated in FIG. 16(C) is performed.

Figure 17:
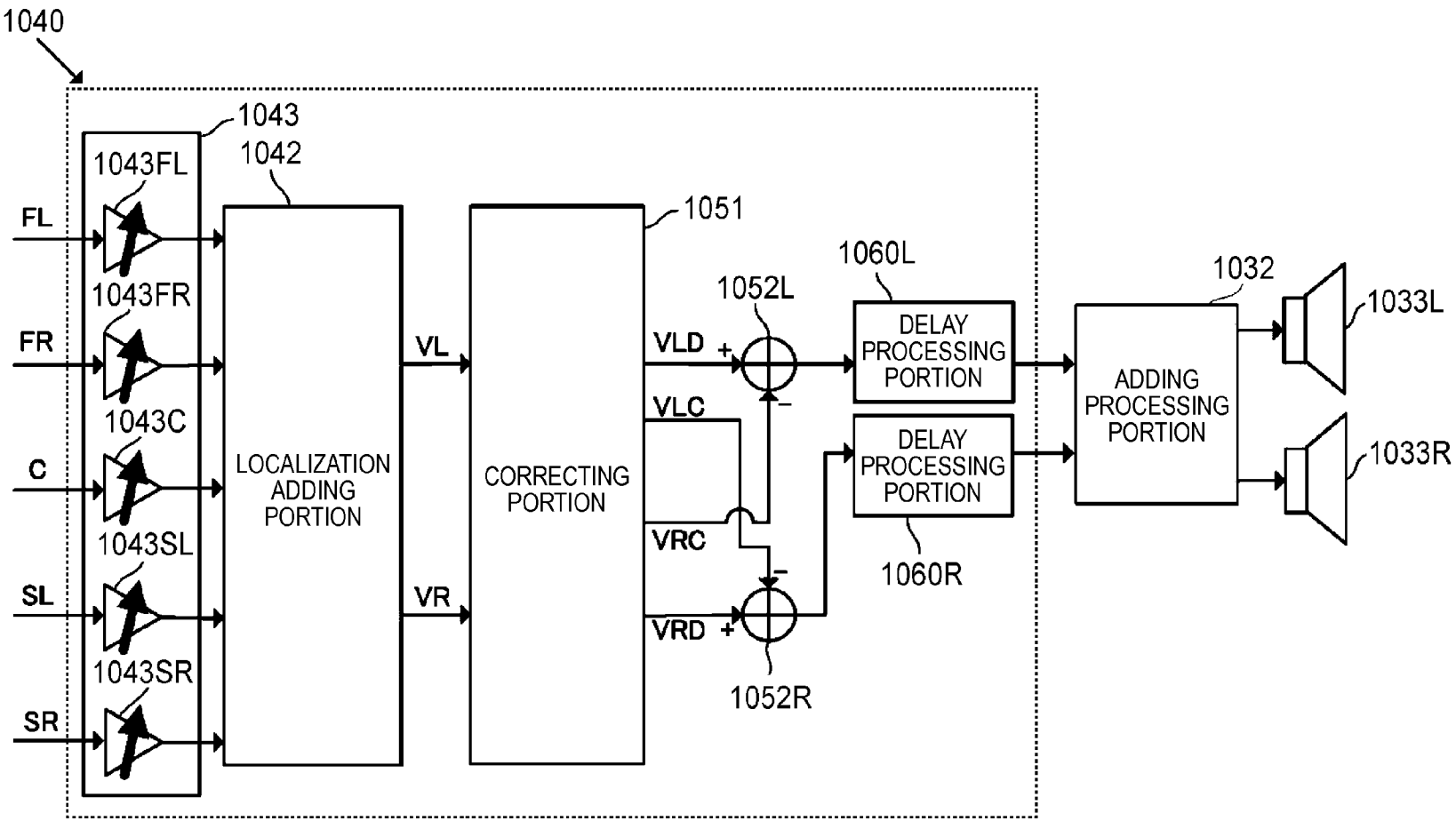
FIG. 17 is a block diagram illustrating the configuration of a virtual processing portion.

Next, the virtual processing portion 1040 will be described. FIG. 17 is a block diagram illustrating the configuration of the virtual processing portion 1040. The virtual processing portion 1040 includes a level adjusting portion 1043, a localization adding portion 1042, a correcting portion 1051, a delay processing portion 1060L and a delay processing portion 1060R.

The level adjusting portion 1043 includes a gain adjusting portion 1043FL, a gain adjusting portion 1043FR, a gain adjusting portion 1043C, a gain adjusting portion 1043SL and a gain adjusting portion 1043SR respectively receiving, as inputs, digital audio signals of the FL channel, the FR channel, the C channel, the SL channel and the SR channel.

Each of the gain adjusting portion 1043FL, the gain adjusting portion 1043FR, the gain adjusting portion 1043C, the gain adjusting portion 1043SL and the gain adjusting portion 1043SR adjusts the gain of the audio signal of the corresponding channel. The gain of each gain adjusting portion is set by, for example, the control portion 1035 on the basis of a detection result of a test sound beam. For example, the sound beam of the C channel is a direct sound as illustrated in FIG. 16(B), and hence is at the highest level. Accordingly, the gain of the gain adjusting portion 1043C is set to be the lowest. Besides, since the sound beam of the C channel is a direct sound and hence there is a low possibility that it is varied depending upon the environment of the room, it may be set to, for example, a fixed value. With respect to the other gain adjusting portions, gains are set in accordance with level differences from the C channel. For example, assuming that a detection level G1 of the C channel is 1.0 and the gain of the gain adjusting portion 1043C is set to 0.1, if a detection level G3 of the FR channel is 0.6, the gain of the gain adjusting portion 1043FR is set to 0.4, and if a detection level G2 of the SR channel is 0.4, the gain of the gain adjusting portion 1043SR is set to 0.6. In this manner, the gains for the respective channels are adjusted. Incidentally, although the sound beam of the test signal is turned by the control portion 1035 for detecting the levels of the sound beams of the respective channels reaching the listening position in the example illustrated in FIGS. 16(A), 16(B) and 16(C), a listener may instruct, manually by using the user I/F 1036, the control portion 1035 to output a sound beam so as to manually set the levels of the gain adjusting portion 1043FL, the gain adjusting portion 1043FR, the gain adjusting portion 1043C, the gain adjusting portion 1043SL and the gain adjusting portion 1043SR. Besides, for the setting of the gain adjusting portion 1043FL, the gain adjusting portion 1043FR, the gain adjusting portion 1043C, the gain adjusting portion 1043SL and the gain adjusting portion 1043SR, the level of each channel may be measured separately from the levels detected with the test sound beam swept. Specifically, this method can be performed by outputting a test sound beam in a direction determined, for each channel, by the test sound beam swept, and analyzing a sound picked up in the listening position by the microphone 1007.

The audio signal of each channel having been adjusted in the gain is input to the localization adding portion 1042. The localization adding portion 1042 performs processing for localizing the audio signal of each channel input thereto in a prescribed position as a virtual sound source. In order to localize the audio signal as a virtual sound source, a head-related transfer function (hereinafter referred to as the HRTF) corresponding to a transfer function between a prescribed position and an ear of a listener is employed.

The HRTF corresponds to an impulse response expressing the loudness, the reaching time, the frequency characteristic and the like of a sound emitted from a virtual speaker placed in a given position to right and left ears. The localization adding portion 1042 can allow a listener to localize a virtual sound source by applying the HRTF to the audio signal of each channel input thereto and emitting the resultant from the woofer 1033L or the woofer 1033R.

Figure 18A:
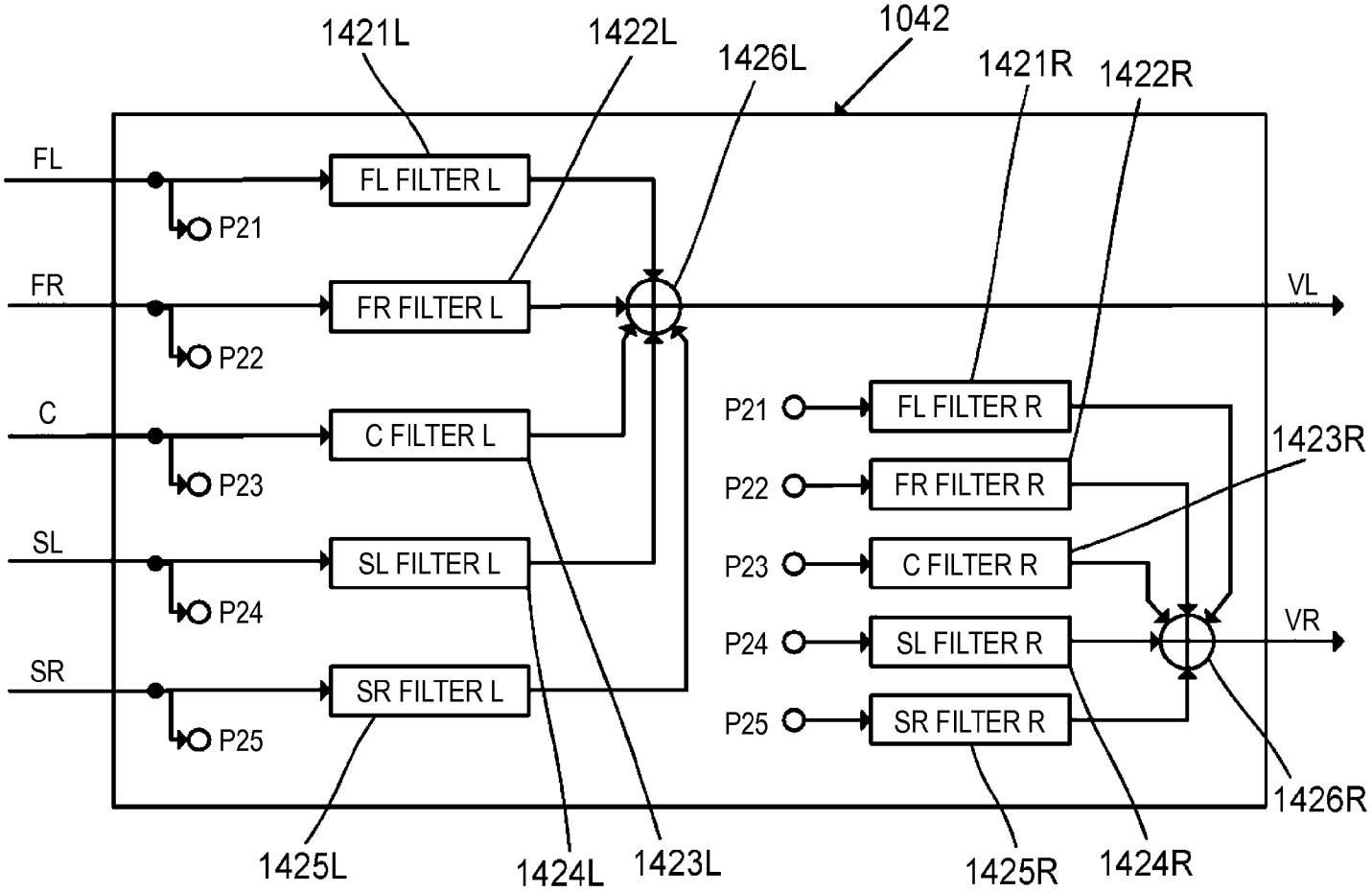
FIGS. 18(A) and 18(B) are block diagrams illustrating the configurations of a localization adding portion and a correcting portion.

FIG. 18(A) is a block diagram illustrating the configuration of the localization adding portion 1042. The localization adding portion 1042 includes an FL filter 1421L, an FR filter 1422L, a C filter 1423L, an SL filter 1424L and an SR filter 1425L, and an FL filter 1421R, an FR filter 1422R, a C filter 1423R, an SL filter 1424R and an SR filter 1425R for convolving the impulse response of the HRTF to the audio signals of the respective channels.

For example, an audio signal of the FL channel is input to the FL filter 1421L and the FL filter 1421R. The FL filter 1421L applies, to the audio signal of the FL channel, an HRTF corresponding to a path from the position of a virtual sound source VSFL (see FIG. 19(A)) disposed on a left forward side of a listener to his/her left ear. The FL filter 1421R applies, to the audio signal of the FL channel, an HRTF corresponding to a path from the position of the virtual sound source VSFL to the listener's right ear. With respect to each of the other channels, an HRTF corresponding to a path from the position of a virtual sound source disposed around the listener to his/her right or left ear is similarly applied.

An adding portion 1426L synthesizes the audio signals to which the HRTFs have been applied by the FL filter 1421L, the FR filter 1422L, the C filter 1423L, the SL filter 1424L and the SR filter 1425L, and outputs the resultant as an audio signal VL to the correcting portion 1051. An adding portion 1426R synthesizes the audio signals to which the HRTFs have been applied by the FL filter 1421R, the FR filter 1422R, the C filter 1423R, the SL filter 1424R and the SR filter 1425R, and outputs the resultant as an audio signal VR to the correcting portion 1051.

Figure 18B:
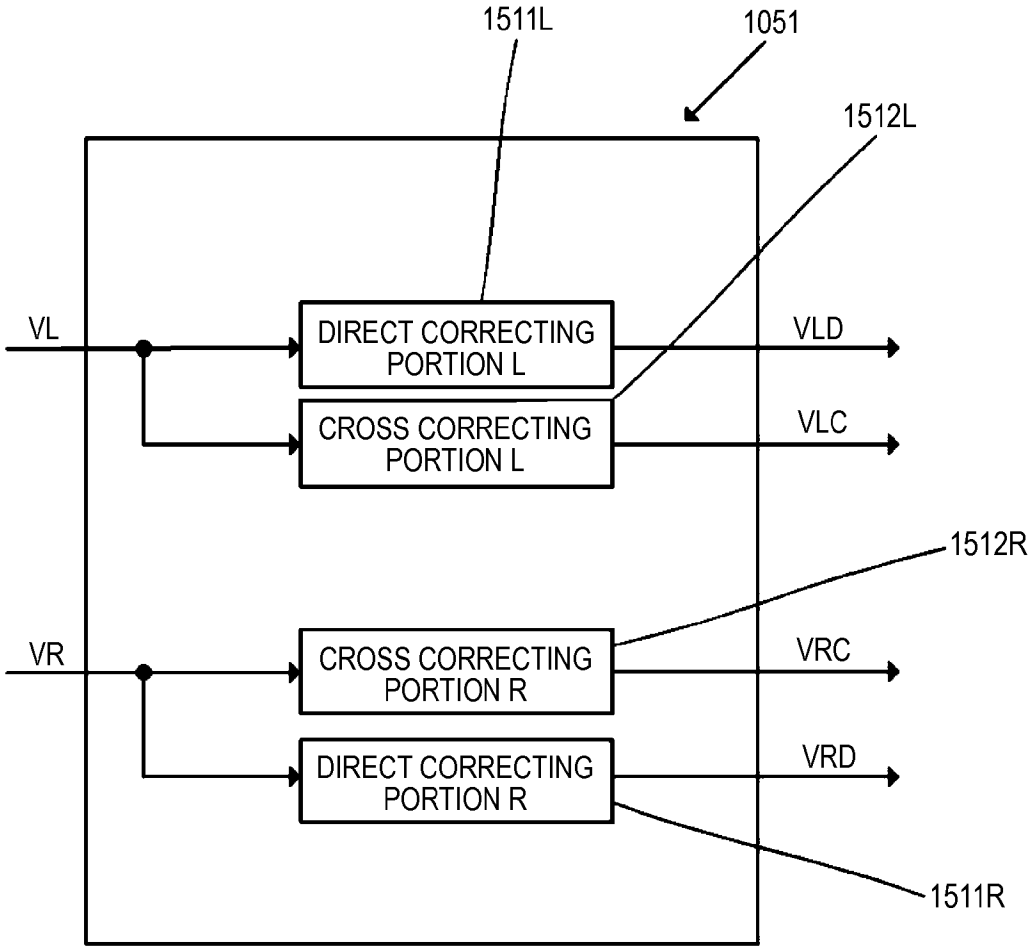

The correcting portion 1051 performs the crosstalk cancellation processing. FIG. 18(B) is a block diagram illustrating the configuration of the correcting portion 1051. The correcting portion 1051 includes a direct correcting portion 1511L, a direct correcting portion 1511R, a cross correcting portion 1512L and a cross correcting portion 1512R.

The audio signal VL is input to the direct correcting portion 1511L and the cross correcting portion 1512L. The audio signal VR is input to the direct correcting portion 1511R and the cross correcting portion 1512R.

The direct correcting portion 1511L performs processing for causing a listener to perceive as if a sound output from the woofer 1033L was emitted in the vicinity of his/her left ear. The direct correcting portion 1511L had a filter coefficient set for making the frequency characteristic of the sound output from the woofer 1033L flat in the position of the left ear. The direct correcting portion 1511L processes the audio signal VL input thereto with this filter, so as to output an audio signal VLD. The direct correcting portion 1511R has a filter coefficient set for making the frequency characteristic of a sound output from the woofer 1033R flat in the position of the listener's right ear. The direct correcting portion 1511R processes the audio signal VL input thereto with this filter, so as to output an audio signal VRD.

The cross correcting portion 1512L has a filter coefficient set for adding a frequency characteristic of a sound routing around from the woofer 1033L to the right ear. The sound (VLC) routing around from the woofer 1033L to the right ear is reversed in phase by a synthesizing portion 1052R to emit the resultant from the woofer 1033R, and thus, the sound from the woofer 1033L can be inhibited from being heard by the right ear. In this manner, the listener is made to perceive as if the sound emitted from the woofer 1033R was emitted in the vicinity of his/her right ear.

The cross correcting portion 1512R has a filter coefficient set for adding a frequency characteristic of a sound routing around from the woofer 1033R to the left ear. The sound (VRC) routing around from the woofer 1033R to the left ear is reversed in phase by a synthesizing portion 1052L to emit the resultant from the woofer 1033L, and thus, the sound from the woofer 1033R can be inhibited from being heard by the left ear. In this manner, the listener is made to perceive as if the sound emitted from the woofer 1033L was emitted in the vicinity of his/her left ear.

The audio signal output from the synthesizing portion 1052L is input to the delay processing portion 1060L. The audio signal having been delayed by a prescribed time by the delay processing portion 1060L is input to the adding processing portion 1032. Besides, the audio signal output from the synthesizing portion 1052R is input to the delay processing portion 1060R. The audio signal having been delayed by a prescribed time by the delay processing portion 1060R is input to the adding processing portion 1032.

The delay time caused by each of the delay processing portion 1060L and the delay processing portion 1060R is set to be, for example, longer than the longest delay time given by the directivity controlling portions of the beam forming processing portion 1020. Thus, a sound for making a virtual sound source perceived does not impede the formation of a sound beam. Incidentally, in one aspect, a delay processing portion may be provided in a stage following the beam forming processing portion 1020 for adding a delay to a sound beam so that the sound beam may not impede a sound for localizing a virtual sound source.

The audio signal output from the delay processing portion 1060L is input to the woofer 1033L via the adding processing portion 1032. In the adding processing portion 1032, the audio signal output from the delay processing portion 1060L and the audio signal output from the HPF 1030L are added up. Incidentally, the adding processing portion 1032 may include a constitution of a gain adjusting portion for changing an addition ratio between these audio signals. Similarly, the audio signal output from the delay processing portion 1060R is input to the woofer 1033R via the adding processing portion 1032. In the adding processing portion 1032, the audio signal output from the delay processing portion 1060R and the audio signal output from the HPF 1030R are added up. The adding processing portion 1032 may include a constitution of a gain adjusting portion for changing an addition ratio between these audio signals.

Figure 19A:
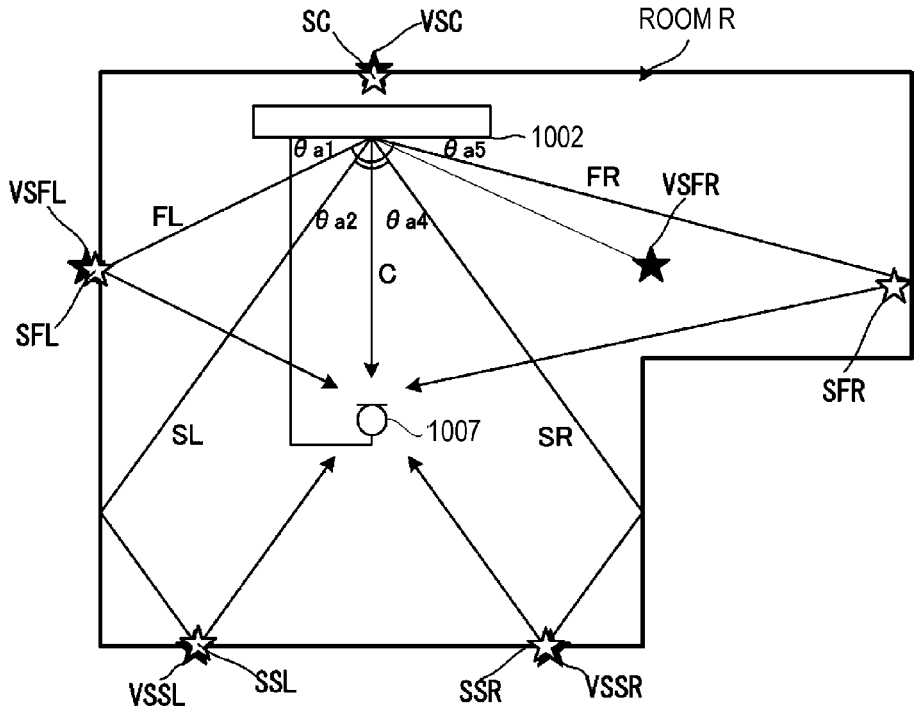
FIGS. 19(A) and 19(B) are diagrams for explaining a sound field generated by the array speaker apparatus.

Next, a sound field generated by the array speaker apparatus 1002 will be described with reference to FIG. 19(A). In FIG. 19(A), a solid arrow indicates the path of a sound beam output from the array speaker apparatus 1002. In FIG. 19(A), a white star indicates the position of a sound source generated by a sound beam, and a black star indicates the position of a virtual sound source.

In the example illustrated in FIG. 19(A), the array speaker apparatus 1002 outputs five sound beams. For an audio signal of the C channel, a sound beam focused on a position behind the array speaker apparatus 1002 is set. Thus, a listener perceives that a sound source SC is disposed in front of him/her.

Similarly, for an audio signal of the FL channel, a sound beam focused on a position on a wall of the room R on the left forward side is set, and the listener perceives that a sound source SFL is disposed on the wall on the left forward side of the listener. For an audio signal of the FR channel, a sound beam focused on a position on a wall of the room R on the right forward side is set, and the listener perceives that a sound source SFR is disposed on the wall on the right forward side of the listener. For an audio signal of the SL channel, a sound beam focused on a position on a wall of the room R on the left backward side is set, and the listener perceives that a sound source SSL is disposed on the wall on the left backward side of the listener. For an audio signal of the SR channel, a sound beam focused on a position on a wall on the right backward side is set, and the listener perceives that a sound source SSR is disposed on the wall on the right backward side of the listener.

In the example illustrated in FIG. 19(A), however, a distance between the wall on the right forward side and the listening position is larger than a distance between the wall on the left forward side and the listening position. Accordingly, the sound source SFR is perceived in a position rather backward than the sound source SFL. Therefore, the localization adding portion 1042 sets it in the middle between the sound beam of the C channel and the sound beam of the FR channel. In this example, the localization adding portion 1042 sets the direction of a virtual sound source VSFR to a direction bilaterally symmetrical to the reaching direction of the sound beam of the FL channel (bilaterally symmetrical with respect to a center axis corresponding to the listening position). This setting may be carried out by the listener manually with the user I/F 1036 or can be automatically carried out as follows.

Figure 19B:
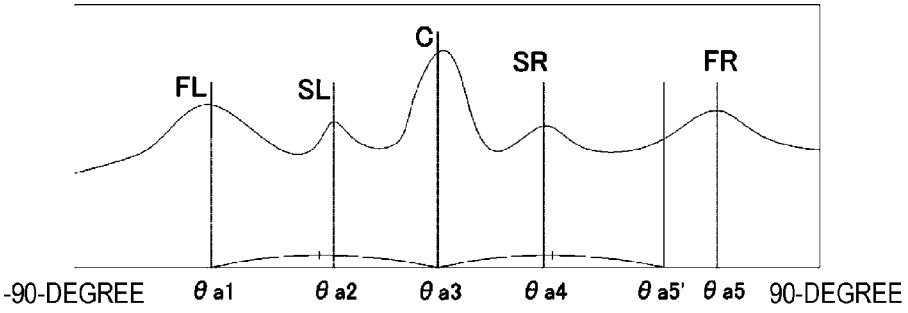

The control portion 1035 makes a discrimination about the symmetry of peaks present in regions disposed on both sides of an angle θa3 corresponding to a peak set for the C channel as illustrated in FIG. 19(B).

Assuming that an allowable error is, for example, ±10 degrees, the control portion 1035 discriminates that the reaching directions of the sound beams of the SL channel and the SR channel are bilaterally symmetrical if $-10$ degrees $\leq \theta a2+\theta a4 \leq 10$ degrees. Similarly, the control portion 1035 discriminates that the reaching directions of the sound beams of the FL channel and the FR channel are bilaterally symmetrical if $-10$ degrees $\leq \theta a1+\theta a5 \leq 10$ degrees.

FIG. 19(B) illustrates an example where the value of θa1+θa5 exceeds the allowable error. Accordingly, the control portion 1035 instructs the localization adding portion 1042 to set the direction of the virtual sound source in the middle between the reaching directions of the two sound beams (the sound beam of the C channel and the sound beam of the FR channel). The direction of a virtual sound source is preferably set to be symmetrical to a sound beam closer to an ideal reaching direction (for example, approximately 30 degrees to the right or to the left when seen from the listening position).

In the example illustrated in FIG. 19(B), the direction of the virtual sound source VSFR is set to an angle θa5' symmetrical to an angle θa1 with respect to the center axis (corresponding to an angle θa3=0 degree). Virtual sound sources of the other channels are set in positions substantially the same as the positions of the sound sources SFL, SC, SSL and SSR described above. Accordingly, the listener perceives the virtual sound sources VSC, VSFL, VSSL and VSSR in substantially the same positions as the sound sources SC, SFL, SSL and SSR, respectively.

In this manner, in the array speaker apparatus 1002, a sound source can be distinctively localized in an intended direction by using a virtual sound source based on a head-related transfer function not depending on the listening environment such as an acoustic reflectivity of a wall while employing the localization feeling based on a sound beam. Besides, in the example illustrated in FIGS. 19(A) and 19(B), the sound sources are localized in bilaterally symmetrical positions when seen from the listening position, a more ideal listening aspect can be attained.

Figure 20A:
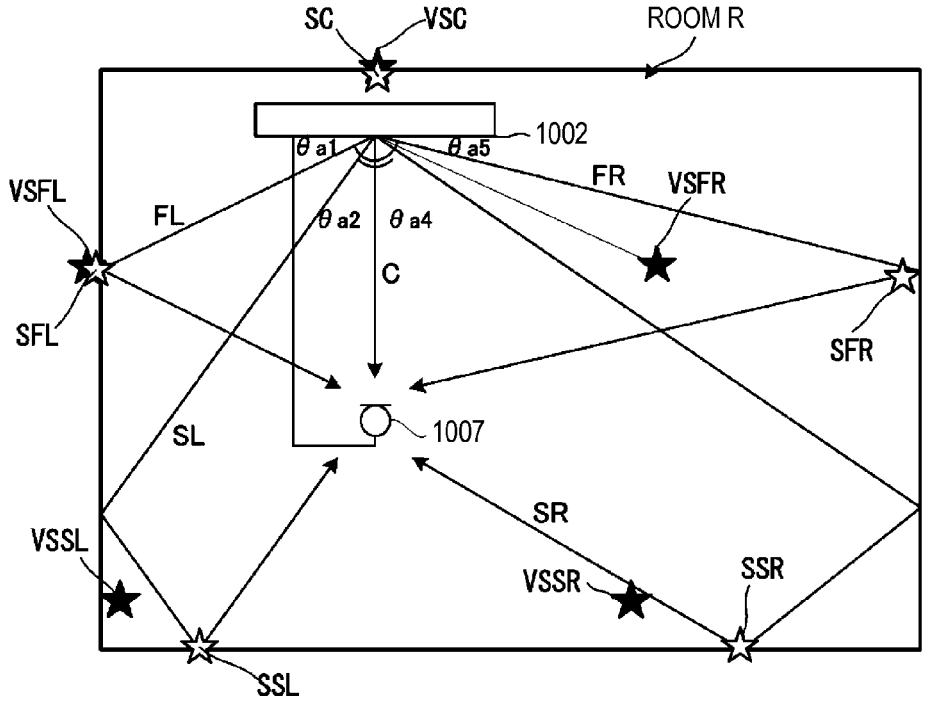
FIGS. 20(A) and 20(B) are diagrams for explaining a sound field generated by an array speaker apparatus 1002.
Figure 20B:
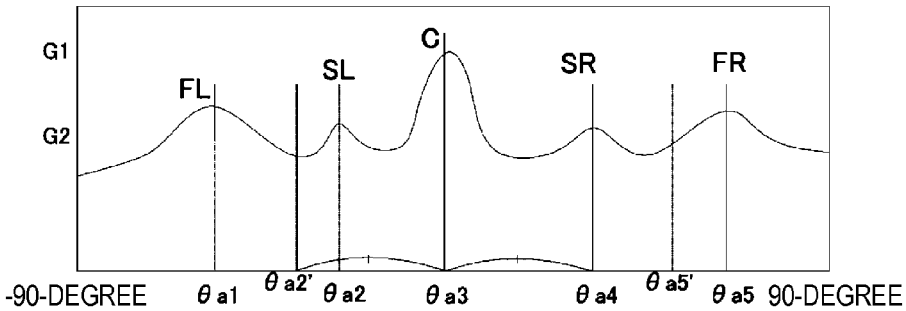

Next, FIG. 20(A) is a diagram illustrating a case where the SR channel reaches a position rather forward than the SL channel. In this case, a distance between the right wall and the listening position is larger than a distance between the left wall and the listening position. Since a surround channel is reflected twice, if the right wall is farther, the sound source SSR is perceived in a position rather forward than the sound source SSL. In the same manner as described above, assuming that an allowable error is, for example, ±10 degrees, the control portion 1035 discriminates whether or not −10 degrees ≤θa2+θa4≤10 degrees. FIG. 20(B) illustrates an example where the value of θa2+θa4 exceeds the allowable error. Accordingly, the control portion 1035 instructs the localization adding portion 1042 to set the direction of the virtual sound source in the middle between the reaching directions of the two sound beams.

Also in this case, the direction of a virtual sound source is preferably set to be symmetrical to a sound beam closer to an ideal reaching direction (for example, approximately 110 degrees to the right or to the left when seen from the listening position). Since the ideal reaching direction of a surround channel is present rather forward and rightward or leftward than that of a front channel, the direction of the virtual sound source is set on the side of a peak having a larger angle difference from the center axis (corresponding to a sound beam reaching in a position rather rightward or leftward). In the example illustrated in FIG. 20(B), the direction of the virtual sound source VSSL is set to an angle θa2' symmetrical to an angle θa4 with respect to the center axis (corresponding to the angle θa3). Virtual sound sources of the other channels are set in positions substantially the same as the positions of the sound sources SFL, SFR, SC and SSR described above. Accordingly, the listener perceives the virtual sound sources VSC, VSFR, VSSL and VSSR in substantially the same positions as the sound sources SC, SFR, SSL and SSR, respectively.

In this manner, also with respect to the surround channels, the sound sources are localized bilaterally symmetrical when seen from the listening position, and hence, a more ideal listening aspect can be attained.

In particular, since each of the sound sources SSL and SSR is generated by the sound beam reflected twice on the walls, a distinctive localization feeling may not be obtained as compared with a front-side channel in some cases. The array speaker apparatus 1002 can, however, compensate the localization feeling with the virtual sound source VSSL and the virtual sound source VSSR generated by the woofer 1033L and the woofer 1033R by using the sound directly reaching the ears of the listener, and hence, the sound sources can be more distinctively localized in more ideal directions.

Figure 21:
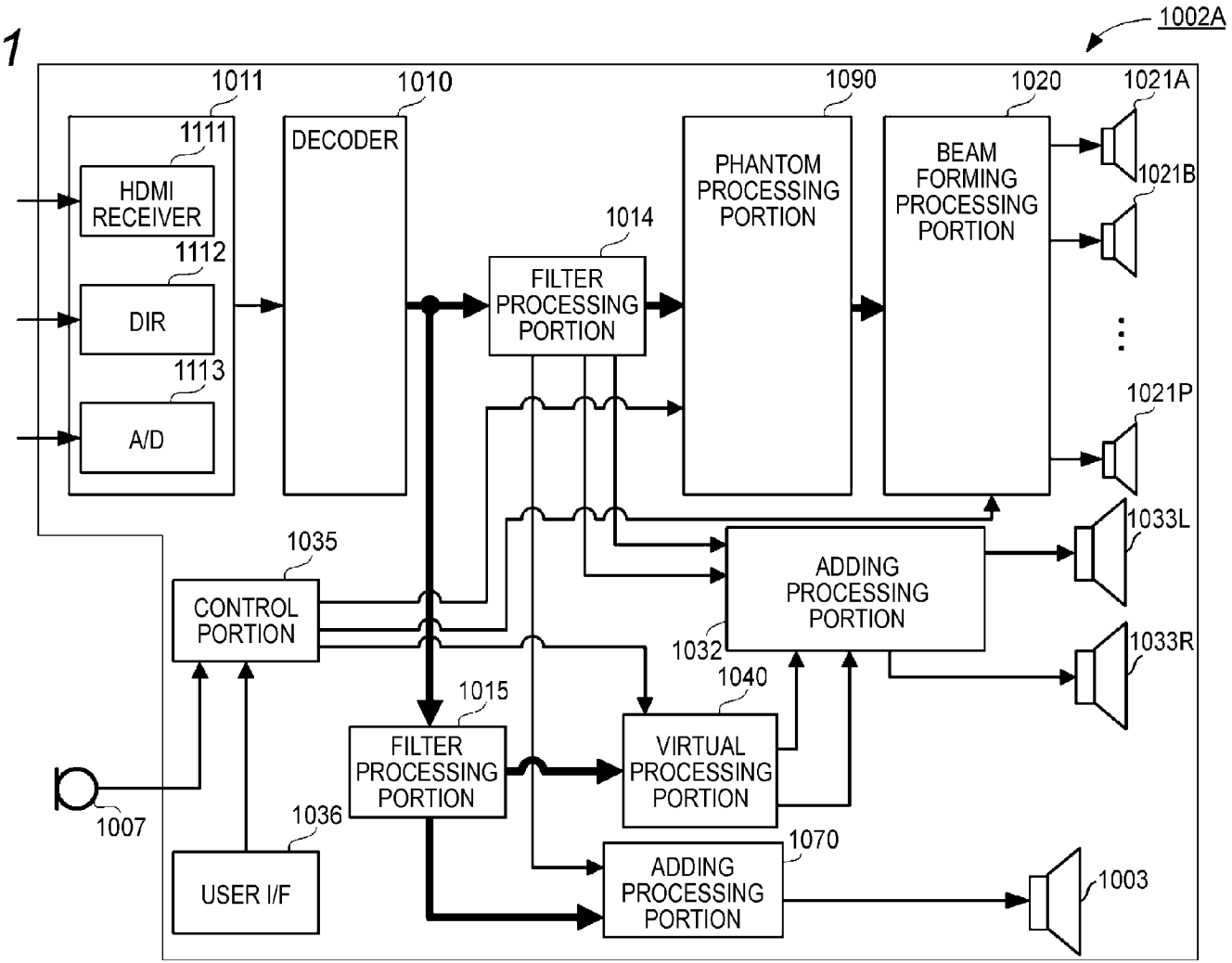
FIG. 21 is a block diagram illustrating the configuration of an array speaker apparatus employed when a phantom sound source is also used.

Next, FIG. 21 is a block diagram illustrating the configuration of an array speaker apparatus 1002A employed when a phantom sound source is also used. Like reference numerals are used to refer to the constitution common to the array speaker apparatus 1002 of FIG. 13 so as to herein omit the description.

The array speaker apparatus 1002A is different from the array speaker apparatus 1002 in that it includes a phantom processing portion 1090. The phantom processing portion 1090 localizes a specific channel as a phantom (generates a phantom sound source) by distributing an audio signal of each channel, among from audio signals input from the filter processing portion 1014, to the channel itself and the other channels.

Figures 22A, 22B, 22C:
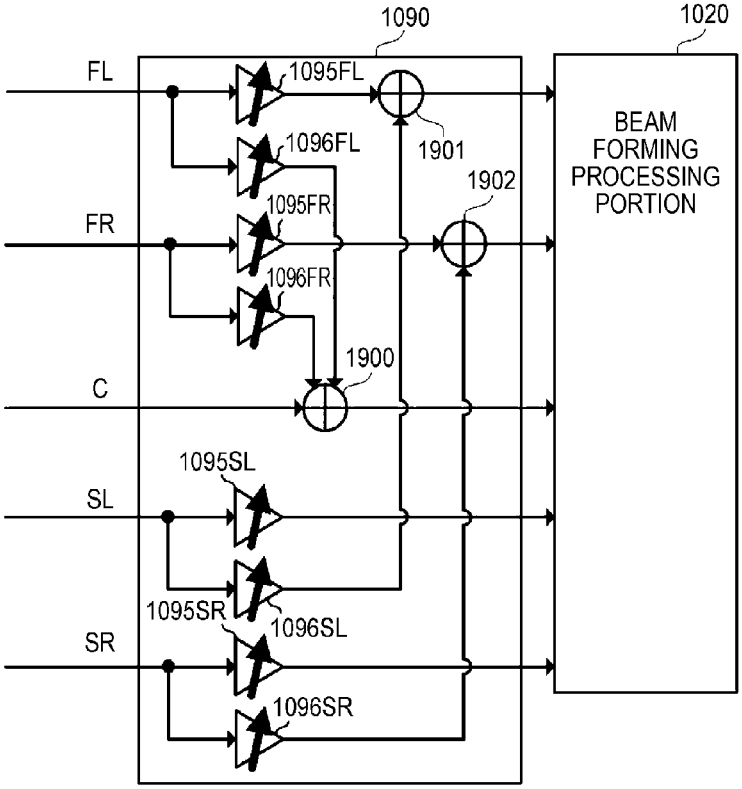
FIG. 22(A) is a block diagram illustrating the configuration of a phantom processing portion.
FIG. 22(B) is a diagram of a correspondence table between a specified angle and a gain ratio.
FIG. 22(C) is a diagram of a correspondence table between the specified angle and a head-related transfer function.

FIG. 22(A) is a block diagram illustrating the configuration of the phantom processing portion 1090. FIG. 22(B) is a diagram of a correspondence table between a specified angle and a gain ratio. FIG. 22(C) is a diagram of a correspondence table between a specified angle and a filter coefficient (a head-related transfer function to be applied by the localization adding portion 1042). The phantom processing portion 1090 includes a gain adjusting portion 1095FL, a gain adjusting portion 1096FL, a gain adjusting portion 1095FR, a gain adjusting portion 1096FR, a gain adjusting portion 1095SL, a gain adjusting portion 1096SL, a gain adjusting portion 1095SR, a gain adjusting portion 1096SR, an adding portion 1900, an adding portion 1901 and an adding portion 1902.

To the gain adjusting portion 1095FL and the gain adjusting portion 1096FL, an audio signal of the FL channel is input. To the gain adjusting portion 1095FR and the gain adjusting portion 1096FR, an audio signal of the FR channel is input. To the gain adjusting portion 1095SL and the gain adjusting portion 1096SL, an audio signal of the SL channel is input. To the gain adjusting portion 1095SR and the gain adjusting portion 1096SR, an audio signal of the SR channel is input.

The audio signal of the FL channel is adjusted in the gain ratio by the gain adjusting portion 1095FL and the gain adjusting portion 1096FL, and the resultants are respectively input to the adding portion 1901 and the adding portion 1900. The audio signal of the FR channel is adjusted in the gain ratio by the gain adjusting portion 1095FR and the gain adjusting portion 1096FR, and the resultants are respectively input to the adding portion 1902 and the adding portion 1900. The audio signal of the SL channel is adjusted in the gain ratio by the gain adjusting portion 1095SL and the gain adjusting portion 1096SL, and the resultants are respectively input to the beam forming processing portion 1020 and the adding portion 1901. The audio signal of the SR channel is adjusted in the gain ratio by the gain adjusting portion 1095SR and the gain adjusting portion 1096SR, and the resultants are respectively input to the beam forming processing portion 1020 and the adding portion 1902.

The gains of the respective gain adjusting portions are set by the control portion 1035. The control portion 1035 reads the correspondence table stored in a memory (not shown) as illustrated in FIG. 22(B), and reads a gain ratio in correspondence with a specified angle. In this example, the control portion 1035 controls the direction of a phantom sound source of the FR channel by controlling a gain ratio between the sound beam of the FR channel reaching from the right forward direction of the listening position and the sound beam of the C channel reaching from the front direction of the listening position.

Figure 23:
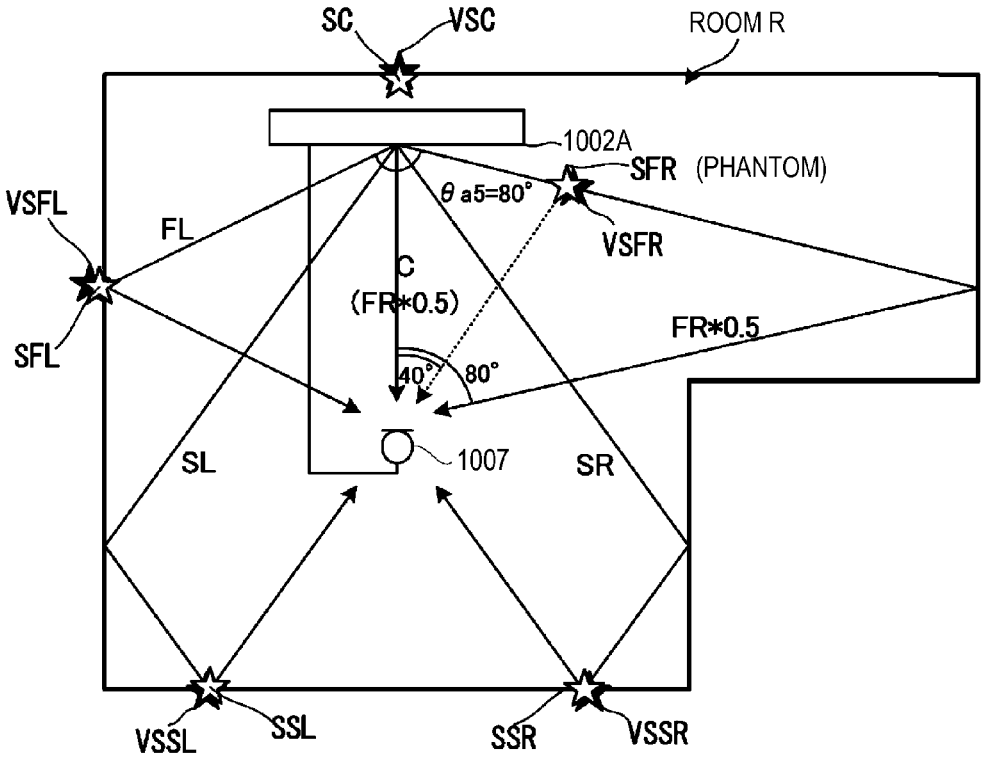
FIG. 23 is a diagram for explaining a sound field generated by an array speaker apparatus.

Referring to FIG. 23, an example in which a phantom sound source and a virtual sound source are both used will be described. In this example, a case where the phantom sound source of the FR channel is to be localized in a direction with a specified angle of 40 degrees (at 40 degrees to the right when seen from the listening position) on the assumption that the reaching direction θa5 of the sound beam of the FR channel is 80 degrees (80 degrees to the right when seen from the listening position) will be described.

Since the specified angle is 40 degrees, the reaching direction θa5 of the sound beam of the FR channel (the FR angle) is 80 degrees and the reaching direction θa3 of the sound beam of the C channel (the C angle) is 0 degree, the control portion 1035 reads the gains of the gain adjusting portion 1095FR and the gain adjusting portion 1096FR corresponding to a gain ratio 100*(40/80)=50. In this case, the control portion 1035 sets the gain of the gain adjusting portion 1095FR to 0.5 and the gain of the gain adjusting portion 1096FR to 0.5. As a result, as illustrated in FIG. 23, the phantom sound source can be localized in the direction of 40 degrees to the right between the sound beam of the FR channel and the sound beam of the C channel reaching from the front of the listening position. Incidentally, although the case where the gain ratio is set so that the gain of the gain adjusting portion 1095FR (0.5)+the gain of the gain adjusting portion 1096FR (0.5)=1.0 (namely, so that the gain can be constant) has been herein described, the gains can be set so that power can be constant. In this case, the gain of the gain adjusting portion 1095FR and the gain of the gain adjusting portion 1096FR are set to −3 dB (approximately 0.707).

Then, the control portion 1035 reads a filter coefficient for localizing the virtual sound source in the direction of 40 degrees, that is, the specified angle, from the table of FIG. 22(C), and sets the filter coefficient in the localization adding portion 1042. Thus, the virtual sound source VSFR is localized in the same direction as the phantom sound source SFR.

It is noted that the specified angle may be input by a listener manually with the user I/F 1036 but can be automatically set by using the measurement result of the test sound beam described above. For example, if the reaching direction θa1 of the sound beam of the FL channel is −60 degrees (60 degrees to the left when seen from the listening position) and the phantom sound source of the FR channel is to be localized in a direction symmetrical to the reaching direction of the sound beam of the FL channel, the specified angle is 60 degrees to the right. In this case, if the FR angle is 80 degrees and the C angle is 0 degree, the gains of the gain adjusting portion 1095FR and the gain adjusting portion 1096FR corresponding to a gain ratio 100*(60/80)=75 are read. Accordingly, the control portion 1035 sets the gain of the gain adjusting portion 1095FR to 0.75 and the gain of the gain adjusting portion 1096FR to 0.25.

In this manner, in the array speaker apparatus 1002A, the localization feeling of a phantom sound source based on a sound beam is compensated by a virtual sound source based on a head-related transfer function not depending on the listening environment such as an acoustic reflectivity of a wall, so that the phantom sound source can be more distinctively localized.

In particular, since the phantom sound source of a surround channel is generated by using sound beams (for example, the sound beam of the FL channel and the sound beam of the SL channel), a distinctive localization feeling cannot be attained in some cases as compared with the case where a front-side channel is localized as a phantom sound source. In the array speaker apparatus 1002A, however, the localization feeling can be compensated by the virtual sound source VSSL and the virtual sound source VSSR generated by the woofer 1033L and the woofer 1033R by using sounds directly reaching the ears of a listener, and therefore, the phantom sound source can be more distinctively localized.

Figure 24:
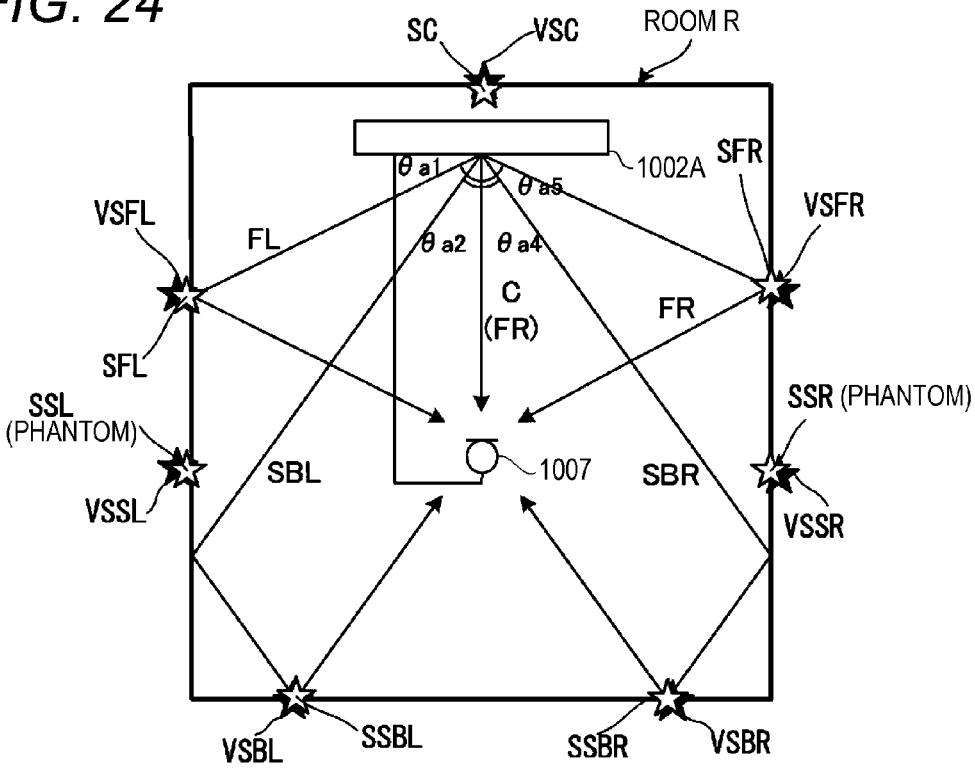
FIG. 24 is another diagram for explaining a sound field generated by the array speaker apparatus.

Incidentally, the array speaker apparatus 1002A is suitable for a case where audio signals of a larger number of channels are localized by using a smaller number of sound beams. FIG. 24 is a diagram illustrating an example where audio signals of 7.1 channels are localized by using five sound beams. The 7.1 channel surround includes, in addition to the 5.1 channel surround (C, FL, FR, SL, SR and LFE), two channels (SBL and SBR) reproduced from backward of a listener. In this example, the array speaker apparatus 1002A sets the SBL channel to a sound beam focused on a position on a wall on a left backward side of the room R, and sets the SBR channel to a sound beam focused on a position on a wall on a right backward side of the room R.

Besides, the array speaker apparatus 1002A sets, by using the sound beams of the SBL channel and the FL channel, a phantom sound source SSL of the SL channel in a position therebetween (−90 degrees to the left from the listening position). Similarly, it sets, by using the sound beams of the SBR channel and the FR channel, a phantom sound source SSR of the SR channel in a position therebetween (90 degrees to the right from the listening position).

Then, the array speaker apparatus 1002A sets a virtual sound source VSSL in the position of the phantom sound source SSL and a virtual sound source VSSR in the position of the phantom sound source SSR.

In this manner, even if a large number of channels are localized by using a smaller number of sound beams, the array speaker apparatus 1002A can compensate the localization feeling by using a virtual sound source generated by the woofer 1033L and the woofer 1033R by using a sound directly reaching the ear of the listener, and therefore, a large number of channels can be more distinctively localized.

Figure 25A:
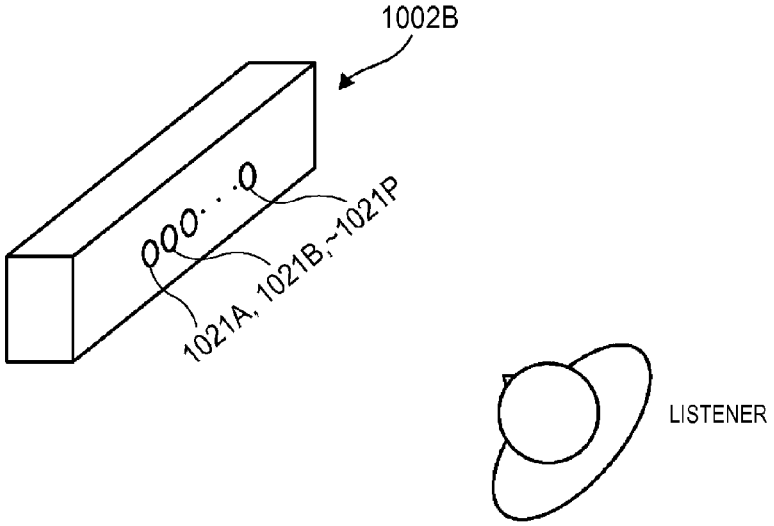
FIGS. 25(A) and 25(B) are diagram illustrating array speaker apparatuses according to modifications.

Next, FIG. 25(A) is a diagram illustrating an array speaker apparatus 1002B according to a modification. The description of the constitution common to the array speaker apparatus 1002 will be herein omitted.

The array speaker apparatus 1002B is different from the array speaker apparatus 1002 in that sounds output from the woofer 1033L and the woofer 1033R are respectively output from the speaker unit 1021A and the speaker unit 1021P.

The array speaker apparatus 1002B outputs a sound for making a virtual sound source perceived from the speaker unit 1021A and the speaker unit 1021P, which are disposed at both ends of the speaker units 1021A to 1021P.

The speaker unit 1021A and the speaker unit 1021P are speaker units disposed at the outermost ends of the array speaker, and are disposed in the leftmost position and the rightmost position when seen from a listener. Accordingly, the speaker unit 1021A and the speaker unit 1021P are suitable for respectively outputting sounds of the L channel and the R channel, and are suitable as speaker units for outputting a sound for making a virtual sound source perceived.

Figure 25B:
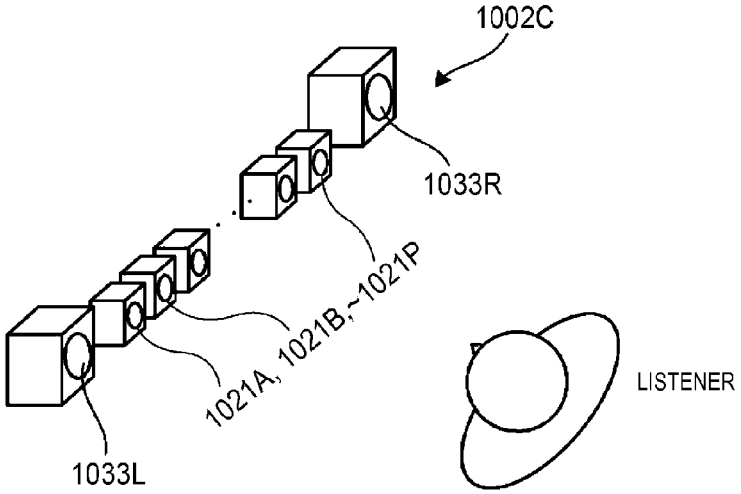

Besides, there is no need for the array speaker apparatus 1002 to include all of the speaker units 1021A to 1021P, the woofer 1033L and the woofer 1033R in one housing. For example, in one aspect, respective speaker units may be provided with individual housings so as to arrange the housings as an array speaker apparatus 1002C illustrated in FIG. 25(B).

Third Embodiment

Figure 26:
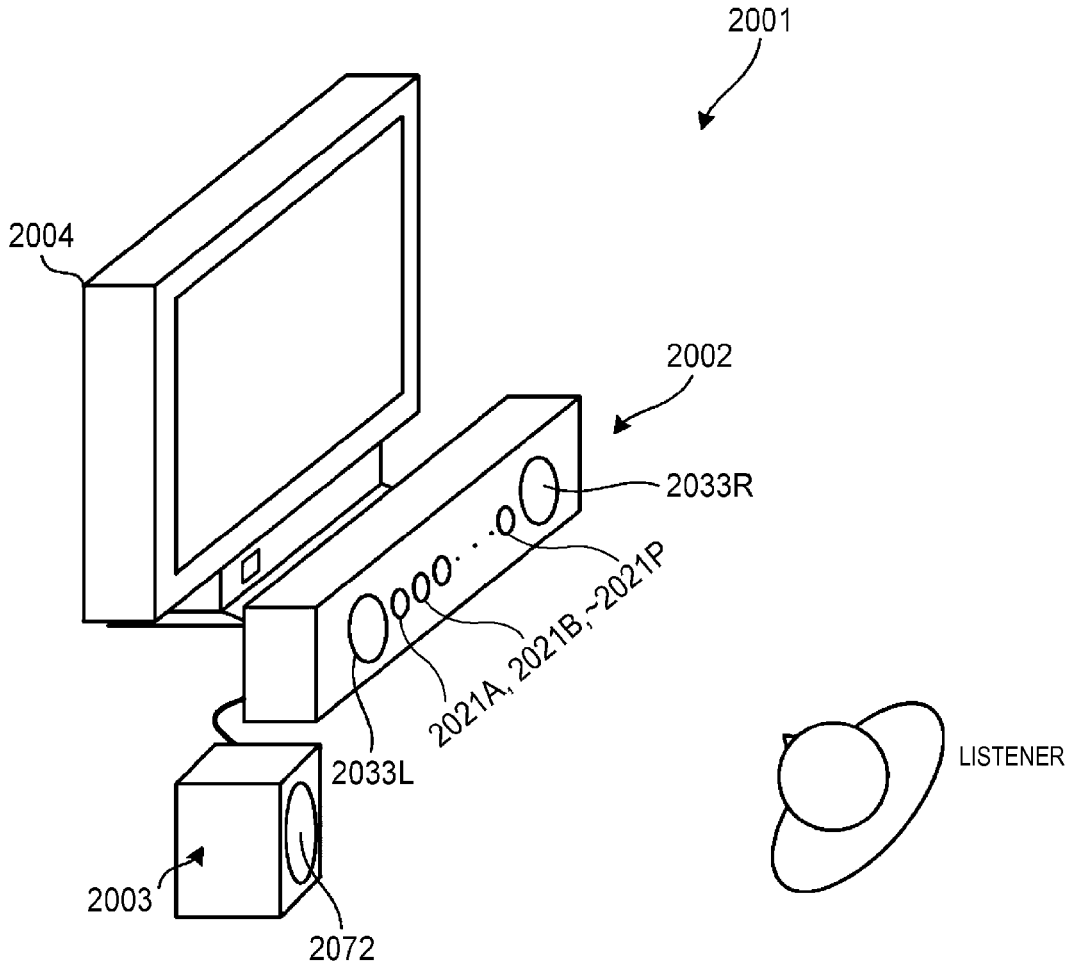
FIG. 26 is a diagram for explaining an AV system including an array speaker apparatus.
Figure 27A:
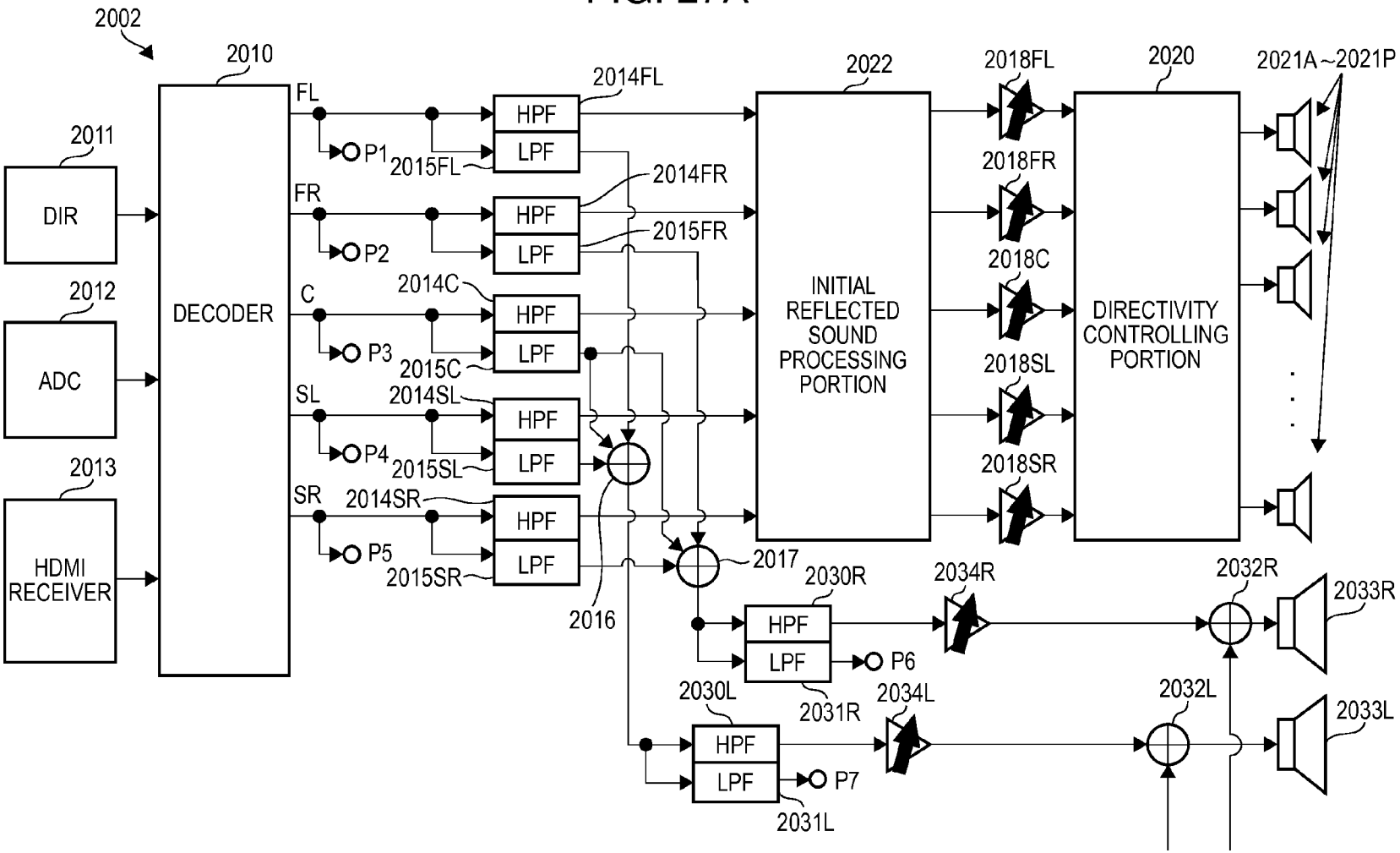
FIGS. 27(A) and 27(B) form together a partial block diagram of an array speaker apparatus and a subwoofer.
Figure 27B:
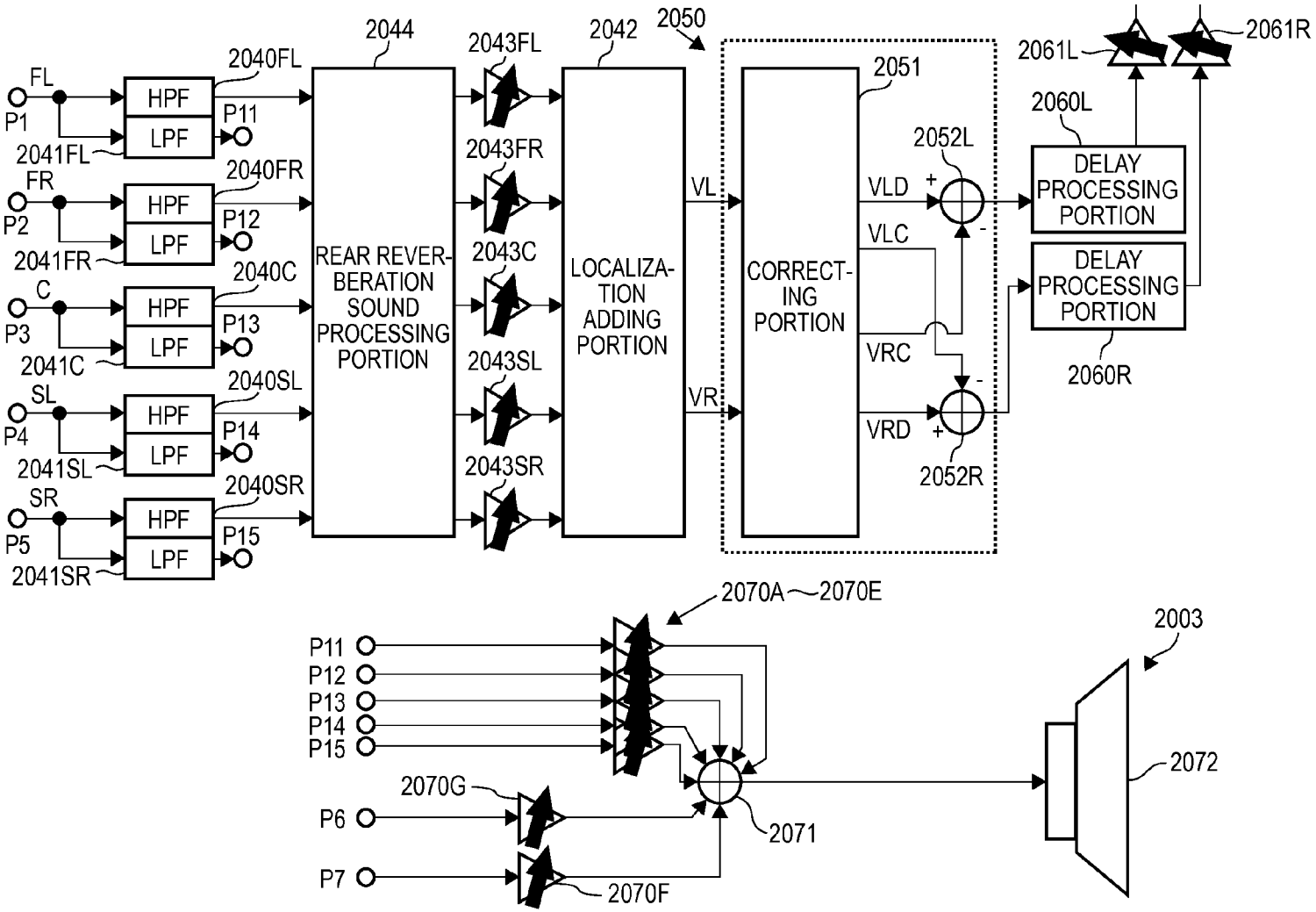
Figure 28A:
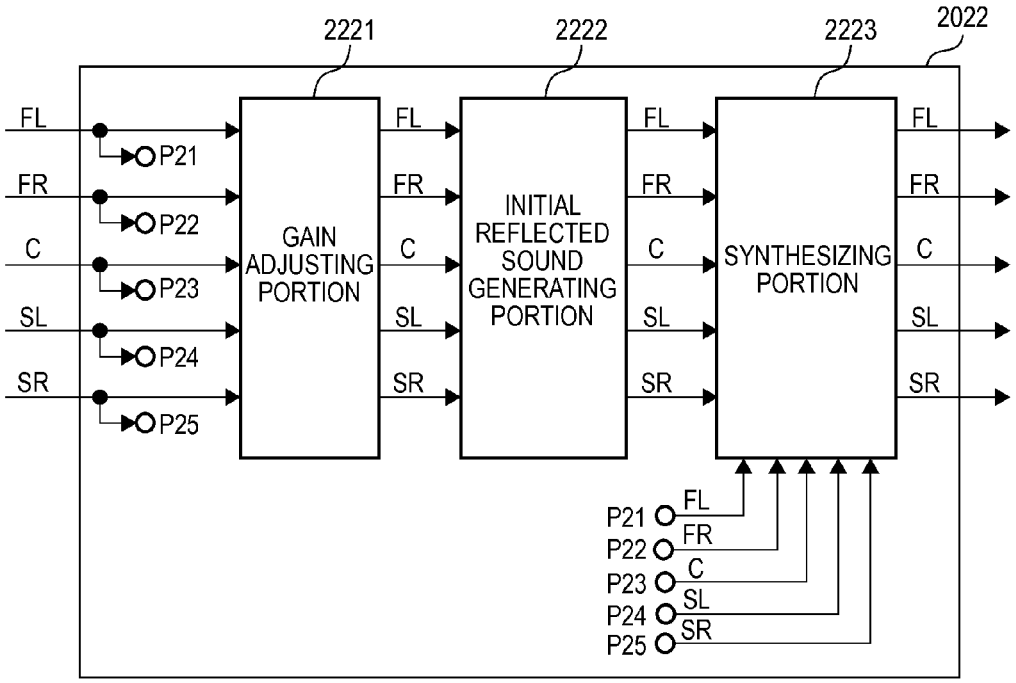
FIGS. 28(A) and 28(B) are block diagrams of an initial reflected sound processing portion and a rear reflected sound processing portion.
Figure 28B:
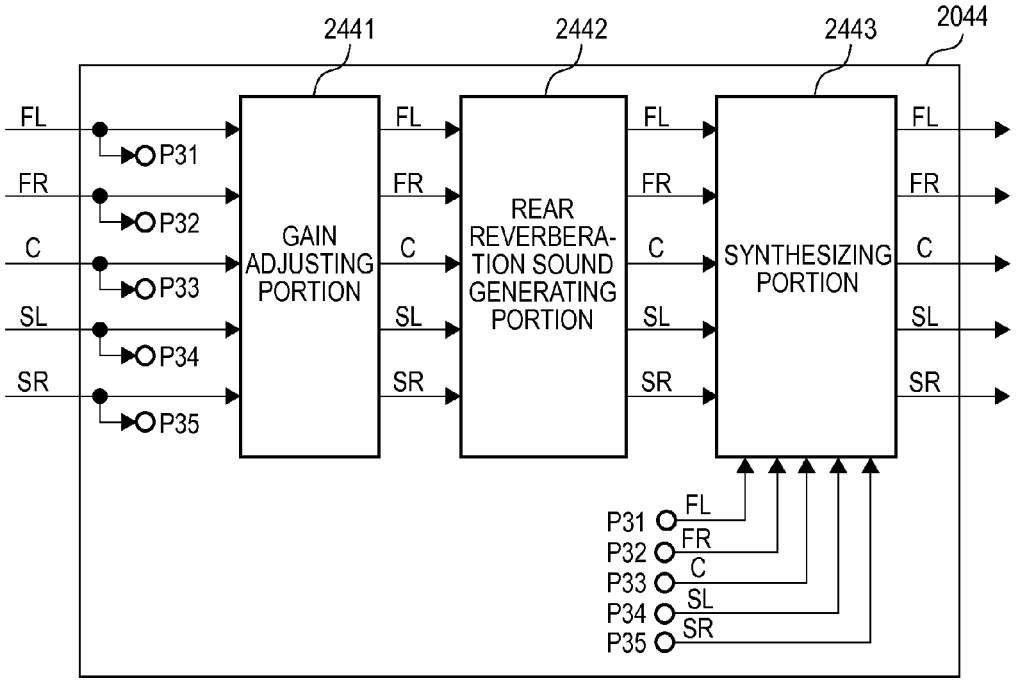
Figure 29:
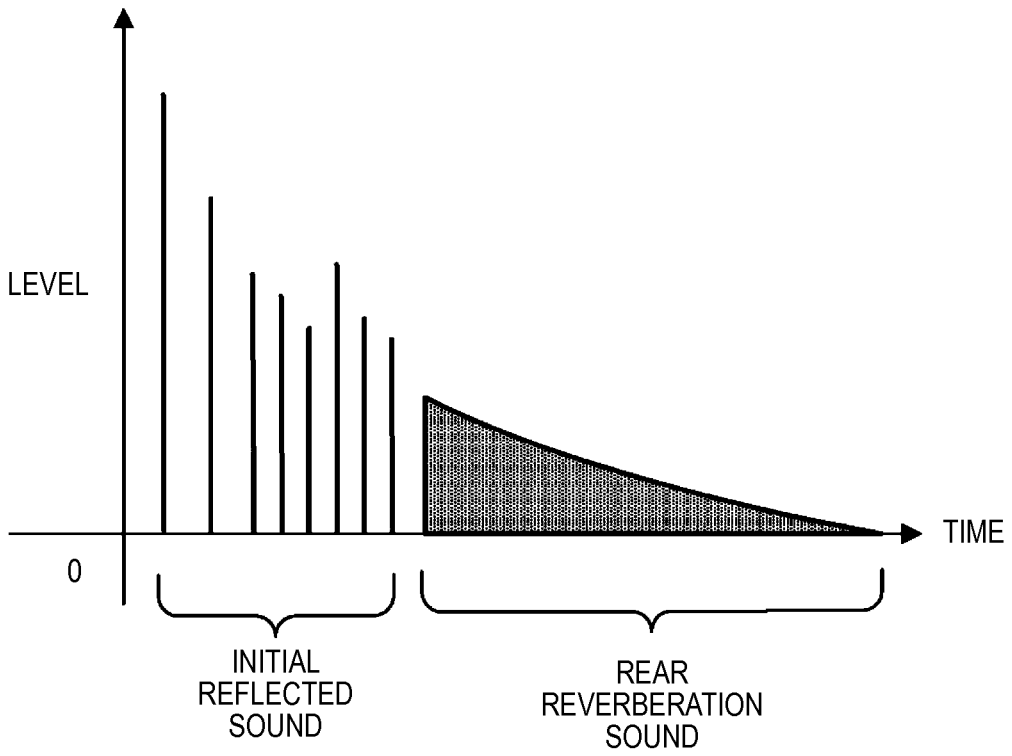
FIG. 29 is a schematic diagram of an example of an impulse response actually measured in a concert hall.
Figure 30A:
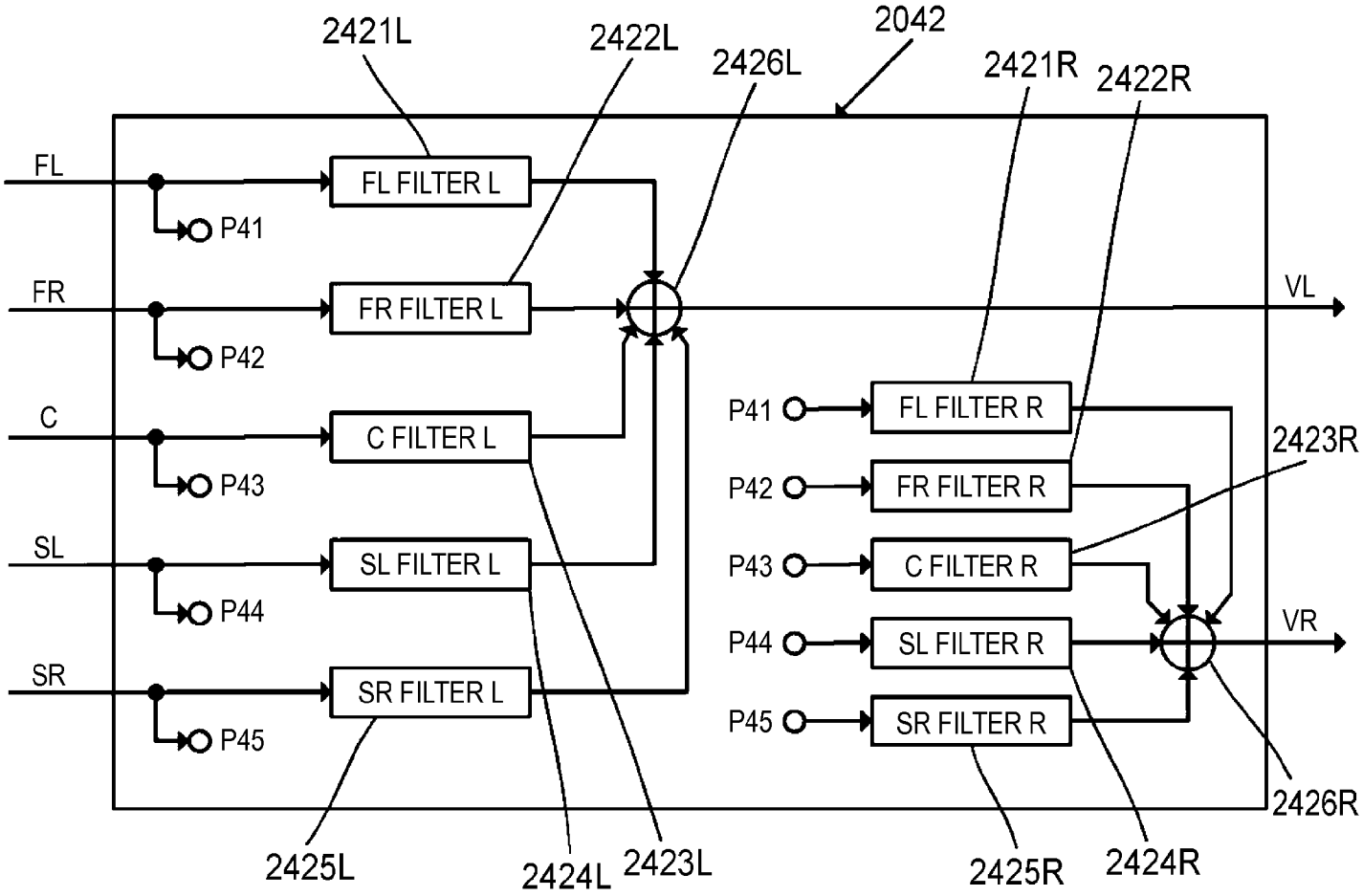
FIGS. 30(A) and 30(B) are block diagrams of a localization adding portion and a correcting portion.
Figure 30B:
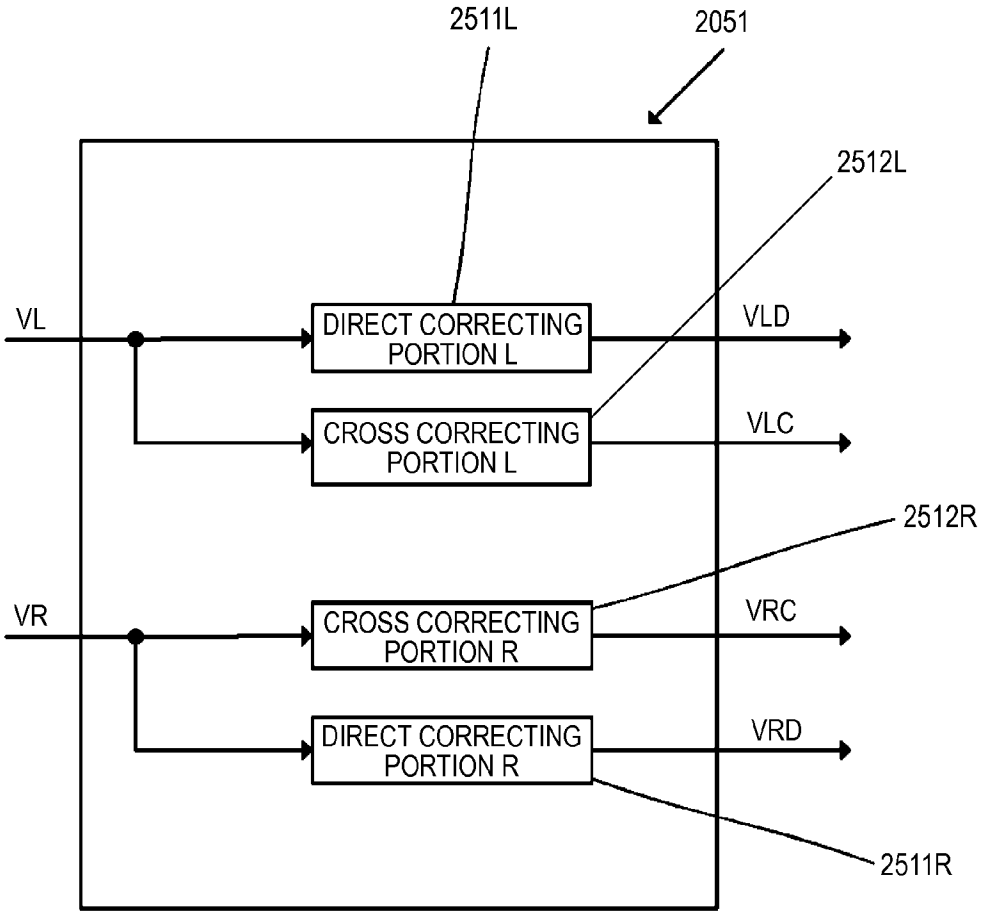
Figure 31:
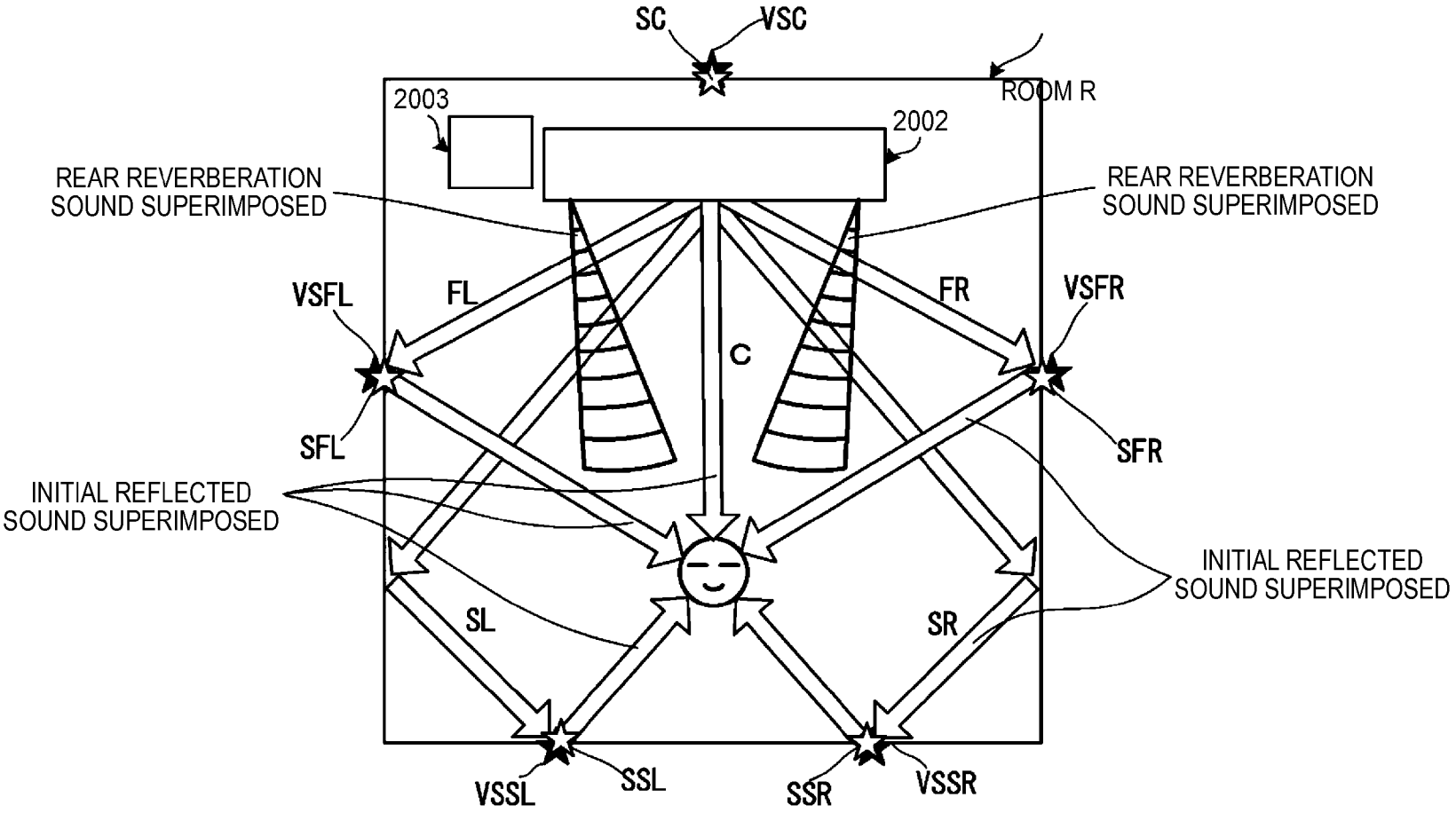
FIG. 31 is a diagram for explaining a sound output by the array speaker apparatus.

An array speaker apparatus 2002 according to a third embodiment will be described with reference to FIGS. 26 to 31. FIG. 26 is a diagram for explaining an AV system 2001 including the array speaker apparatus 2002. FIG. 27 is a partial block diagram of the array speaker apparatus 2002 and a subwoofer 2003. FIG. 28(A) is a block diagram of an initial reflected sound processing portion 2022 and FIG. 28(B) is a block diagram of a rear reflected sound processing portion 2044. FIG. 29 is a schematic diagram illustrating an example of an impulse response actually measured in a concert hall. FIG. 30(A) is a block diagram of a localization adding portion 2042 and FIG. 30(B) is a block diagram of a correcting portion 2051. FIG. 31 is a diagram for explaining a sound output by the array speaker apparatus 2002.

The AV system 2001 includes the array speaker apparatus 2002, the subwoofer 2003 and a television 2004. The array speaker apparatus 2002 is connected to the subwoofer 2003 and the television 2004. To the array speaker apparatus 2002, audio signals in accordance with images reproduced by the television 2004 and audio signals from a content player not shown are input. The array speaker apparatus 2002 outputs, on the basis of an audio signal of a content input thereto, a sound beam having a directivity and a sound for making a virtual sound source perceived, and further adds a sound field effect to a sound of the content.

First, the output of a sound beam and an initial reflected sound will be described. The array speaker apparatus 2002 has, as illustrated in FIG. 26, a rectangular parallelepiped housing. The housing of the array speaker apparatus 2002 includes, on a surface thereof opposing a listener, for example, sixteen speaker units 2021A to 2021P, and woofers 2033L and 2033R (corresponding to a first sound emitting portion of the present invention). It is noted that the number of speaker units is not limited to sixteen but may be, for example, eight or the like.

The speaker units 2021A to 2021P are linearly arranged. The speaker units 2021A to 2021P are successively arranged in a left-to-right order when the array speaker apparatus 2002 is seen from the listener. The woofer 2033L is disposed on the further left side of the speaker unit 2021A. The woofer 2033R is disposed on the further right side of the speaker unit 2021P.

The array speaker apparatus 2002 includes, as illustrated in FIG. 27, a decoder 2010 and a directivity controlling portion 2020. It is noted that a combination of the speaker units 2021A to 2021P and the directivity controlling portion 2020 corresponds to a second sound emitting portion of the present invention.

The decoder 2010 is connected to a DIR (Digital audio I/F Receiver) 2011, an ADC (Analog to Digital Converter) 2012, and an HDMI (registered trademark; High Definition Multimedia Interface) receiver 2013.

The DIR 2011 receives, as an input, a digital audio signal transmitted through an optical cable or a coaxial cable. The ADC 2012 converts an analog signal input thereto into a digital signal. The HDMI receiver 2013 receives, as an input, an HDMI signal according to the HDMI standard.

The decoder 2010 supports various data formats including AAC (registered trademark), Dolby Digital (registered trademark), DTS (registered trademark), MPEG-1/2, MPEG-2 multi-channel and MP3. The decoder 2010 converts digital audio signals output from the DIR 2011 and the ADC 2012 into multi-channel audio signals (digital audio signals of an FL channel, an FR channel, a C channel, an SL channel and an SR channel; it is noted that simple designation of an audio signal used hereinafter refers to a digital audio signal), and outputs the converted signals. The decoder 2010 extracts audio data from the HDMI signal (the signal according to the HDMI standard) output from the HDMI receiver 2013 to decode it into an audio signal, and outputs the decoded audio signal. It is noted that the decoder 2010 can convert audio data into not only a 5-channel audio signal but also audio signals of various numbers of channels such as a 7-channel audio signal.

The array speaker apparatus 2002 includes HPFs 2014 (2014FL, 2014FR, 2014C, 2014SR and 2014SL) and LPFs 2015 (2015FL, 2015FR, 2015C, 2015SR and 2015SL), so that the band of each audio signal output from the decoder 2010 can be divided for outputting a high frequency component (of, for example, 200 Hz or more) to the speaker units 2021A to 2021P and a low frequency component (of, for example, lower than 200 Hz) to the woofers 2033L and 2033R and a subwoofer unit 2072. The cut-off frequencies of the HPFs 2014 and the LPFs 2015 are respectively set in accordance with the lower limit (200 Hz) of the reproduction frequency of the speaker units 2021A to 2021P.

The audio signals of the respective channels output from the decoder 2010 are respectively input to the HPFs 2014 and the LPFs 2015. Each HPF 2014 extracts a high frequency component (of 200 Hz or more) of the audio signal input thereto and outputs the resultant. Each LPF 2015 extracts a low frequency component (lower than 200 Hz) of the audio signal input thereto and outputs the resultant.

The array speaker apparatus 2002 includes, as illustrated in FIG. 27, the initial reflected sound processing portion 2022 for adding a sound field effect of an initial reflected sound to the sound of a content. Each audio signal output from the HPFs 2014 is input to the initial reflected sound processing portion 2022. The initial reflected sound processing portion superimposes an audio signal of an initial reflected sound to the audio signal input thereto, and outputs the resultant to a corresponding one of level adjusting portions 2018 (2018FL, 2018FR, 2018C, 2018SR and 2018SL).

More specifically, the initial reflected sound processing portion 2022 includes, as illustrated in FIG. 28(A), a gain adjusting portion 2221, an initial reflected sound generating portion 2222 and a synthesizing portion 2223. Each audio signal input to the initial reflected sound processing portion 2022 is input to the gain adjusting portion 2221 and the synthesizing portion 2223. The gain adjusting portion 2221 adjusts a level ratio between the level of each audio signal input thereto and the level of a corresponding audio signal input to the gain adjusting portion 2441 (see FIG. 28(B)) for adjusting a level ratio between an initial reflected sound and a rear reverberation sound, and outputs each audio signal having been adjusted in the level to the initial reflected sound generating portion 2222.

The initial reflected sound generating portion 2222 generates an audio signal of the initial reflected sound on the basis of each audio signal input thereto. The audio signal of the initial reflected sound is generated to reflect a reaching direction of the actual initial reflected sound and a delay time of the initial reflected sound.

As illustrated in FIG. 29, the actual initial reflected sound is generated from the occurrence of a direct sound (corresponding to a point of time 0 in the schematic diagram of FIG. 29) until a prescribed time (of, for example, within 300 msec) elapses. Since the actual initial reflected sound is reflected by a smaller number of times as compared with a rear reverberation sound, its reflection pattern is different depending on a reaching direction. Accordingly, the actual initial reflected sound has a different frequency characteristic depending on the reaching direction.

The audio signal of such an initial reflected sound is generated by convolving a prescribed coefficient to an input audio signal by using, for example, an FIR filter. The prescribed coefficient is set on the basis of, for example, sampling data of the impulse response of the actual initial reflected sound illustrated in FIG. 29. Then, the audio signal of the initial reflected sound generated by the initial reflected sound generating portion 2222 is distributed to audio signals of the respective channels in accordance with the reaching direction of the actual initial reflected sound, and then the distributed signals are output. Besides, the initial reflected sound is generated so as to discretely occur until a prescribed time (of, for example, within 300 msec) elapses from the occurrence of a direct sound (corresponding to the audio signal directly input from the HPF 2014 to the synthesizing portion 2223).

Each audio signal output from the initial reflected sound generating portion 2222 is input to the synthesizing portion 2223. The synthesizing portion 2223 outputs, with respect to each channel, an audio signal, which is obtained by synthesizing an audio signal input from the HPF 2014 and an audio signal input from the initial reflected sound generating portion 2222, to the level adjusting portion 2018. Thus, the initial reflected sound is superimposed on the direct sound (corresponding to the audio signal directly input from the HPF 2014 to the synthesizing portion 2223). In other words, the characteristic of the initial reflected sound is added to the direct sound. This initial reflected sound is output, together with the direct sound, in the form of a sound beam.

The level adjusting portion 2018 is provided for adjusting the level of a sound beam of the corresponding channel. The level adjusting portion 2018 adjusts the level of the corresponding audio signal and outputs the resultant.

The directivity controlling portion 2020 receives, as an input, each audio signal output from the level adjusting portions 2018. The directivity controlling portion 2020 distributes the audio signal of each channel input thereto correspondingly to the number of the speaker units 2021A to 2021P, and delays the distributed signals respectively by prescribed delay times. The delayed audio signal of each channel is converted into an analog audio signal by a DAC (Digital to Analog Converter) not shown to be input to the speaker units 2021A to 2021P. The speaker units 2021A to 2021P emit sounds on the basis of the audio signal of each channel input thereto.

If the directivity controlling portion 2020 controls the delays so that a difference in the delay amount between audio signals to be input to adjacent speaker units among from the speaker units 2021A to 2021P can be constant, respective sounds output from the speaker units 2021A to 2021P are mutually strengthened in the phase in directions according to the differences in the delay amount. As a result, sound beams are formed as parallel waves proceeding from the speaker units 2021A to 2021P in prescribed directions.

The directivity controlling portion 2020 can perform delay control for causing the sounds output from the speaker units 2021A to 2021P to have the same phase in a prescribed position. In this case, the sounds respectively output from the speaker units 2021A to 2021P are formed as sound beams focused on the prescribed position.

It is noted that the array speaker apparatus 2002 may include an equalizer for each channel in a stage previous to or following the directivity controlling portion 2020 so as to adjust the frequency characteristic of each audio signal.

The audio signals output from the LPFs 2015 are input to the woofers 2033L and 2033R and the subwoofer unit 2072.

The array speaker apparatus 2002 includes HPFs 2030 (2030L and 2030R) and LPFs (2031L and 2031R) for further dividing an audio signal other than the band of the sound beam (of lower than 200 Hz) into a band for the woofers 2033L and 2033R (of, for example, 100 Hz or more) and a band for the subwoofer unit 2072 (of, for example, lower than 100 Hz). The cut-off frequencies of the HPFs 2030 and the LPFs 2031 are respectively set according to the upper limit (100 Hz) of the reproduction frequency of the subwoofer unit 2072.

The audio signals (of lower than 200 Hz) output from the LPFs 2015 (2015FL, 2015C and 2015SL) are added up by an adding portion 2016. An audio signal resulting from the addition by the adding portion 16 is input to the HPF 2030L and the LPF 2031L. The HPF 2030L extracts a high frequency component (of 100 Hz or more) of the audio signal input thereto and outputs the resultant. The LPF 2031L extracts a low frequency component (lower than 100 Hz) of the audio signal input thereto and outputs the resultant. The audio signal output from the HPF 2030L is input to the woofer 2033L via a level adjusting portion 2034L, an adding portion 2032L and a DAC not shown. The audio signal output from the LPF 2031L is input to the subwoofer unit 2072 of the subwoofer 2003 via a level adjusting portion 2070F, an adding portion 2071 and a DAC not shown. The level adjusting portion 2034L and the level adjusting portion 2070F adjust the levels of audio signals input thereto for adjusting a level ratio among a sound beam, a sound output from the woofer 2033L and a sound output from the subwoofer unit 2072, and output the level-adjusted signals.

The audio signals output from the LPFs 2015 (2015FR, 2015C and 2015SR) are added up by an adding portion 2017. An audio signal resulting from the addition by the adding portion 2017 is input to the HPF 2030R and the LPF 2031R. The HPF 2030R extracts a high frequency component (of 100 Hz or more) of the audio signal input thereto and outputs the resultant. The LPF 2031R extracts a low frequency component (lower than 100 Hz) of the audio signal input thereto and outputs the resultant. The audio signal output from the HPF 2030R is input to the woofer 2033R via a level adjusting portion 2034R, an adding portion 2032R and a DAC not shown. The audio signal output from the LPF 2031R is input to the subwoofer unit 2072 via a level adjusting portion 2070G, the adding portion 2071 and a DAC not shown. The level adjusting portion 2034R and the level adjusting portion 2070G adjust the levels of audio signals input thereto for adjusting a level ratio among a sound beam, a sound output from the woofer 2033R and a sound output from the subwoofer unit 2072, and output the level-adjusted signals.

As described so far, the array speaker apparatus 2002 outputs the sound other than the band of the sound beam (of lower than 200 Hz) from the woofers 2033L and 2033R and the subwoofer unit 2072 while outputting, from the speaker units 2021A to 2021P, the sound beam of each channel on which the initial reflected sound is superimposed.

Incidentally, the cut-off frequency of an HPF 2040FL, an HPF 2040FR, an HPF 2040C, an HPF 2040SL and an HPF 2040SR may be the same as the cut-off frequency of the HPF 2014FL, the HPF 2014FR, the HPF 2014C, the HPF 2014SL and the HPF 2014SR. Besides, in one aspect, the HPF 2040FL, the HPF 2040FR, the HPF 2040C, the HPF 2040SL and the HPF 2040SR alone may be provided in the stage previous to the reflected sound processing portion 2044 without outputting a low frequency component to the subwoofer 2003.

Next, the localization of a virtual sound source and the output of a rear reverberation sound will be described. The array speaker apparatus 2002 includes, as illustrated in FIG. 27, the rear reflected sound processing portion 2044, the localization adding portion 2042, a crosstalk cancellation processing portion 2050 and delay processing portions 2060L and 2060R.

The array speaker apparatus 2002 includes the HPFs 2040 (2040FL, 2040FR, 2040C, 2040SR and 2040SL) and LPFs 2041 (2041FL, 2041FR, 2041C, 2041SR and 2041SL) for dividing the band of an audio signal output from the decoder 2010 so as to output a high frequency component (of, for example, 100 Hz or more) to the woofer 2033L and 2033R and a low frequency component (of, for example, lower than 100 Hz) to the subwoofer unit 2072. The cut-off frequencies of the HPFs 2040 and the LPFs 2041 are respectively set according to the upper limit (100 Hz) of the reproduction frequency of the subwoofer unit 2072.

An audio signal of each channel output from the decoder 2010 is input to the corresponding HPF 2040 and LPF 2041. The HPF 2040 extracts a high frequency component (of 100 Hz or more) of the audio signal input thereto and outputs the resultant. The LPF 2041 extracts a low frequency component (lower than 100 Hz) of the audio signal input thereto and outputs the resultant.

The array speaker apparatus 2002 includes level adjusting portions 2070A to 2070E for adjusting a level ratio between a sound output from the woofers 2033L and 2033R and a sound output from the subwoofer unit 2072.

Each audio signal output from the LPF 2041 is adjusted in the level by the corresponding one of the level adjusting portions 2070A to 2070E. Audio signals resulting from the level adjustment by the level adjusting portions 2070A to 2070E are added up by the adding portion 2071. An audio signal resulting from the addition by the adding portion 2071 is input to the subwoofer unit 2072 via a DAC not shown.

Each audio signal output from the HPF 2040 is input to the rear reflected sound processing portion 2044. The rear reflected sound processing portion 2044 superimposes an audio signal of a rear reverberation sound on each audio signal input thereto, and outputs the resultant to a corresponding one of level adjusting portions 2043 (2043FL, 2043FR, 2043C, 2043SR and 2043SL).

More specifically, the rear reflected sound processing portion 2044 includes, as illustrated in FIG. 28(B), a gain adjusting portion 2441, a rear reverberation sound generating portion 2422 and a synthesizing portion 2443. Each audio signal input to the rear reflected sound processing portion 2044 is input to the gain adjusting portion 2441 and the synthesizing portion 2443. The gain adjusting portion 2441 adjusts a level ratio between the level of each audio signal input thereto and the level of the corresponding audio signal input to the gain adjusting portion 2221 of the initial reflected sound processing portion 2022 for adjusting a level ratio between an initial reflected sound and a rear reverberation sound, and outputs the level-adjusted audio signal to the rear reverberation sound generating portion 2442.

The rear reverberation sound generating portion 2442 generates an audio signal of a rear reverberation sound on the basis of each audio signal input thereto.

As illustrated in FIG. 29, an actual rear reverberation sound occurs after an initial reflected sound for a prescribed time period (of, for example, 2 seconds). Since the actual rear reverberation sound is reflected by a larger number of times than the initial reflected sound, its reflection pattern is substantially uniform regardless of the reaching direction. Accordingly, the rear reverberation sound has substantially the same frequency component regardless of the reaching direction.

In order to generate such a rear reverberation sound, the rear reverberation sound generating portion 2442 includes, with respect to each channel, a constitution of a combination of multiple stages of recursive filters (IIR filters) of a comb filter and an all-pass filter. The coefficient of each filter is set so as to attain characteristics of the actual rear reverberation sound (such as a delay time from the direct sound, the duration of the rear reverberation sound, and the attenuation of the rear reverberation sound in the duration). For example, the rear reverberation sound is generated so as to occur after a generation time (300 msec after the occurrence of a direct sound) of the initial reflected sound generated by the initial reflected sound generating portion 2222 has elapsed. Thus, the rear reverberation sound generating portion 2442 generates, with respect to each channel, the audio signal of the rear reverberation sound after 300 msec has elapsed from the occurrence of the direct sound until 2,000 msec elapses, and outputs the generated signal to the synthesizing portion 2443. Incidentally, although the rear reverberation sound generating portion 2442 is realized by using the IIR filters in this example, it can be also realized by using FIR filters.

Each audio signal output from the rear reverberation sound generating portion 2442 is input to the synthesizing portion 2443. The synthesizing portion 2443 synthesizes, as illustrated in FIG. 27 and FIG. 28(B), each audio signal input from the HPF 2040 with the corresponding audio signal input from the rear reverberation sound generating portion 2442, and outputs the synthesized signal to the level adjusting portion 2043. Thus, the rear reverberation sound is superimposed on the direct sound (corresponding to the audio signal directly input from the HPF 2040 to the synthesizing portion 2443). In other words, the characteristics of the rear reverberation sound are added to the direct sound. This rear reverberation sound is output from the woofers 2033L and 2033R together with the sound for making a virtual sound source perceived.

The level adjusting portion 2043 adjusts the level of each audio signal input thereto for adjusting, with respect to each channel, the level of the sound for making a virtual sound source perceived, and outputs the resultant to the localization adding portion 2042.

The localization adding portion 2042 performs processing for localizing each audio signal input thereto in a virtual sound source position. In order to localize an audio signal in a virtual sound source position, a head-related transfer function (hereinafter referred to as the HRTF) corresponding to a transfer function between a prescribed position and an ear of a listener is employed.

The HRTF corresponds to an impulse response expressing the loudness, the reaching time, the frequency characteristic and the like of a sound emitted from a virtual speaker placed in a given position to right and left ears. When the HRTF is applied to an audio signal to emit a sound from the woofer 2033L (or the woofer 2033R), a listener perceives as if the sound was emitted from the virtual speaker.

The localization adding portion 2042 includes, as illustrated in FIG. 30(A), filters 2421L to 2425L and filters 2421R to 2425R for convolving an impulse response of an HRTF for the respective channels.

An audio signal of the FL channel (an audio signal output from the HPF 2040FL) is input to the filters 2421L and 2421R. The filter 2421L applies, to the audio signal of the FL channel, an HRTF corresponding to a path from the position of a virtual sound source VSFL (see FIG. 31) disposed on a left forward side of a listener to his/her left ear. The filter 2421R applies, to the audio signal of the FL channel, an HRTF corresponding to a path from the position of the virtual sound source VSFL to the listener's right ear.

The filter 2422L applies, to an audio signal of the FR channel, an HRTF corresponding to a path from the position of a virtual sound source VSFR disposed on a right forward side of the listener to his/her left ear. The filter 2422R applies, to the audio signal of the FR channel, an HRTF corresponding to a path from the position of the virtual sound source VSFR to the listener's right ear.

Each of the filters 2423L to 2425L applies, to an audio signal of the C channel, the SL channel or the SR channel, an HRTF corresponding to a path from the position of a virtual sound source VSC, VSSL or VSSR corresponding to the C, SL or SR channel to the listener's left ear. Each of the filters 2423R to 2425R applies, to the audio signal of the C channel, the SL channel or the SR channel, an HRTF corresponding to a path from the position of the virtual sound source VSC, VSSL or VSSR corresponding to the C, SL or SR channel to the listener's right ear.

Then, an adding portion 2426L synthesizes audio signals output from the filters 2421L to 2425L and outputs the resultant as an audio signal VL to the crosstalk cancellation processing portion 2050. An adding portion 2426R synthesizes audio signals output from the filters 2421R to 2425R and outputs the resultant as an audio signal VR to the crosstalk cancellation processing portion 2050.

The crosstalk cancellation processing portion 2050 changes the frequency characteristics of the respective audio signals input to the woofer 2033L and the woofer 2033R so that crosstalk emitted from the woofer 2033L to reach the right ear can be cancelled and that a direct sound emitted from the woofer 2033L to reach the left ear can sound flat. Similarly, the crosstalk cancellation processing portion 2050 changes the frequency characteristics of the respective audio signals input to the woofer 2033L and the woofer 2033R so that crosstalk emitted from the woofer 2033R to reach the left ear can be cancelled and that a direct sound emitted from the woofer 2033R to reach the right ear can sound flat.

More specifically, the crosstalk cancellation processing portion 2050 performs processing by using the correcting portion 2051 and synthesizing portions 2052L and 2052R.

The correcting portion 2051 includes, as illustrated in FIG. 30(B), direct correcting portions 2511L and 2511R and cross correcting portions 2512L and 2512R. The audio signal VL is input to the direct correcting portion 2511L and the cross correcting portion 2512L. The audio signal VR is input to the direct correcting portion 2511R and the cross correcting portion 2512R.

The direct correcting portion 2511L performs processing for causing a listener to perceive as if a sound output from the woofer 2033L was emitted in the vicinity of his/her left ear. The direct correcting portion 2511L has a filter coefficient set for making the sound output from the woofer 2033L sound flat in the position of the left ear. The direct correcting portion 2511L corrects the audio signal VL input thereto to output an audio signal VLD.

The cross correcting portion 2512R, in combination with the synthesizing portion 2052L, outputs, from the woofer 2033L, a reverse phase sound of a sound routing around from the woofer 2033R to the left ear for canceling the sound pressure in the position of the left ear, so as to inhibit the sound from the woofer 2033R from being heard by the left ear. Besides, the cross correcting portion 2512R performs processing for causing a listener to perceive as if a sound output from the woofer 2033L was emitted in the vicinity of his/her left ear. The cross correcting portion 2512R has a filter coefficient set for making the sound output from the woofer 2033R not heard in the position of the left ear. The cross correcting portion 2512R corrects the audio signal VR input thereto to output an audio signal VRC.

The synthesizing portion 2052L reverses the phase of the audio signal VRC and synthesizes the reverse signal with the audio signal VLD.

The direct correcting portion 2511R performs processing for causing a listener to perceive as if a sound output from the woofer 2033R was emitted in the vicinity of his/her right ear. The direct correcting portion 2511R has a filter coefficient set for making the sound output from the woofer 2033R sound flat in the position of the right ear. The direct correcting portion 2511R corrects the audio signal VR input thereto to output an audio signal VRD.

The cross correcting portion 2512L, in combination with the synthesizing portion 2052R, outputs, from the woofer 2033R, a reverse phase sound of a sound routing around from the woofer 2033L to the right ear for canceling the sound pressure in the position of the right ear, so as to inhibit the sound from the woofer 2033L from being heard by the right ear. Besides, the cross correcting portion 2512L performs processing for causing a listener to perceive as if a sound output from the woofer 2033R was emitted in the vicinity of his/her right ear. The cross correcting portion 2512L has a filter coefficient set for making the sound output from the woofer 2033L not heard in the position of the right ear. The cross correcting portion 2512L corrects the audio signal VL input thereto to output an audio signal VLC.

The synthesizing portion 2052R reverses the phase of the audio signal VLC and synthesizes the reverse signal with the audio signal VRD.

An audio signal output from the synthesizing portion 2052L is input to the delay processing portion 2060L. The audio signal is delayed by the delay processing portion 2060L by a prescribed time and the delayed signal is input to a level adjusting portion 2061L. An audio signal output from the synthesizing portion 2052R is input to the delay processing portion 2060R. The delay processing portion 2060R delays the audio signal by the same delay time as the delay processing portion 2060L.

The delay time caused by the delay processing portions 2060L and 2060R is set so that a sound beam and a sound for making a virtual sound source perceived cannot be output at the same timing Thus, the formation of the sound beam is difficult to be impeded by the sound for making a virtual sound source perceived. Incidentally, in one aspect, the array speaker apparatus 2002 may include a delay processing portion for each channel in a stage following the directivity controlling portion 2020 so as to delay a sound beam for preventing the sound beam from impeding the sound for making a virtual sound source perceived.

The level adjusting portions 2061L and 2061R are provided for adjusting the levels of the sounds for making virtual sound sources perceived of all the channels all at once. The level adjusting portions 2061L and 2061R adjust the levels of the respective audio signals having been delayed by the delay processing portions 2060L and 2060R. The respective audio signals having been adjusted in the level by the level adjusting portions 2061L and 2061R are input to the woofers 2033L and 2033R via the adding portions 2032L and 2032R.

Since an audio signal out of the band of the sound beam (of lower than 200 Hz) to be output from the speaker units 2021A to 2021P is input to the adding portions 2032L and 2032R, a sound out of the band of the sound beam and a sound for localizing a virtual sound source are output from the woofers 2033L and 2033R.

In this manner, the array speaker apparatus 2002 localizes, in a virtual sound source position, an audio signal of each channel on which an audio signal of a rear reverberation sound is superimposed.

Next, a sound field generated by the array speaker apparatus 2002 will be described with reference to FIG. 31. In FIG. 31, a white arrow indicates the path of each sound beam output from the array speaker apparatus 2002, and a plurality of arcs indicate a sound for making a virtual sound source perceived output from the array speaker apparatus 2002. Besides, in FIG. 31, a star indicates the position of each sound source generated by a sound beam or the position of each virtual sound source.

The array speaker apparatus 2002 outputs, as illustrated in FIG. 31, five sound beams in accordance with the number of channels of input audio signals. An audio signal of the C channel is controlled to be delayed, for example, to have a focus position set behind the array speaker apparatus 2002. Thus, a listener perceives that a sound source SC of the audio signal of the C channel is disposed in front of him/her.

Audio signals of the FL and FR channels are controlled to be delayed, for example, so that sound beams can be focused respectively on walls on the left forward side and the right forward side of the listener. The sound beams based on the audio signals of the FL and FR channels reach the position of the listener after being reflected once on the walls of the room R. Thus, the listener perceives that sound sources SFL and SFR of the audio signals of the FL and FR channels are disposed on the walls on the left forward side and the right forward side of the listener.

Audio signals of the SL and SR channels are controlled to be delayed, for example, so that sound beams can be directed respectively toward walls on the left side and the right side of the listener. The sound beams based on the audio signals of the SL and SR channels reach walls on the left backward side and the right backward side of the listener after being reflected on the walls of the room R. The respective sound beams are respectively reflected again on the walls on the left backward side and the right backward side of the listener to reach the position of the listener. Thus, the listener perceives that sound sources VSSL and VSSR of the audio signals of the SL and SR channels are disposed on the walls on the left backward side and the right backward side of the listener.

The filters 2421L to 2425L and the filters 2421R to 2425R of the localization adding portion 2042 are respectively set so that the positions of virtual speakers can be respectively substantially the same as the positions of the sound sources SFL, SFR, SC, SSL and SSR. Thus, the listener perceives the virtual sound sources VSC, VSFL, VSFR, VSSL and VSSR in substantially the same positions as the sound sources SFL, SFR, SC, SSL and SSR as illustrated in FIG. 31.

As a result, in the array speaker apparatus 2002, the localization feeling is improved as compared with the case where a sound beam alone is used or a virtual sound source alone is used.

Here, the array speaker apparatus 2002 superimposes an initial reflected sound on each sound beam as illustrated in FIG. 31. The initial reflected sound having a different frequency characteristic depending on the reaching direction is not superimposed on a sound for making a virtual sound source perceived, and hence the frequency characteristic of the head-related transfer function is retained. Besides, the sound for making a virtual sound source perceived provides the localization feeling by using a difference in the frequency characteristic, a difference in the reaching time of a sound and a difference in the sound volume between both ears, and therefore, even when a rear reverberation sound having a uniform frequency characteristic is superimposed for each channel, the frequency characteristic of the head-related transfer function is not affected, and hence the localization feeling is not varied.

Furthermore, in the array speaker apparatus 2002, a rear reverberation sound is not superimposed on each sound beam but is superimposed on a sound for making a virtual sound source perceived. Accordingly, in the array speaker apparatus 2002, a rear reverberation sound having substantially the same frequency component regardless of the reaching direction is not superimposed on each sound beam, and hence, audio signals of the respective channels are prevented from being similar to one another so as to otherwise combine the sound images. Thus, the localization feeling of each beam is prevented from becoming indistinctive in the array speaker apparatus 2002. Besides, since a sound beam makes the localization perceived by using a sound pressure from a reaching direction, even if an initial reflected sound having a different frequency characteristic depending upon the reaching direction is superimposed and the frequency characteristic is varied, the localization feeling is not varied.

As described so far, in the array speaker apparatus 2002, a sound field effect can be added to the sound of a content by using an initial reflected sound and a rear reverberation sound without impairing the effect of providing the localization of each sound beam and sound for making a virtual sound source perceived.

Besides, since the array speaker apparatus 2002 includes a combination of the gain adjusting portion 2221 and gain adjusting portion 2441, the level ratio between an initial reflected sound and a rear reverberation sound can be changed to a ratio desired by a listener.

Furthermore, in the array speaker apparatus 2002, a sound beam and a sound for making a virtual sound source perceived are output for an audio signal of the multi-channel surround sound, and in addition, the sound field effect is added. Therefore, in the array speaker apparatus 2002, the sound field effect can be added to the sound of a content while providing a localization feeling so as to surround a listener.

Incidentally, although a rear reverberation sound generated by the rear reverberation sound generating portion 2442 is superimposed on a sound for making a virtual sound source perceived and then output from the woofers 2033L and 2033R in the aforementioned example, it may not be superimposed on the sound for making a virtual sound source perceived. For example, an audio signal of a rear reverberation sound generated by the rear reverberation sound generating portion 2442 may be input to the woofers 2033L and 2033R not via the localization adding portion 2042 but via the level adjusting portions 2034L and 2034R.

Figure 32:
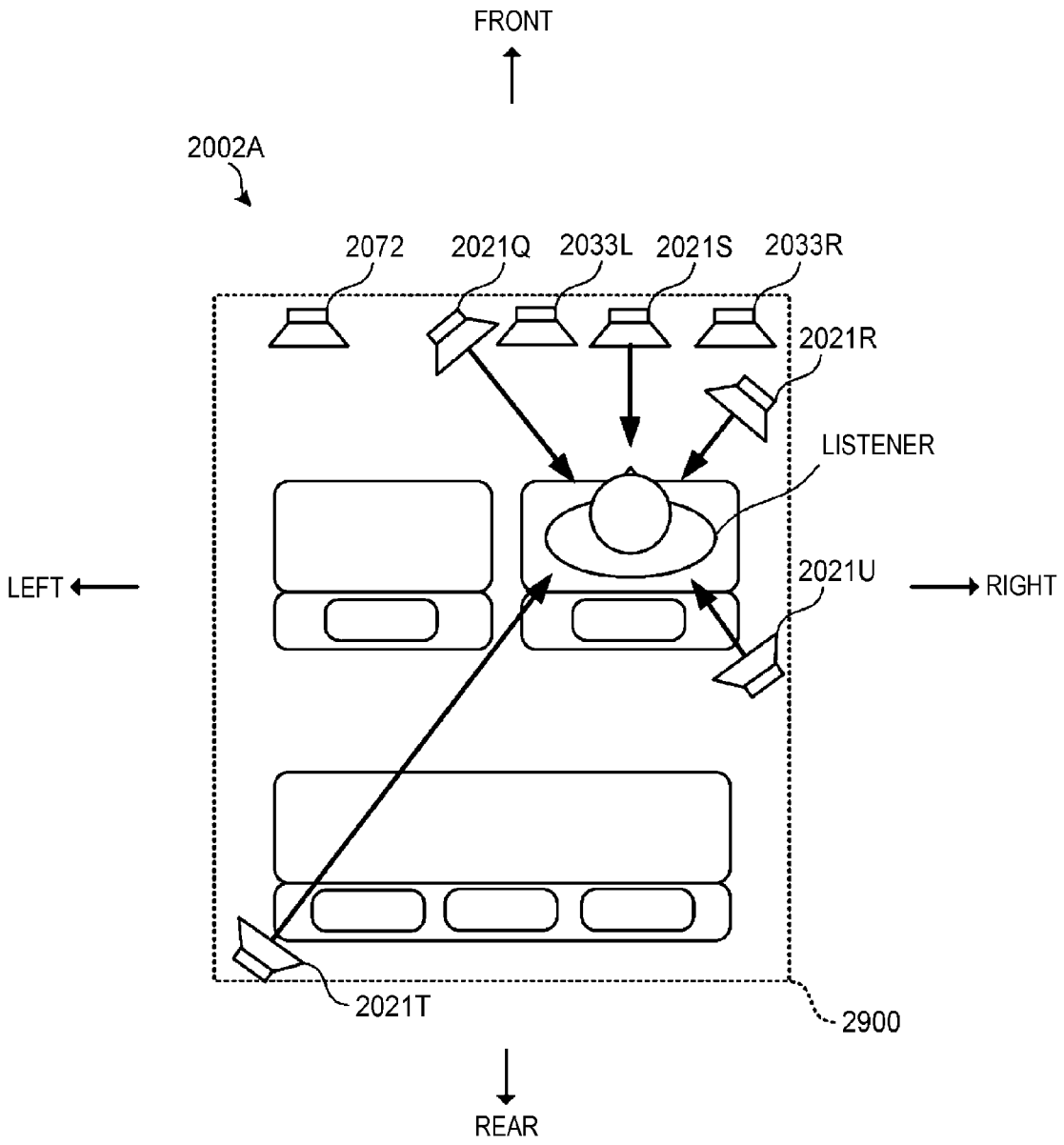
FIG. 32 is a diagram for explaining a speaker set according to a modification of the array speaker apparatus.
Figure 33A:
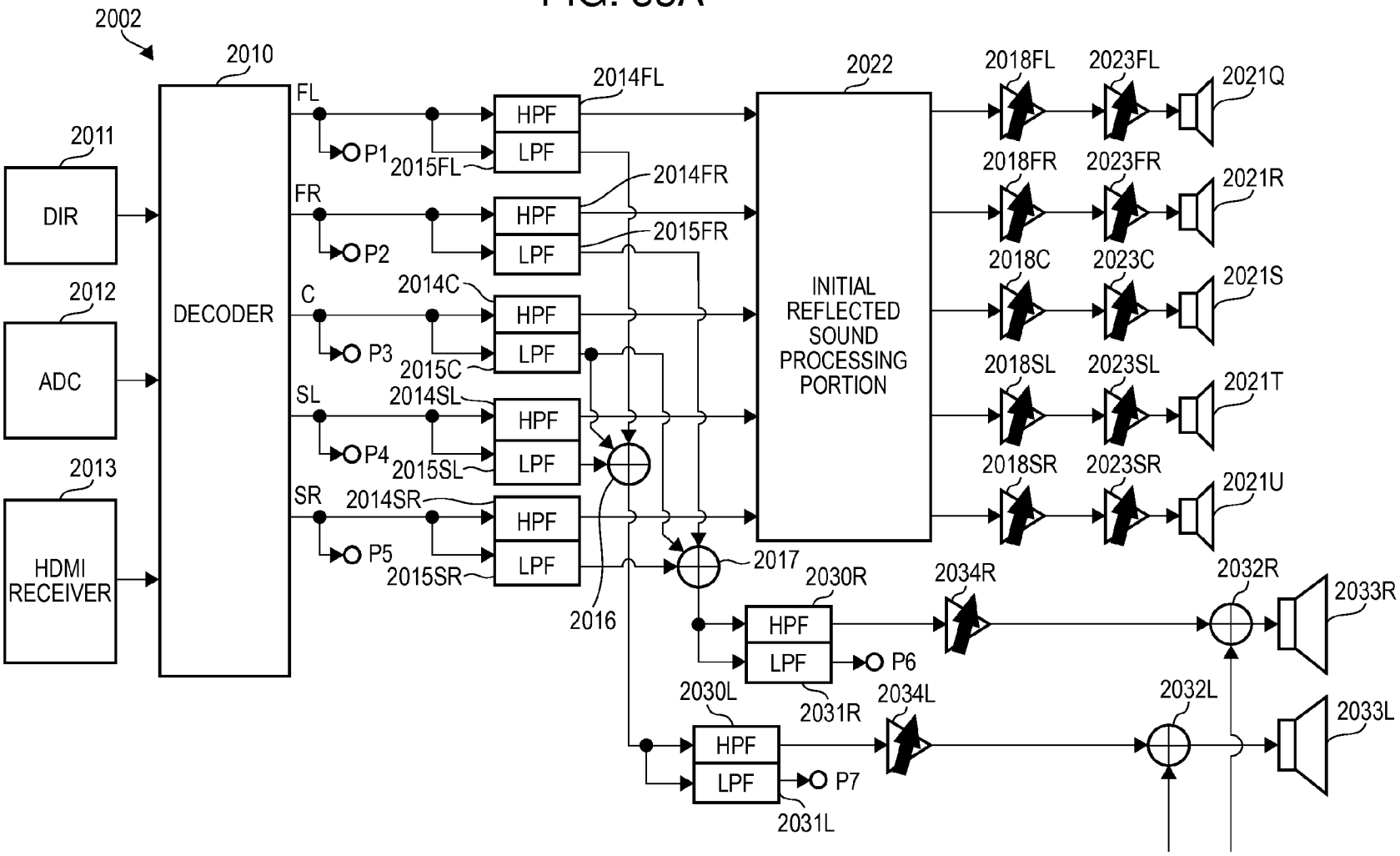
FIGS. 33(A) and 33(B) form together a partial block diagram of the speaker set and a subwoofer.
Figure 33B:
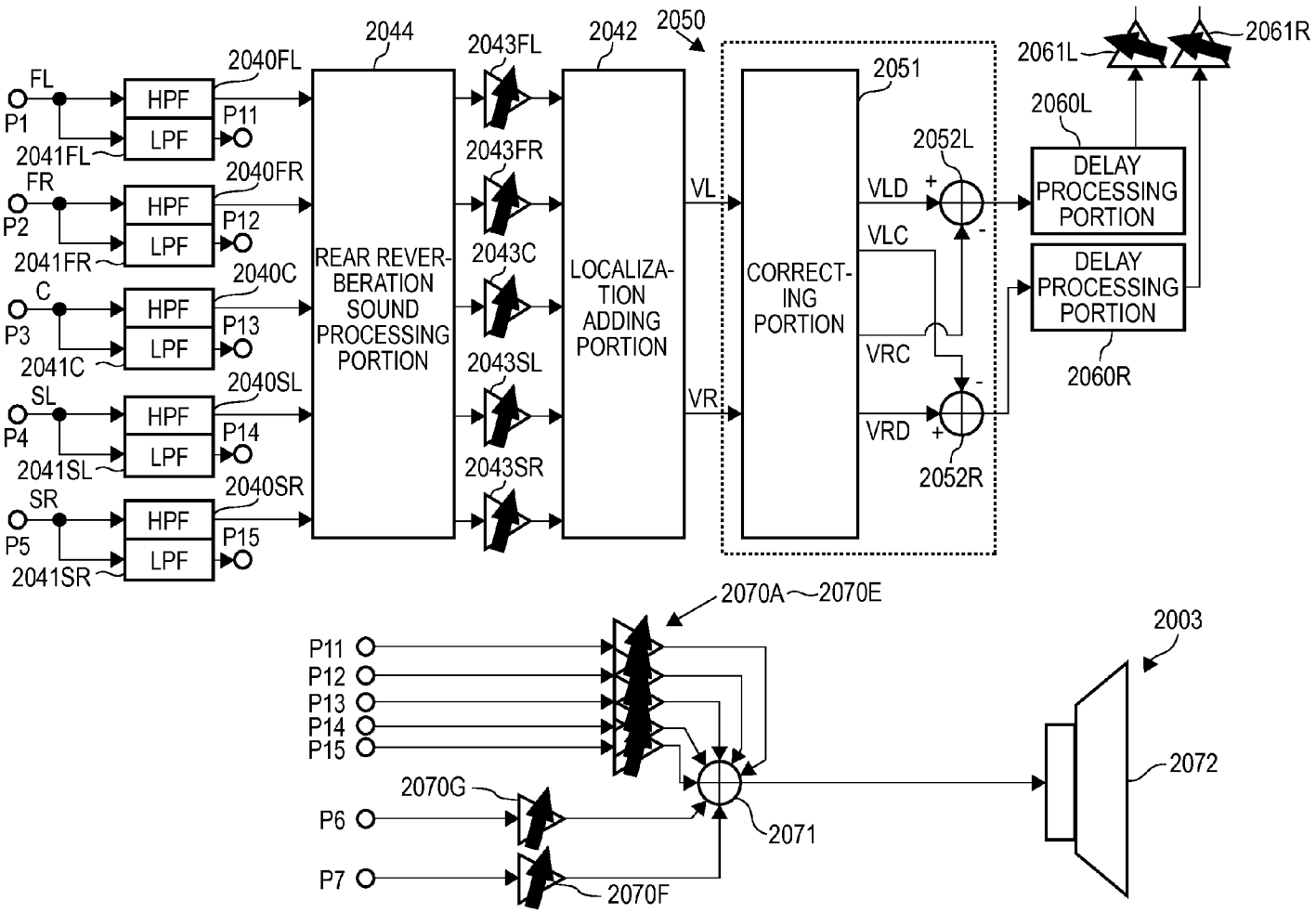

Next, a speaker set 2002A according to a modification of the array speaker apparatus 2002 will be described with reference to drawings. FIG. 32 is a diagram for explaining the speaker set 2002A. FIG. 33 is a partial block diagram of the speaker set 2002A and a subwoofer 2003. In FIG. 32, each arrow indicates a path of a sound having a directivity in a passenger room 900 of a vehicle.

The speaker set 2002A is different from the array speaker apparatus 2002 in that sounds having a directivity are output from directional speaker units 2021 (2021Q, 2021R, 2021S, 2021T and 2021U). The description of the constitution common to the array speaker apparatus 2002 will be herein omitted.

The respective directional speaker units 2021 are arranged in accordance with channels. Specifically, the directional speaker unit 2021S corresponding to the C channel is disposed in front of a listener. The directional speaker unit 2021Q corresponding to the FL channel is disposed on a forward and left side of the listener. The directional speaker unit 2021R corresponding to the FR channel is disposed on a forward and right side of the listener. The directional speaker unit 2021T corresponding to the SL channel is disposed on a backward and left side of the listener. The directional speaker unit 2021U corresponding to the SR channel is disposed on a backward and right side of the listener.

Audio signals respectively output from the level adjusting portions 2018 are input, as illustrated in FIG. 33, to delay processing portions 2023 (2023FL, 2023FR, 2023C, 2023SR and 2023SL). Each of the delay processing portions 2023 performs delay processing in accordance with the length of the path from the corresponding one of the directional speakers 2021 to the listener so that the sounds having a directivity may have the same phase in the vicinity of the listener.

The audio signal output from each of the delay processing portions 2023 is input to the corresponding one of the directional speaker units 2021. Even though the speaker set 2002A has such a configuration, an initial reflected sound can be superimposed on a sound having a directivity corresponding to each channel, so as to allow the resultant sound to reach the listener.

Incidentally, in this modification, the delay times caused by the delay processing portions 2060 and the delay processing portions 2023 are respectively set so that a sound having a directivity and a sound for making a virtual sound source perceived cannot be output at the same timing.

Fourth Embodiment

Figure 34:
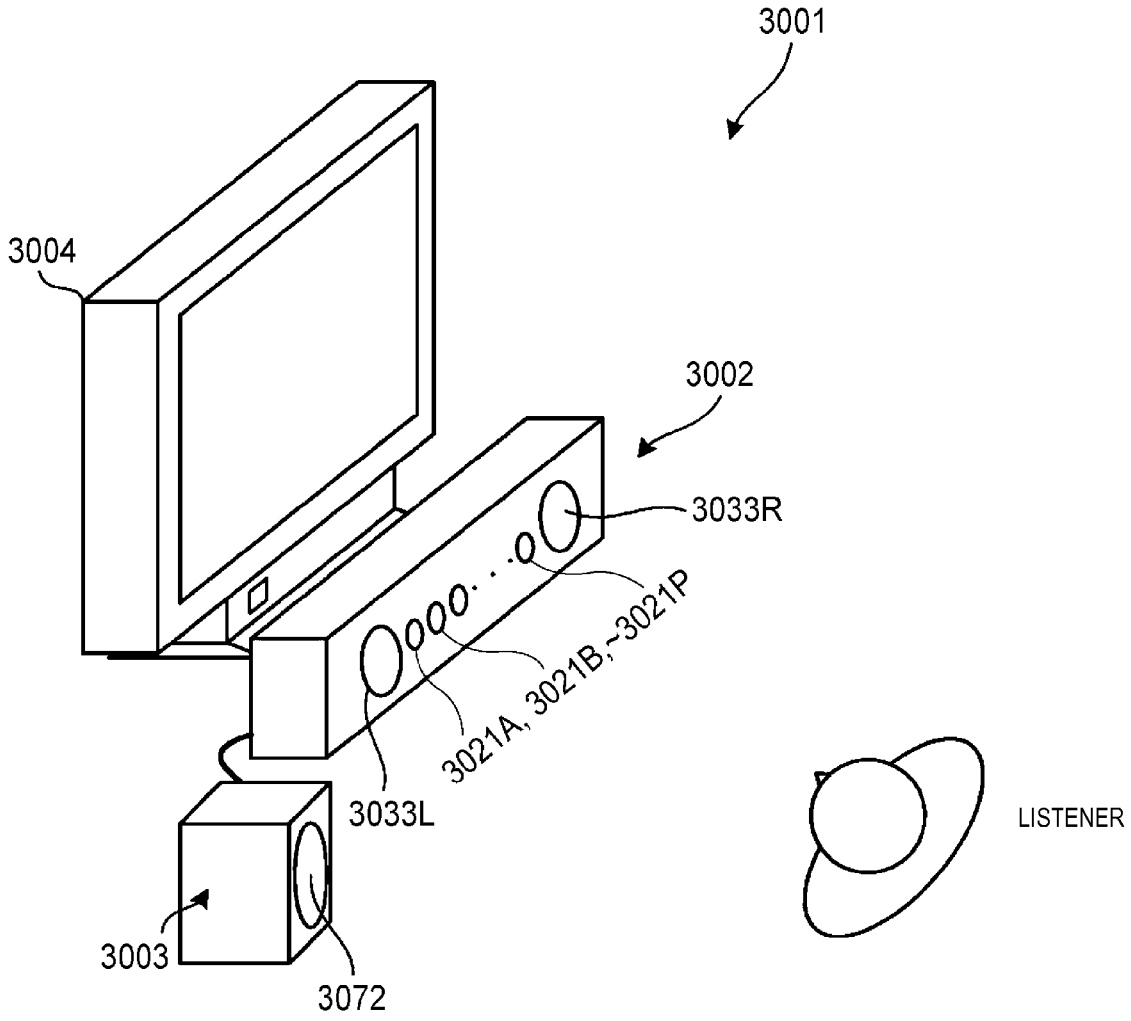
FIG. 34 is a diagram for explaining an AV system including an array speaker apparatus.
Figure 35A:
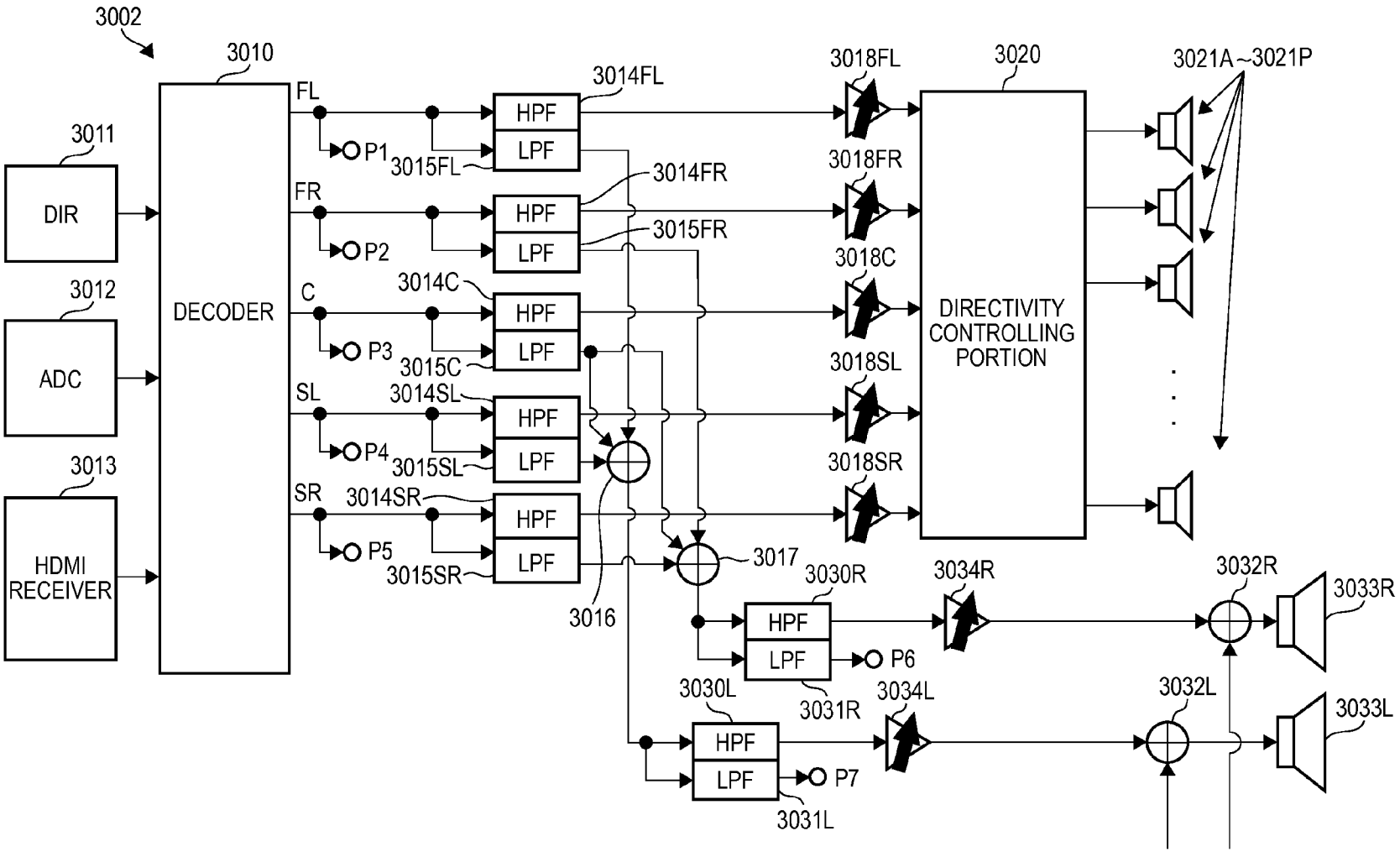
FIGS. 35(A) and 35(B) form together a partial block diagram of the array speaker apparatus and a subwoofer according to an embodiment of the present invention.
Figure 35B:
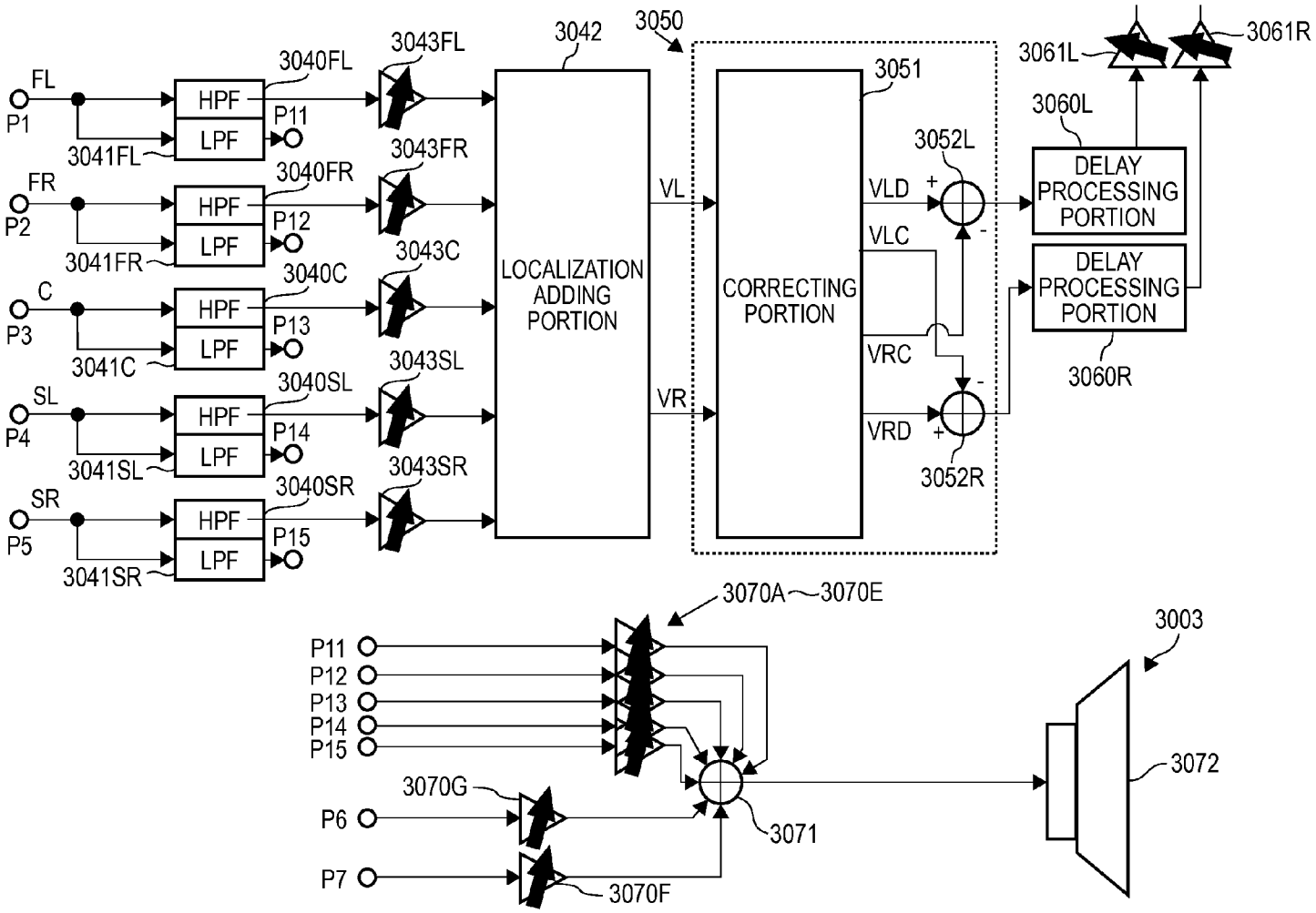
Figure 36A:
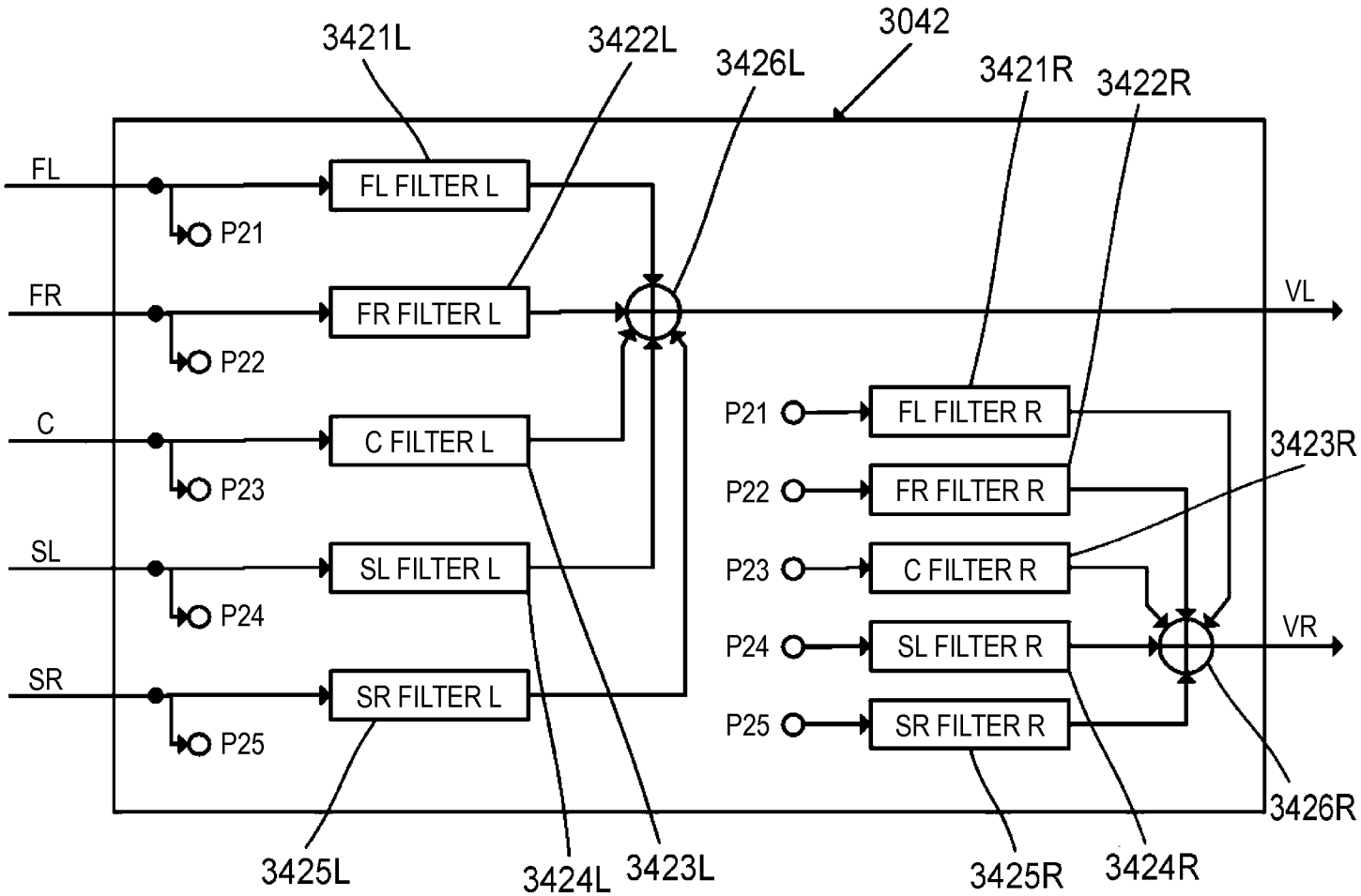
FIGS. 36(A) and 36(B) are block diagrams of a localization adding portion and a correcting portion.
Figure 36B:
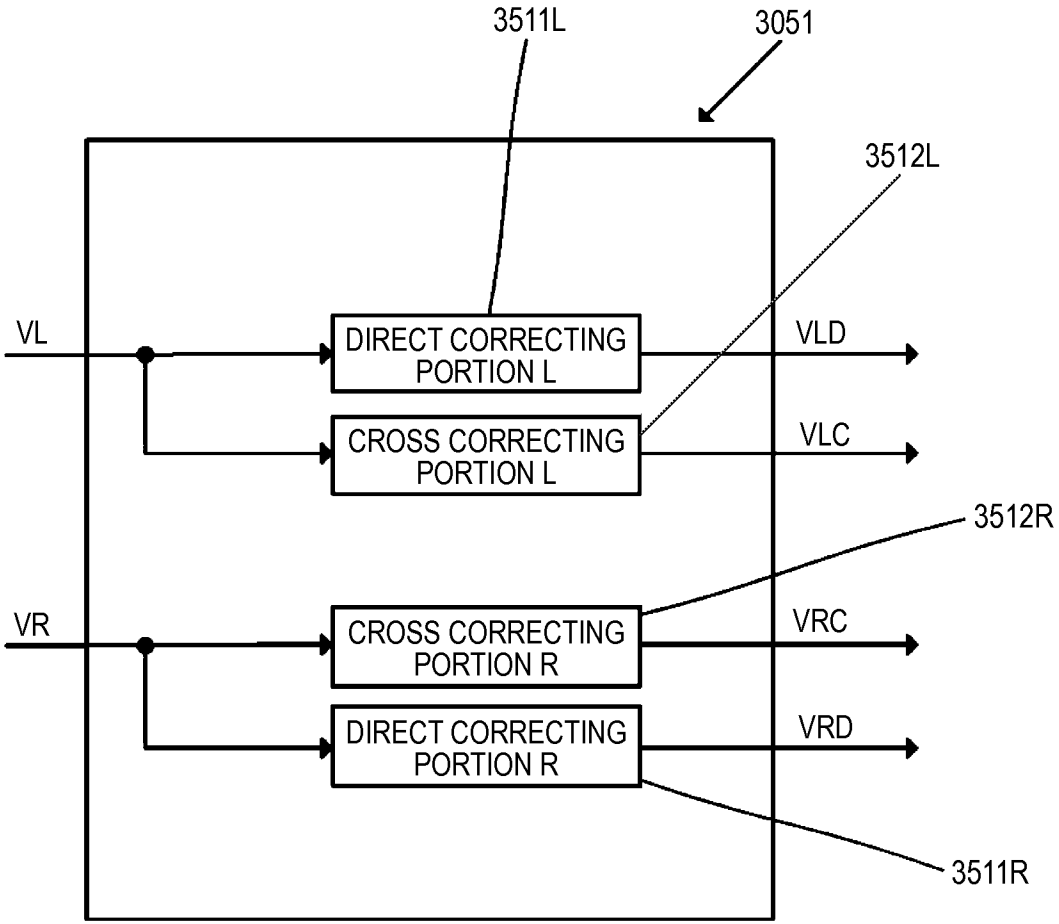
Figure 37:
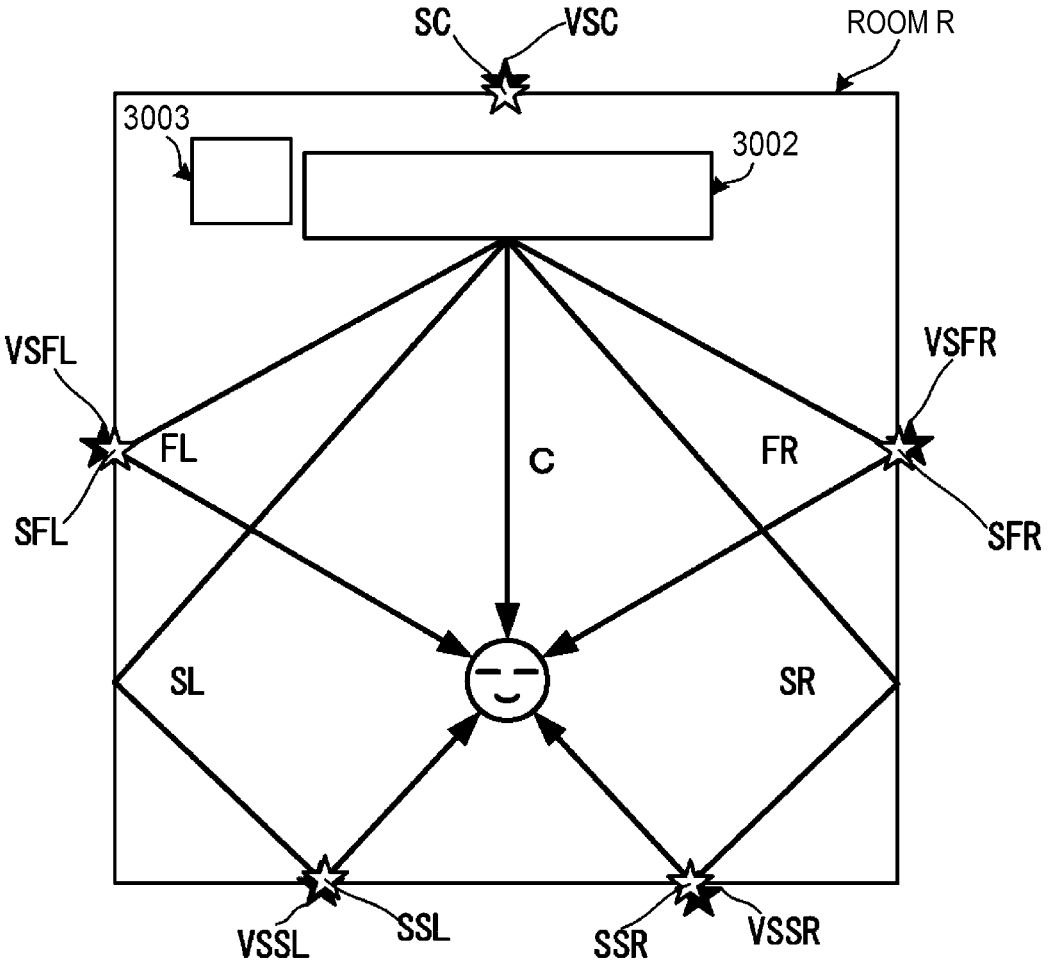
FIG. 37 is a diagram illustrating a path of a sound beam output by the array speaker apparatus and a localization position of a sound source based on the sound beam.
Figure 38:
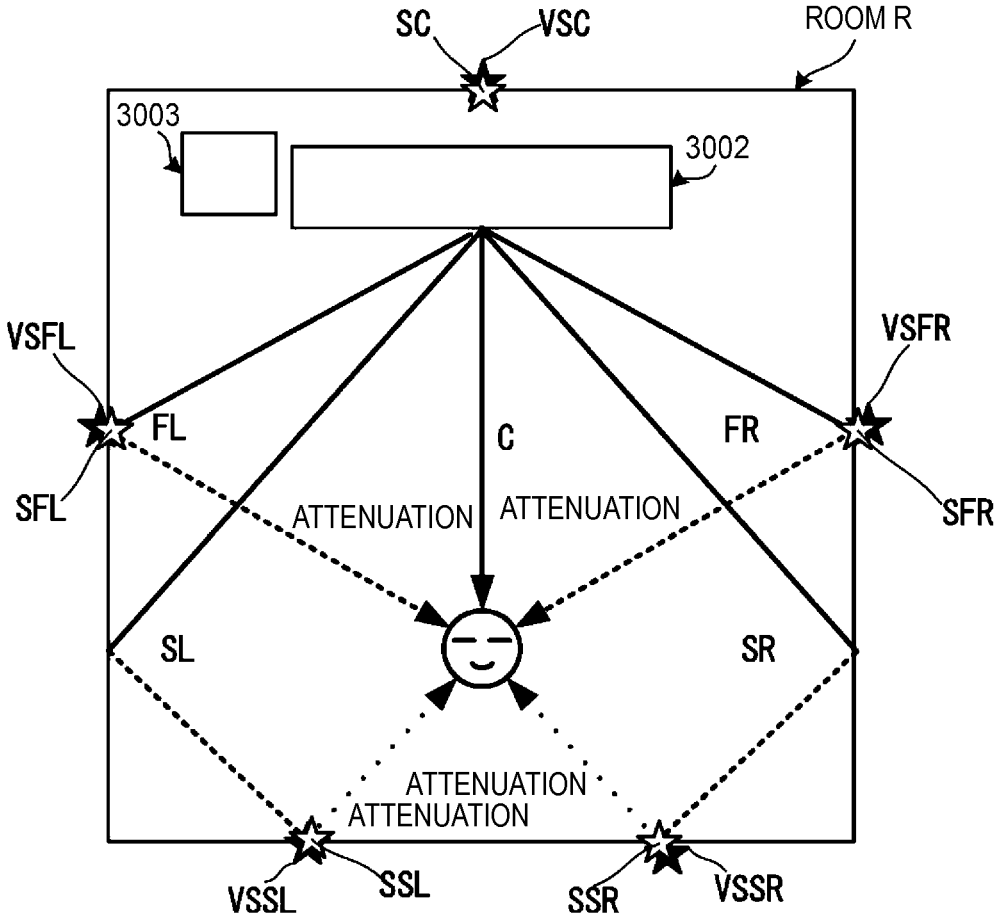
FIG. 38 is another diagram illustrating a path of a sound beam output by the array speaker apparatus and a localization position of a sound source based on the sound beam.
Figure 39:
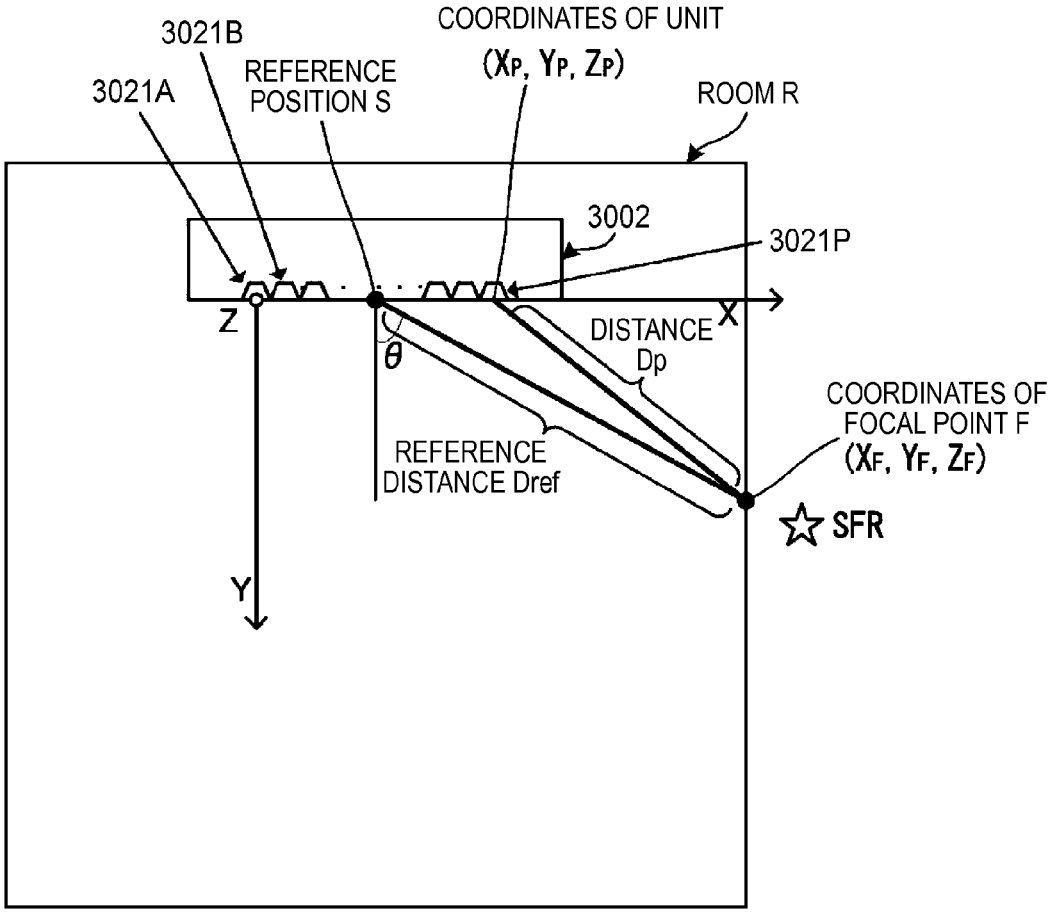
FIG. 39 is a diagram for explaining calculation of a delay amount of an audio signal performed by a directivity controlling portion.

An array speaker apparatus 3002 according to a fourth embodiment will be described with reference to FIGS. 34 to 39. FIG. 34 is a diagram for explaining an AV system 3001 including the array speaker apparatus 3002. FIG. 35 is a partial block diagram of the array speaker apparatus 3002 and a subwoofer 3003. FIG. 36(A) is a block diagram of a localization adding portion 3042 and FIG. 36(B) is a block diagram of a correcting portion 3051. FIG. 37 and FIG. 38 are diagrams respectively illustrating paths of sound beams output by the array speaker apparatus 3002 and localization positions of sound sources based on the sound beams. FIG. 39 is a diagram for explaining calculation of a delay amount of an audio signal performed by a directivity controlling portion 3020.

The AV system 3001 includes the array speaker apparatus 3002, the subwoofer 3003 and a television 3004. The array speaker apparatus 3002 is connected to the subwoofer 3003 and the television 3004. To the array speaker apparatus 3002, audio signals in accordance with images reproduced by the television 3004 and audio signals from a content player not shown are input. The array speaker apparatus 3002 outputs a sound beam on the basis of an audio signal of a content input thereto, and allows a listener to localize a virtual sound source.

First, the output of a sound beam will be described.

The array speaker apparatus 3002 has, as illustrated in FIG. 34, a rectangular parallelepiped housing. The housing of the array speaker apparatus 3002 includes, on a surface thereof opposing a listener, for example, sixteen speaker units 3021A to 3021P, and woofers 3033L and 3033R. It is noted that the number of speaker units is not limited to sixteen but may be, for example, eight or the like. In this example, the speaker units 3021A to 3021P, the woofer 3033L and the woofer 3033R correspond to "a plurality of speakers" of the present invention.

The speaker units 3021A to 3021P are linearly arranged. The speaker units 3021A to 3021P are successively arranged in a left-to-right order when the array speaker apparatus 3002 is seen from a listener. The woofer 3033L is disposed on the further left side of the speaker unit 3021A. The woofer 3033R is disposed on the further right side of the speaker unit 3021P.

The array speaker apparatus 3002 includes, as illustrated in FIG. 35, a decoder 3010 and the directivity controlling portion 3020.

The decoder 3010 is connected to a DIR (Digital audio I/F Receiver) 3011, an ADC (Analog to Digital Converter) 3012, and an HDMI (registered trademark; High Definition Multimedia Interface) receiver 3013.

To the DIR 3011, a digital audio signal transmitted through an optical cable or a coaxial cable is input. The ADC 3012 converts an analog signal input thereto into a digital signal. To the HDMI receiver 3013, an HDMI signal according to the HDMI standard is input.

The decoder 3010 supports various data formats including AAC (registered trademark), Dolby Digital (registered trademark), DTS (registered trademark), MPEG-1/2, MPEG-2 multi-channel and MP3. The decoder 3010 converts digital audio signals output from the DIR 3011 and the ADC 3012 into multi-channel audio signals (digital audio signals of an FL channel, an FR channel, a C channel, an SL channel and an SR channel; it is noted that simple designation of an audio signal used hereinafter refers to a digital audio signal), and outputs the converted signals. The decoder 3010 extracts audio data from the HDMI signal (the signal according to the HDMI standard) output from the HDMI receiver 3013 to decode it into an audio signal, and outputs the decoded signal. It is noted that the decoder 3010 can convert audio data into not only a 5-channel audio signal but also audio signals of various numbers of channels such as a 7-channel audio signal.

The array speaker apparatus 3002 includes HPFs 3014 (3014FL, 3014FR, 3014C, 3014SR and 3014SL) and LPFs 3015 (3015FL, 3015FR, 3015C, 3015SR and 3015SL), so that the band of each audio signal output from the decoder 3010 can be divided for outputting a high frequency component (of, for example, 200 Hz or more) to the speaker units 3021A to 3021P and a low frequency component (of, for example, lower than 200 Hz) to the woofers 3033L and 3033R and a subwoofer unit 3072. The cut-off frequencies of the HPFs 3014 and the LPFs are respectively set in accordance with the lower limit (200 Hz) of the reproduction frequency of the speaker units 3021A to 3021P.

The audio signal of each channel output from the decoder 3010 is input to the corresponding HPF 3014 and LPF 3015. The HPF 3014 extracts a high frequency component (of 200 Hz or more) of the audio signal input thereto and outputs the resultant. The LPF 3015 extracts a low frequency component (lower than 200 Hz) of the audio signal input thereto and outputs the resultant.

The audio signals output from the HPFs 3014 are respectively input to level adjusting portions 3018 (3018FL, 3018FR, 3018C, 3018SR and 3018SL). Each level adjusting portion 3018 is provided for adjusting the level of a sound beam of the corresponding channel. The level adjusting portion 3018 adjusts the level of each audio signal and outputs the resultant.

The directivity controlling portion 3020 receives, as an input, each audio signal output from the level adjusting portions 3018. The directivity controlling portion 3020 distributes the audio signal of each channel input thereto correspondingly to the number of the speaker units 3021A to 3021P, and delays the distributed signals respectively by prescribed delay times. The delayed audio signal of each channel is converted into an analog audio signal by a DAC (Digital to Analog Converter) not shown to be input to the speaker units 3021A to 3021P. The speaker units 3021A to 3021P emit sounds on the basis of the audio signal of each channel input thereto.

If the directivity controlling portion 3020 controls the delays so that a difference in the delay amount between audio signals to be input to adjacent speaker units among from the speaker units 3021A to 3021P can be constant, respective sounds output from the speaker units 3021A to 3021P are mutually strengthened in the phase in directions according to the differences in the delay amount. As a result, sound beams are formed as parallel waves proceeding from the speaker units 3021A to 3021P in prescribed directions.

The directivity controlling portion 3020 can perform delay control for causing the sounds respectively output from the speaker units 3021A to 3021P to have the same phase in a prescribed position. In this case, the sounds respectively output from the speaker units 3021A to 3021P are formed as sound beams focused on the prescribed position.

It is noted that the array speaker apparatus 3002 may include an equalizer for each channel in a stage previous to or following the directivity controlling portion 3020 so as to adjust the frequency characteristic of each audio signal.

The audio signals output from the LPFs 3015 are input to the woofers 3033L and 3033R and the subwoofer unit 3072.

The array speaker apparatus 3002 includes HPFs 3030 (3030L and 3030R) and LPFs 3031 (3031L and 3031R) for further dividing an audio signal other than the band of the sound beam (of lower than 200 Hz) into a band for the woofers 3033L and 3033R (of, for example, 100 Hz or more) and a band for the subwoofer unit 3072 (of, for example, lower than 100 Hz). The cut-off frequencies of the HPFs 3030 and the LPFs 3031 are respectively set according to the upper limit (100 Hz) of the reproduction frequency of the subwoofer unit 3072.

The audio signals (of lower than 200 Hz) output from the LPFs 3015 (3015FL, 3015C and 3015SL) are added up by an adding portion 3016. An audio signal resulting from the addition by the adding portion 3016 is input to the HPF 3030L and the LPF 3031L. The HPF 3030L extracts a high frequency component (of 100 Hz or more) of the audio signal input thereto and outputs the resultant. The LPF 3031L extracts a low frequency component (lower than 100 Hz) of the audio signal input thereto and outputs the resultant. The audio signal output from the HPF 3030L is input to the woofer 3033L via a level adjusting portion 3034L, an adding portion 3032L and a DAC not shown. The audio signal output from the LPF 3031L is input to the subwoofer unit 3072 of the subwoofer 3003 via a level adjusting portion 3070F, an adding portion 3071 and a DAC not shown. The level adjusting portion 3034L and the level adjusting portion 3070F adjust the levels of audio signals input thereto for adjusting a level ratio among a sound beam, a sound output from the woofer 3033L and a sound output from the subwoofer unit 3072, and output the level-adjusted signals.

The audio signals output from the LPFs 3015 (3015FR, 3015C and 3015SR) are added up by an adding portion 3017. An audio signal resulting from the addition by the adding portion 3017 is input to the HPF 3030R and the LPF 3031R. The HPF 3030R extracts a high frequency component (of 100 Hz or more) of the audio signal input thereto and outputs the resultant. The LPF 3031R extracts a low frequency component (lower than 100 Hz) of the audio signal input thereto and outputs the resultant. The audio signal output from the HPF 3030R is input to the woofer 3033R via a level adjusting portion 3034R, an adding portion 3032R and a DAC not shown. The audio signal output from the LPF 3031R is input to the subwoofer unit 3072 via a level adjusting portion 3070G, the adding portion 3071 and a DAC not shown. The level adjusting portion 3034R and the level adjusting portion 3070G adjust the levels of audio signals input thereto for adjusting a level ratio among a sound beam, a sound output from the woofer 3033R and a sound output from the subwoofer unit 3072, and output the level-adjusted signals.

As described so far, the array speaker apparatus 3002 outputs a sound other than the band of a sound beam (of lower than 200 Hz) from the woofers 3033L and 3033R and the subwoofer unit 3072 while outputting, from the speaker units 3021A to 3021P, the sound beam of each channel.

Next, the localization of a virtual sound source will be described.

The array speaker apparatus 3002 includes the localization adding portion 3042, a crosstalk cancellation processing portion 3050 and delay processing portions 3060L and 3060R.

The array speaker apparatus 3002 includes HPFs 3040 (3040FL, 3040FR, 3040C, 3040SR and 3040SL) and LPFs 3041 (3041FL, 3041FR, 3041C, 3041SR and 3041SL) for dividing the band of each audio signal output from the decoder 3010 so as to output a high frequency component (of, for example, 100 Hz or more) to the woofers 3033L and 3033R and a low frequency component (of, for example, lower than 100 Hz) to the subwoofer unit 3072. The cut-off frequencies of the HPFs 3040 and the LPFs 3041 are respectively set according to the upper limit (100 Hz) of the reproduction frequency of the subwoofer unit 3072.

An audio signal of each channel output from the decoder 3010 is input to the corresponding HPF 3040 and LPF 3041. The HPF 3040 extracts a high frequency component (of 100 Hz or more) of the audio signal input thereto and outputs the resultant. The LPF 3041 extracts a low frequency component (lower than 100 Hz) of the audio signal input thereto and outputs the resultant.

The array speaker apparatus 3002 includes level adjusting portions 3070A to 3070E for adjusting a level ratio between a sound output from the woofers 3033L and 3033R and a sound output from the subwoofer unit 3072.

Each audio signal output from the LPF 3041 is adjusted in the level by the corresponding one of the level adjusting portions 3070A to 3070E. Audio signals resulting from the level adjustment by the level adjusting portions 3070A to 3070E are added up by the adding portion 3071. An audio signal resulting from the addition by the adding portion 3071 is input to the subwoofer unit 3072 via a DAC not shown.

The array speaker apparatus 3002 includes a level adjusting portion 3043 (3043FL, 3043FR, 3043C, 3043SR or 3043SL) for adjusting the level of a sound for making a virtual sound source perceived of each channel.

Each audio signal output from the HPF 3040 is input to the corresponding level adjusting portion 3043. The level adjusting portion 3043 adjusts the level of the audio signal input thereto and outputs the resultant.

Each audio signal output from the level adjusting portions 3043 is input to the localization adding portion 3042. The localization adding portion 3042 performs processing for localizing each audio signal input thereto in a virtual sound source position. In order to localize an audio signal in a virtual sound source position, a head-related transfer function (hereinafter referred to as the HRTF) corresponding to a transfer function between a prescribed position and an ear of a listener is employed.

An HRTF corresponds to an impulse response expressing the loudness, the reaching time, the frequency characteristic and the like of a sound emitted from a virtual speaker placed in a given position to right and left ears. When the HRTF is applied to an audio signal to emit a sound from the woofer 3033L (or the woofer 3033R), a listener perceives as if the sound was emitted from the virtual speaker.

The localization adding portion 3042 includes, as illustrated in FIG. 36(A), filters 3421L to 3425L and filters 3421R to 3425R for convolving an impulse response of an HRTF for each of the channels.

An audio signal of the FL channel (an audio signal output from the HPF 3040FL) is input to the filters 3421L and 3421R. The filter 3421L applies, to the audio signal of the FL channel, an HRTF corresponding to a path from the position of a virtual sound source VSFL (see FIG. 37) disposed on a left forward side of a listener to his/her left ear. The filter 3421R applies, to the audio signal of the FL channel, an HRTF corresponding to a path from the position of the virtual sound source VSFL to the listener's right ear.

The filter 3422L applies, to an audio signal of the FR channel, an HRTF corresponding to a path from the position of a virtual sound source VSFR disposed on a right forward side of the listener to his/her left ear. The filter 3422R applies, to the audio signal of the FR channel, an HRTF corresponding to a path from the position of the virtual sound source VSFR to the listener's right ear.

Each of the filters 3423L to 3425L applies, to an audio signal of the C channel, the SL channel or the SR channel, an HRTF corresponding to a path from the position of a virtual sound source VSC, VSSL or VSSR corresponding to the C, SL or SR channel to the listener's left ear. Each of the filters 3423R to 3425R applies, to the audio signal of the C channel, the SL channel or the SR channel, an HRTF corresponding to a path from the position of the virtual sound source VSC, VSSL or VSSR corresponding to the C, SL or SR channel to the listener's right ear.

Then, an adding portion 3426L synthesizes audio signals output from the filters 3421L to 3425L for outputting the resultant as an audio signal VL to the crosstalk cancellation processing portion 3050. An adding portion 3426R synthesizes audio signals output from the filters 3421R to 3425R for outputting the resultant as an audio signal VR to the crosstalk cancellation processing portion 3050.

The crosstalk cancellation processing portion 3050 inhibits the sound of the woofer 3033L from being heard by the right ear by emitting, from the woofer 3033R, a reverse phase component of crosstalk emitted from the woofer 3033L to reach the right ear for cancelling the sound pressure in the position of the right ear. On the contrary, the crosstalk cancellation processing portion 3050 inhibits the sound of the woofer 3033R from being heard by the left ear by emitting, from the woofer 3033L, a reverse phase component of crosstalk emitted from the woofer 3033R to reach the left ear for cancelling the sound pressure in the position of the left ear.

More specifically, the crosstalk cancellation processing portion 3050 performs the processing by using the correcting portion 3051 and synthesizing portions 3052L and 3052R.

The correcting portion 3051 includes, as illustrated in FIG. 36(B), direct correcting portions 3511L and 3511R and cross correcting portions 3512L and 3512R. The audio signal VL is input to the direct correcting portion 3511L and the cross correcting portion 3512L. The audio signal VR is input to the direct correcting portion 3511R and the cross correcting portion 3512R.

The direct correcting portion 3511L performs processing for causing a listener to perceive as if a sound output from the woofer 3033L was emitted in the vicinity of his/her left ear. The direct correcting portion 3511L has a filter coefficient set for making the sound output from the woofer 3033L sound flat in the position of the left ear. The direct correcting portion 3511L corrects the audio signal VL input thereto to output an audio signal VLD.

The cross correcting portion 3512R, in combination with the synthesizing portion 3052L, outputs, from the woofer 3033L, a reverse phase sound of a sound routing around from the woofer 3033R to the left ear for canceling the sound pressure in the position of the left ear, so as to inhibit the sound from the woofer 3033R from being heard by the left ear. Besides, the cross correcting portion 3512R performs processing for causing a listener to perceive as if a sound output from the woofer 3033L was emitted in the vicinity of his/her left ear. The cross correcting portion 3512R has a filter coefficient set for making the sound output from the woofer 3033R not heard in the position of the left ear. The cross correcting portion 3512R corrects the audio signal VR input thereto to output an audio signal VRC.

The synthesizing portion 3052L reverses the phase of the audio signal VRC and synthesizes the reverse signal with the audio signal VLD.

The direct correcting portion 3511R performs processing for causing a listener to perceive as if a sound output from the woofer 3033R was emitted in the vicinity of his/her right ear. The direct correcting portion 3511R has a filter coefficient set for making the sound output from the woofer 3033R sound flat in the position of the right ear. The direct correcting portion 3511R corrects the audio signal VR input thereto to output an audio signal VRD.

The cross correcting portion 3512L, in combination with the synthesizing portion 3052R, outputs, from the woofer 3033R, a reverse phase sound of a sound routing around from the woofer 3033L to the right ear for canceling the sound pressure in the position of the right ear, so as to inhibit the sound from the woofer 3033L from being heard by the right ear. Besides, the cross correcting portion 3512L performs processing for causing a listener to perceive as if a sound output from the woofer 3033R was emitted in the vicinity of his/her right ear. The cross correcting portion 3512L has a filter coefficient set for making the sound output from the woofer 3033L not heard in the position of the right ear. The cross correcting portion 3512L corrects the audio signal VL input thereto to output an audio signal VLC.

The synthesizing portion 3052R reverses the phase of the audio signal VLC and synthesizes the reverse signal with the audio signal VRD.

An audio signal output from the synthesizing portion 3052L is input to the delay processing portion 3060L. The audio signal is delayed by the delay processing portion 3060L by a prescribed time and the delayed signal is input to a level adjusting portion 3061L. An audio signal output from the synthesizing portion 3052R is input to the delay processing portion 2060R. The delay processing portion 3060R delays the audio signal by the same delay time as the delay processing portion 3060L.

The delay time caused by the delay processing portions 3060L and 3060R is set to be longer than the longest delay time among from the delay times to be given to audio signals to be used for forming sound beams. This delay time will be described in detail later.

The level adjusting portions 3061L and 3061R are provided for adjusting the levels of the sounds for making virtual sound sources perceived of all the channels all at once. The level adjusting portions 3061L and 3061R adjust the levels of the respective audio signals having been delayed by the delay processing portions 3060L and 3060R. The respective audio signals having been adjusted in the level by the level adjusting portions 3061L and 3061R are input to the woofers 3033L and 3033R via the adding portions 3032L and 3032R.

Since an audio signal out of the band of the sound beam (of lower than 200 Hz) to be output from the speaker units 3021A to 3021P is input to the adding portions 3032L and 3032R, a sound out of the band of the sound beam and a sound for localizing a virtual sound source are output from the woofers 3033L and 3033R.

In this manner, the array speaker apparatus 3002 localizes an audio signal of each channel in a virtual sound source position.

Next, a sound field generated by the array speaker apparatus 3002 will be described with reference to FIG. 37. In FIG. 37, each white arrow indicates the path of a sound beam output from the array speaker apparatus 3002. In FIG. 31, a star indicates the position of each sound source generated by a sound beam or the position of each virtual sound source.

The array speaker apparatus 3002 outputs, as illustrated in FIG. 37, five sound beams in accordance with the number of channels of audio signals input thereto. An audio signal of the C channel is controlled to be delayed, for example, to have a focus position set on a wall disposed in front of a listener. Thus, the listener perceives that a sound source SC of the audio signal of the C channel is disposed on the wall in front of him/her.

Audio signals of the FL and FR channels are controlled to be delayed, for example, so that sound beams can be focused respectively on walls on the left forward side and the right forward side of the listener. The sound beams based on the audio signals of the FL and FR channels reach the position of the listener after being reflected once on the walls of the room R. Thus, the listener perceives that sound sources SFL and SFR of the audio signals of the FL and FR channels are disposed on the walls on the left forward side and the right forward side of the listener.

Audio signals of the SL and SR channels are controlled to be delayed, for example, so that sound beams can be directed respectively toward walls on the left side and the right side of the listener. The sound beams based on the audio signals of the SL and SR channels reach walls on the left backward side and the right backward side of the listener after being reflected on the walls of the room R. The respective sound beams are respectively reflected again on the walls on the left backward side and the right backward side of the listener to reach the position of the listener. Thus, the listener perceives that sound sources VSSL and VSSR of the audio signals of the SL and SR channels are disposed on the walls on the left backward side and the right backward side of the listener.

The filters 3421L to 3425L and the filters 3421R to 3425R of the localization adding portion 3042 are respectively set so that the positions of virtual speakers can be respectively substantially the same as the positions of the sound sources SFL, SFR, SC, SSL and SSR. Thus, the listener perceives the virtual sound sources VSC, VSFL, VSFR, VSSL and VSSR in substantially the same positions as the sound sources SFL, SFR, SC, SSL and SSR as illustrated in FIG. 37.

A sound beam may be diffused when reflected on some types of walls. The array speaker apparatus 3002 can, however, compensate a localization feeling based on a sound beam by using a virtual sound source. Accordingly, in the array speaker apparatus 3002, the localization feeling is improved as compared with the case where a sound beam alone is used or a virtual sound source alone is used.

As described above, each of the sound sources SSL and SSR of the audio signals of the SL and SR channels is generated by the sound beam reflected twice on the walls. Accordingly, the sound sources of the SL and SR channels are more difficult to perceive than the sound sources of the FL, C and FR channels. In the array speaker apparatus 3002, however, the localization feeling of the SL and SR channels based on the sound beams can be compensated by the virtual sound sources VSSL and VSSR generated on the basis of the sounds directly reaching the ears of a listener, and hence, the localization feeling of the SL and SR channels is not impaired.

Besides, even if a sound beam is difficult to be reflected because of high sound absorbency of the walls of the room R as illustrated in FIG. 38, the array speaker apparatus 3002 can provide the localization feeling to a listener because a virtual sound source is perceived by using a sound directly reaching the listener's ear.

Furthermore, under an environment where a sound beam is easily reflected, the array speaker apparatus 3002 decreases the gain used in the level adjusting portions 3061L and 3061R or increases the gain used in the level adjusting portions 3018, so as to increase the level of a sound beam as compared with the level of a sound for making a virtual sound source perceived. On the other hand, under an environment where a sound beam is difficult to be reflected, the array speaker apparatus 3002 increases the gain used in the level adjusting portions 3061L and 3061R or decreases the gain used in the level adjusting portions 3018, so as to lower the level of a sound beam as compared with the level of a sound for making a virtual sound source perceived. In this manner, the array speaker apparatus 3002 can adjust a ratio between the level of a sound beam and the level of a sound for making a virtual sound source perceived in accordance with the environment. Needless to say, the array speaker apparatus 3002 may simultaneously change the levels of both a sound beam and a sound for making a virtual sound source perceived instead of changing the level of one of a sound beam and a sound for making a virtual sound source perceived.

Besides, the array speaker apparatus 3002 includes, as described above, the level adjusting portions 3018 for adjusting the levels of sound beams of the respective channels and the level adjusting portions 3043 for adjusting the levels of sounds for making virtual sound sources perceived of the respective channels. Since the array speaker apparatus 3002 is provided with a combination of the level adjusting portion 3018 and the level adjusting portion for each channel, a ratio between the level of a sound beam and the level of a sound for making a virtual sound source perceived can be changed for, for example, the FL channel alone. Therefore, even under an environment where the sound source SFL is difficult to localize by a sound beam, the array speaker apparatus 3002 can provide a localization feeling by increasing the sound for making the virtual sound source VSFL perceived.

The formation of a sound beam may be, however, impeded by a sound for making a virtual sound source perceived in some cases. Therefore, the delay processing portions 3060L and 3060R delay a sound for making a virtual sound source perceived so that the sound for making a virtual sound source perceived cannot impede the formation of a sound beam.

Next, the time for delaying each audio signal by the delay processing portions 3060L and 3060R will be described with reference to FIG. 39.

The time for delaying an audio signal by the delay processing portions 3060L and 3060R (hereinafter referred to as the delay time DT) is calculated on the basis of a time for delaying an audio signal by the directivity controlling portion 3020. The calculation of the delay time DT is performed by the directivity controlling portion 3020, but in one aspect, it may be calculated by another functional portion.

The delay time DT is calculated as follows. In the example illustrated in FIG. 39, a sound beam for generating the sound source SFR will be used for the explanation.

First, the directivity controlling portion 3020 calculates a distance DP from the speaker unit 3021P to a focal point F of the sound beam. The distance DP is calculated in accordance with a trigonometric function. Specifically, it is obtained in accordance with the following expression:

$$DP=\mathrm{Sqrt}((XF-XP)^2+(YF-YP)^2+(ZF-ZP)^2)$$

In the expression, Sqrt represents a function for obtaining a square root, and coordinates (XF, YF, ZF) correspond to a position of the focal point F. Coordinates (XP, YP, ZP) correspond to the position of the speaker unit 3021P and is precedently set in the array speaker apparatus 3002. The coordinates (XF, YF, ZF) are set, for example, by using a user interface provided in the array speaker apparatus 3002.

After calculating the distance DP, the directivity controlling portion 3020 obtains a differential distance DDP from a reference distance Dref in accordance with the following expression:

$$DDP=DP-Dref$$

It is noted that the reference distance Dref corresponds to a distance from a reference position S of the array speaker apparatus 3002 to the focal point F. The coordinates of the reference position S are precedently set in the array speaker apparatus 3002.

Then, with respect to the other speaker units 3021A to 30210, the directivity controlling portion 3020 calculates differential distances DDA to DDO. In other words, the directivity controlling portion 3020 calculates the differential distances DDA to DDP of all the speaker units 3021A to 3021P.

Next, the directivity controlling portion 3020 selects a maximum differential distance DDMAX and a minimum differential distance DDMIN from the differential distances DDA to DDP. A delay time T corresponding to a distance difference DDDIF between the differential distance DDMAX and the differential distance DDMIN is calculated by dividing the distance difference DDDIF by the speed of sound.

In this manner, the delay time T for the sound beam used for generating the sound source SFR is calculated.

Here, a sound beam having the largest output angle is formed by using a sound output the latest among all the sound beams. It is noted that the output angle of a sound beam is defined, in the example illustrated in FIG. 39, as an angle θ between the X-axis and a line connecting the reference position S and the focal point F. Therefore, the directivity controlling portion 3020 specifies a sound beam having the largest output angle and obtains a delay time T corresponding to this sound beam (hereinafter referred to as the delay time TMAX).

The directivity controlling portion 3020 sets the delay time DT to be longer than the delay time TMAX and gives the delay time thus set to the delay processing portions 3060L and 3060R. Thus, a sound for making a virtual sound source perceived is output later than a sound for forming each sound beam. Specifically, the woofers 3033L and 3033R do not output a sound as a part of a speaker array including the speaker units 3021A to 3021P. As a result, a sound for making a virtual sound source perceived is difficult to impede the formation of a sound beam. The array speaker apparatus 3002 can improve the localization feeling without impairing the localization feeling of a sound source based on a sound beam.

It is noted that the delay processing portions 3060L and 3060R may be provided in a stage previous to the localization adding portion 3042 or between the localization adding portion 3042 and the crosstalk cancellation processing portion 3050.

In another aspect, the directivity controlling portion 3020 may give, to the delay processing portions 3060L and 3060R, the number of samples to be delayed instead of the delay time DT. In this case, the number of samples to be delayed is calculated by multiplying the delay time DT by a sampling frequency.

Figure 40A:
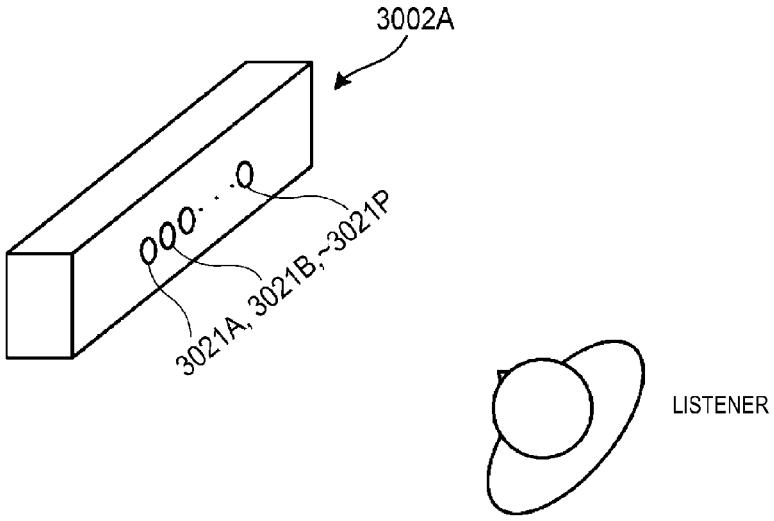
FIGS. 40(A) and 40(B) are diagrams of an array speaker apparatus and a speaker set according to a modification of the array speaker apparatus.
Figure 40B:
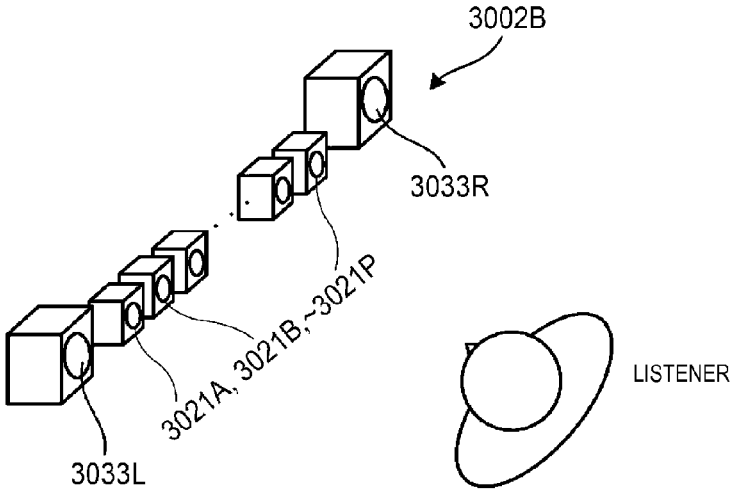

Next, FIG. 40(A) is a diagram illustrating an array speaker apparatus 3002A according to Modification 1 of the array speaker apparatus 3002 of the present embodiment. FIG. 40(B) is a diagram illustrating an array speaker apparatus 3002B according to Modification 2 of the array speaker apparatus 3002. The description of the constitution common to the array speaker apparatus 3002 will be herein omitted.

The array speaker apparatus 3002A is different from the array speaker apparatus 3002 in that sounds output from the woofer 3033L and the woofer 3033R are respectively output from the speaker unit 3021A and the speaker unit 3021P.

Specifically, the array speaker apparatus 3002A outputs a sound for making a virtual sound source perceived and a sound out of the band of a sound beam (100 Hz or more and lower than 200 Hz) from the speaker unit 3021A and the speaker unit 3021P, which are disposed at both ends of the speaker units 3021A to 3021P.

The speaker units 3021A and the speaker unit 3021P are speaker units disposed to be farthest from each other among the speaker units 3021A to 3021P. Accordingly, the array speaker apparatus 3002A can make a virtual sound source perceived.

Besides, there is no need for the array speaker apparatus 3002 to include all of the speaker units 3021A to 3021P, the woofer 3033L and the woofer 3033R in one housing.

For example, in one aspect, respective speaker units may be provided with individual housings so as to arrange the housings as an array speaker apparatus 3002B illustrated in FIG. 40(B).

No matter which of the aspects is employed, as long as input audio signals of a plurality of channels having been respectively delayed are distributed to a plurality of speakers and any of the input audio signals of the plurality of channels is subjected to the filtering processing based on a head-related transfer function before inputting it to the plurality of speakers, it is included in the technical scope of the present invention.

Figure 41A:
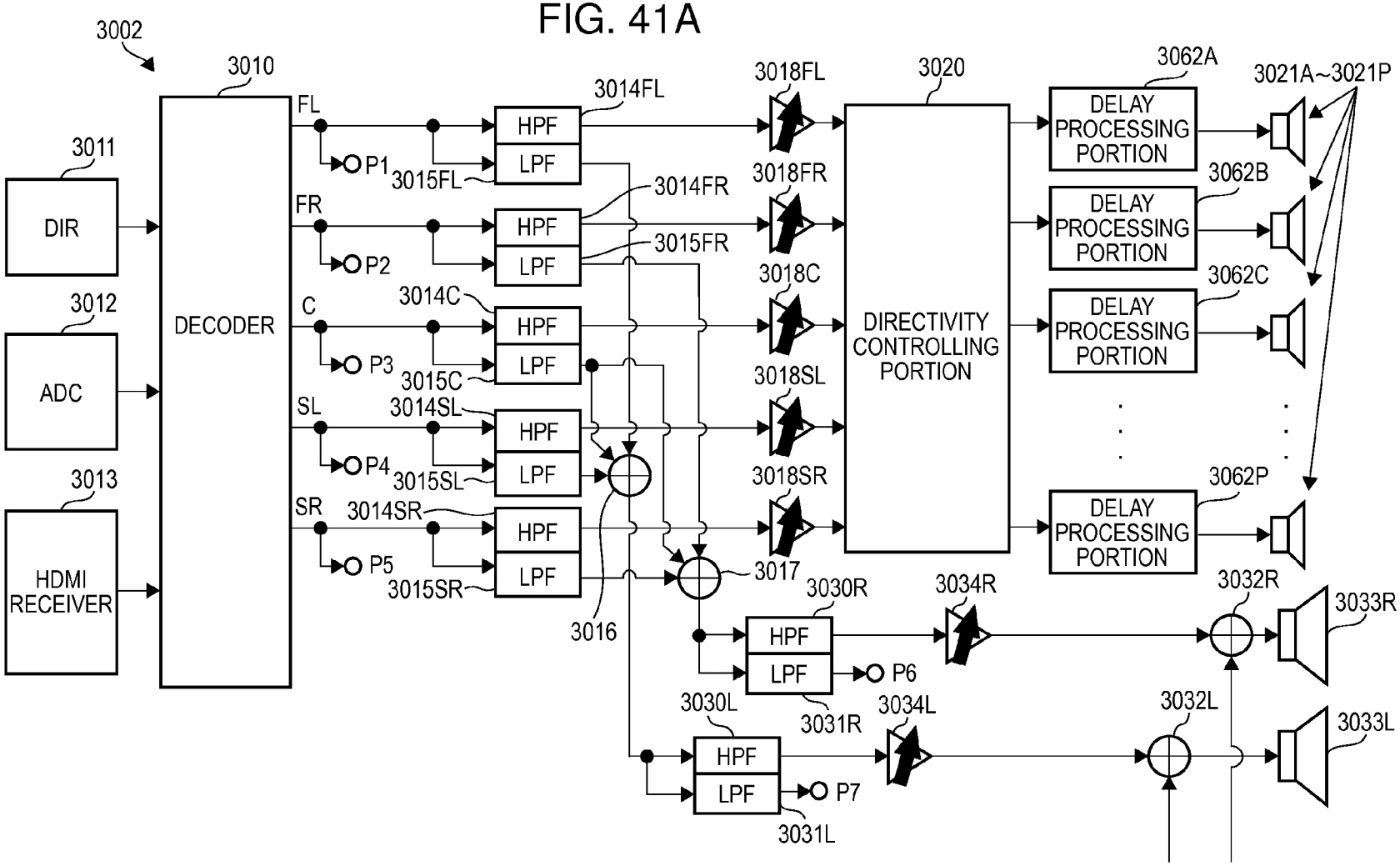
FIGS. 41(A) and 41(B) form together a block diagram illustrating the configuration of the array speaker apparatus according to the modification.
Figure 41B:
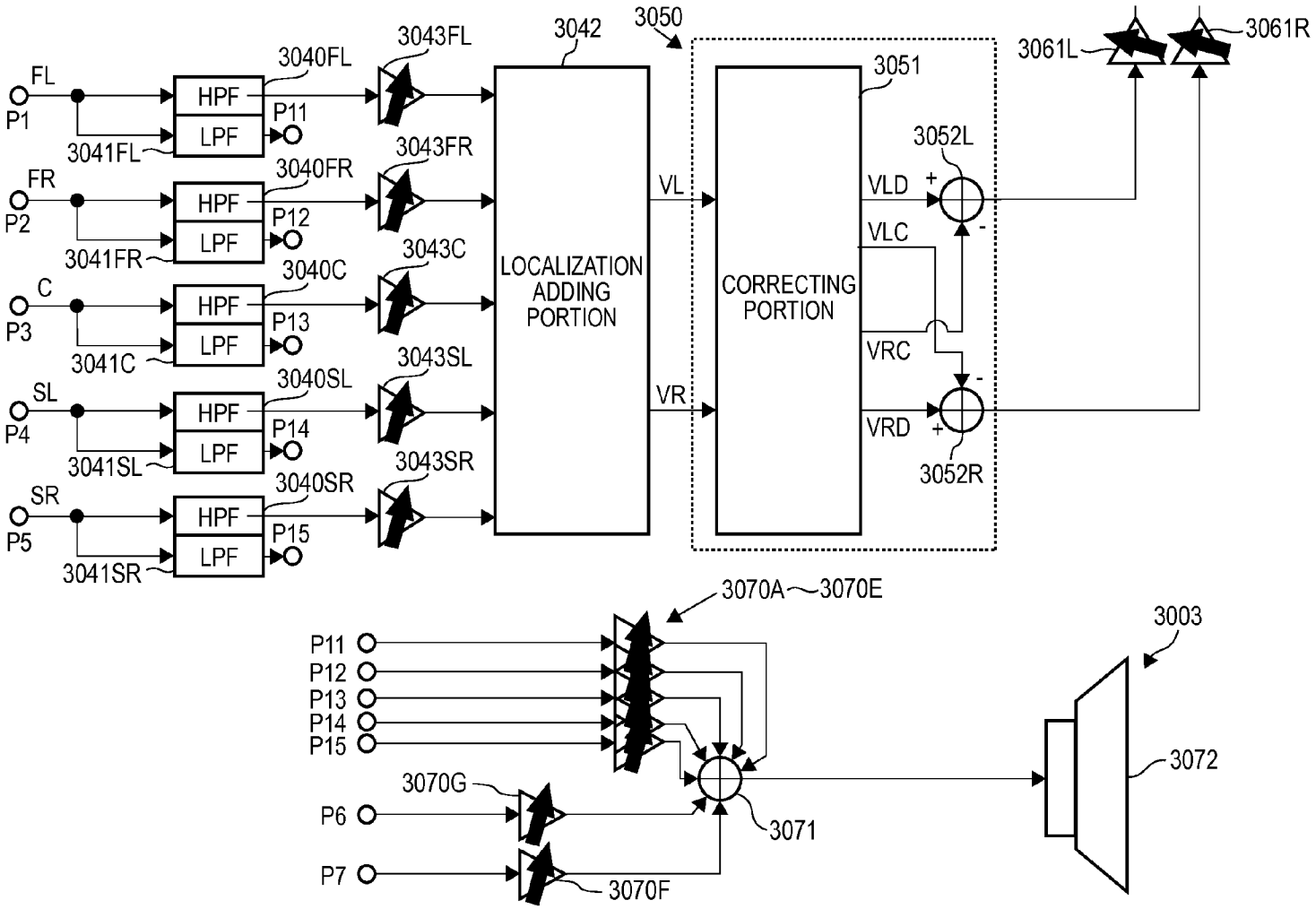

Next, FIG. 41 is a block diagram illustrating the configuration of an array speaker apparatus 3002C according to another modification. Like reference numerals are used to refer to the constitution common to the array speaker apparatus 3002 to omit the description.

The array speaker apparatus 3002C is different from the array speaker apparatus 3002 in that delay processing portions 3062A to 3062P are provided in a stage following the directivity controlling portion 3020 instead of the delay processing portions 3060L and 3060R.

The delay processing portions 3062A to 3062P respectively delay audio signals to be supplied to the speaker units 3021A to 3021P. Specifically, the delay processing portions 3062A to 3062P delay the audio signals so that the audio signals to be input to the speaker units 3021A to 3021P from the directivity controlling portion 3020 can be delayed from the audio signals to be input to the woofers 3033L and 3033R from the localization adding portion 3042.

The array speaker apparatus 3002 employs the aspect where a sound for making a virtual sound source perceived is delayed by the delay processing portions 3060L and 3060R so as not to impede the formation of a sound beam by the sound for making a virtual sound source perceived, but the array speaker apparatus 3002C employs an aspect where the delay processing portions 3062A to 3062P delay a sound for forming a sound beam so as not to impede a sound for making a virtual sound source perceived by the sound for forming the sound beam. For example, under an environment where a listening position is away from a wall, under an environment where a wall is made of a material with a low acoustic reflectivity, or if the number of speakers is small, reflection of a sound beam on the wall is so weak that the localization feeling based on the sound beam is weak in some cases. In such a case, a sound for forming a sound beam may impede a sound for making a virtual sound source perceived. Accordingly, in the array speaker apparatus 3002C, a sound for forming a sound beam is delayed, so as not to impede a sound for making a virtual sound source perceived, and is reproduced to be delayed from the sound for making a virtual sound source perceived.

Incidentally, although the delay processing portions 3062A to 3062P are provided in a stage following the directivity controlling portion 3020 in the example of FIG. 41, delay processing portions for respectively delaying audio signals of the respective channels may be provided in a stage previous to the directivity controlling portion 3020 in one aspect.

In an alternative aspect, an array speaker apparatus may include the delay processing portions 3060L and 3060R and the delay processing portions 3062A to 3062P. In this case, it may be selected, depending on a listening environment, whether a sound for making a virtual sound source perceived is to be delayed or a sound for forming a sound beam is to be delayed. If, for example, the reflection of a sound beam on a wall is weak, a sound for forming a sound beam is delayed, and if the reflection of a sound beam on the wall is strong, a sound for making a virtual sound source perceived is delayed.

Incidentally, the intensity of the reflection on a wall can be measured by using a microphone installed in a listening position with a sound beam of a test sound such as white noise turned around. When the sound beam of the test sound is turned around, the sound beam of the test sound is reflected on a wall of the room to be picked up at a prescribed angle by the microphone. The array speaker apparatus can measure the intensity of the reflection of the sound beam on the wall by detecting the level of the sound beam of the test sound thus picked up. If the level of the sound beam thus picked up exceeds a prescribed threshold value, the array speaker apparatus determines that the reflection of the sound beam is strong, and delays a sound for making a virtual sound source perceived. On the other hand, if the level of the sound beam thus picked up is lower than the prescribed threshold value, the array speaker apparatus determines that the reflection of the sound beam on the wall is weak, and delays a sound for forming a sound beam.

The outline of the present invention is summarized as follows:

A speaker apparatus of the present invention includes: an input portion to which audio signals of a plurality of channels are input; a plurality of speakers; a directivity controlling portion causing the plurality of speakers to output a plurality of sound beams by delaying the audio signals of the plurality of channels having been input to the input portion and distributing the delayed audio signals to the plurality of speakers; a localization adding portion subjecting any of the audio signals of the plurality of channels having been input to the input portion to filtering processing based on a head-related transfer function and inputting the processed audio signal to the plurality of speakers; a first level adjusting portion adjusting levels of audio signals of the respective channels in the localization adding portion and the audio signals of the sound beams of the respective channels; and a setting portion for setting the levels in the first level adjusting portion.

In this manner, the speaker apparatus of the present invention employs an aspect where a localization feeling based on a sound beam is compensated by a virtual sound source. Therefore, the localization feeling can be improved as compared with the case where a sound beam alone is used or a virtual sound source alone is used. Then, the speaker apparatus of the present invention detects a difference in the level among the sound beams of the respective channels reaching a listening position, and adjusts the levels of the respective channels in the localization adding portion and of the sound beams of the respective channels on the basis of the detected level difference. With respect to, for example, a channel in which the level of a sound beam is lowered because of the influence of a wall with a low acoustic reflectivity or the like, the level of the localization adding portion is set to be higher than in the other channels, so as to enhance the effect of localization addition based on a virtual sound source. Besides, in the speaker apparatus of the present invention, also with respect to a channel in which the effect of the localization addition based on a virtual sound source is set to be strong, there presents a localization feeling based on a sound beam, and hence, audibility connection among the channels can be retained without causing an uncomfortable feeling due to a virtual sound source generated for merely a specific channel.

Furthermore, for example, the speaker apparatus of the present invention further includes: a microphone installed in a listening position; and a detection portion for detecting a level of the sound beam of each channel reaching the listening position, the detection portion inputs a test signal to the directivity controlling portion to cause the plurality of speakers to output a test sound beam, and measures a level of the test sound beam input to the microphone, and the setting portion sets a level ratio in the first level adjusting portion on the basis of a measurement result obtained by the detection portion.

In this case, merely by performing the measurement with the microphone installed in the listening position, the levels of the respective channels in the localization adding portion and of the sound beams of the respective channels are automatically adjusted together with output angles of the sound beams of the respective channels.

For example, the speaker apparatus of the present invention further includes a comparison portion for comparing the levels of the audio signals of the plurality of channels having been input to the input portion, and the setting portion sets the levels in the level adjusting portion on the basis of a comparison result obtained by the comparison portion.

For example, if a high-level signal is input merely for a specific channel, it is presumed that a creator of the content has an intention of providing this channel with a localization feeling, and therefore, this specific channel is preferably provided with a distinctive localization feeling. Accordingly, for the channel in which the high-level signal is input, the level in the localization adding portion is set to be higher than that for the other channels to enhance the effect of the localization addition based on a virtual sound source, and thus, a sound image is distinctively localized.

For example, the comparison portion compares the levels of the audio signal of a front channel and the audio signal of a surround channel, and the setting portion sets the levels in the first level adjusting portion on the basis of a comparison result obtained by the comparison portion.

For the surround channel, it is necessary to cause a sound beam to reach the listening position from behind the listening position, and the sound beam need to be reflected twice on walls. Therefore, a distinctive localization feeling may not be obtained for the surround channel as compared with the front channel in some cases. Accordingly, for example, if the level of the surround channel is relatively high, the level in the localization adding portion is set to be high to enhance the effect of the localization addition based on a virtual sound source for retaining the localization feeling of the surround channel, and if the level of the front channel is relatively high, the localization feeling based on a sound beam is set to be strong. On the other hand, in the case where the level of the surround channel is relatively low, if the level ratio in the localization adding portion is low, it may be difficult to hear the surround channel in some cases, and therefore, in one aspect, if the level of the surround channel is relatively low, the level ratio in the localization adding portion may be set to be high, and if the level of the surround channel is relatively high, the level ratio in the localization adding portion may be set to be low.

In another aspect, the comparison portion may divide the audio signals of the plurality of channels having been input to the input portion into prescribed bands for comparing levels of the signals of each of the divided bands.

In still another aspect, the speaker apparatus of the present invention includes a volume setting accepting portion accepting setting of volumes of the plurality of speakers, and the setting portion sets the levels in the level adjusting portion on the basis of the setting of the volumes.

In particular, if the volume setting of the plurality of speakers (master volume setting) is low, the level of a sound reflected on a wall may be lowered to spoil the depth of the sound, the connection among the channels may be lost, and the surround feeling may be degraded. Therefore, as the master volume setting is lower, the levels in the localization adding portion are preferably set to be higher for enhancing the effect of the localization addition based on a virtual sound source, so as to retain the connection among the channels and retain the surround feeling.

A speaker apparatus of the present invention includes: an input portion to which audio signals of a plurality of channels are input; a plurality of speakers; a directivity controlling portion causing the plurality of speakers to output sound beams by delaying the audio signals of the plurality of channels having been input to the input portion and distributing the delayed audio signals to the plurality of speakers; and a localization adding portion subjecting each of the audio signals of the plurality of channels having been input to the input portion to filtering processing based on a head-related transfer function and inputting the processed audio signals to the plurality of speakers.

The localization adding portion of the speaker apparatus sets a direction of a virtual sound source based on the head-related transfer function to a direction, when seen from a listening position, between reaching directions of the plurality of sound beams. Specifically, the direction of the virtual sound source based on the head-related transfer function is set to the direction between a plurality of beams like a phantom sound source.

In this manner, the speaker apparatus of the present invention can distinctively localize a sound source in an intended direction by using a virtual sound source based on a head-related transfer function not depending on a listening environment such as an acoustic reflectivity of a wall while employing a localization feeling based on a sound beam.

Incidentally, the direction of the virtual sound source based on the head-related transfer function is set, for example, in the same direction as a phantom sound source generated by a plurality of beams. Thus, the localization feeling based on the phantom sound source generated by the sound beams can be compensated to more distinctively localize the sound source.

In another aspect, the direction of a virtual sound source based on a head-related transfer function may be set to a direction bilaterally symmetrical to a reaching direction of at least one of the sound beams with respect to a center axis corresponding to the listening position. In this case, the sound source is localized in a direction bilaterally symmetrical when seen from the listening position.

Furthermore, the speaker apparatus of the present invention may further include: a microphone installed in the listening position; a detection portion that inputs a test signal to the directivity controlling portion to cause the plurality of speakers to output a test sound beam, and measures a level of the test sound beam input to the microphone; and a beam angle setting portion for setting an output angle of the sound beam on the basis of a peak of the level measured by the detection portion. In this case, the localization adding portion sets the direction of the virtual sound source based on the head-related transfer function on the basis of the peak of the level measured by the detection portion. Thus, the output angles of the sound beams of the respective channels as well as the direction of the virtual sound source can be automatically set merely by performing the measurement with the microphone installed in the listening position.

A speaker apparatus of the present invention includes: an input portion to which an audio signal is input; a first sound emitting portion emitting a sound on the basis of the input audio signal; a second sound emitting portion emitting a sound on the basis of the input audio signal; a localization adding portion subjecting the audio signal having been input to the input portion to filtering processing based on a head-related transfer function and inputting the processed signal to the first sound emitting portion; an initial reflected sound adding portion adding a characteristic of an initial reflected sound to an audio signal input thereto; and a rear reverberation sound adding portion adding a characteristic of a rear reverberation sound to an audio signal input thereto.

The localization adding portion receives, as an input, an audio signal output from the rear reverberation sound adding portion, and the directivity controlling portion receives, as an input, an audio signal output from the initial reflected sound adding portion.

The initial reflected sound adding portion adds the characteristic of the initial reflected sound not to a sound for making a virtual sound source perceived but to a sound output from the second sound emitting portion alone. Accordingly, the speaker apparatus prevents the frequency characteristic of the sound for making a virtual sound source perceived from changing due to the addition of the characteristic of the initial reflected sound having a different frequency characteristic depending on a reaching direction. As a result, the sound for making a virtual sound source perceived retains the frequency characteristic of the head-related transfer function.

In this manner, even if a sound field effect based on an initial reflected sound and a rear reverberation sound is added, a localization feeling based on a sound for making a virtual sound source perceived is not impaired in the speaker apparatus of the present invention.

Besides, the speaker apparatus may include a level adjusting portion adjusting levels of the initial reflected sound of the initial reflected sound adding portion and the rear reverberation sound of the rear reverberation sound adding portion.

Thus, the level of the initial reflected sound and the level of the rear reverberation sound can be set to a ratio desired by a listener.

Besides, the audio signal may be an audio signal of a multi-channel surround sound.

Thus, the speaker apparatus can add the sound field effect while virtually localizing the audio signal so as to surround the listener.

Furthermore, the first sound emitting portion may output a sound having a directivity. For example, the speaker apparatus may output a sound beam as the sound having a directivity by employing the following constitution. In one aspect, the first sound emitting portion may include a stereo speaker to which the audio signal of the localization adding portion is input, and the second sound emitting portion may include a speaker array and a directivity controlling portion delaying the audio signal having been input to the input portion and distributing the delayed audio signal to the speaker array.

In this aspect, a sound beam is output as follows as the sound having a directivity. The speaker array including a plurality of speaker units emit sounds on the basis of the audio signals delayed and distributed by the directivity controlling portion. The directivity controlling portion controls the delays of the audio signals so that the sounds output from the plurality of speaker units have the same phase in a prescribed position. As a result, the sounds respectively output from the plurality of speaker units are mutually strengthened in the prescribed position to form a sound beam having a directivity.

The localization adding portion performs filtering processing for localizing a virtual sound source in or in the vicinity of a position where a listener perceives a sound source based on the sound having a directivity. As a result, the speaker apparatus improves the localization feeling as compared with the case where a sound having a directivity alone is used or the case where a virtual sound source alone is used.

The rear reverberation sound adding portion adds the characteristic of the rear reverberation sound not to the sound having a directivity but merely to the sound for making the virtual sound source perceived emitted from the first sound emitting portion. Accordingly, the speaker apparatus does not add the characteristic of the rear reverberation sound to the sound having a directivity, and hence prevents the localization of the sound having a directivity from becoming indistinctive because the sound is drawn toward the center of the reverberation.

A speaker apparatus of the present invention includes: an input portion to which audio signals are input; a plurality of speakers; a directivity controlling portion for delaying the audio signals having been input to the input portion and distributing the delayed audio signals to the plurality of speakers; and a localization adding portion subjecting the audio signals having been input to the input portion to filtering processing based on a head-related transfer function and inputting the processed signals to the plurality of speakers.

The plurality of speakers emit sounds on the basis of the audio signals delayed and distributed by the directivity controlling portion. The directivity controlling portion controls the delays of the audio signals so that the sounds output from the plurality of speakers may have the same phase in a prescribed position. As a result, the sounds respectively output from the plurality of speakers are mutually strengthened in the prescribed position to form a sound beam having a directivity. A listener perceives a sound source when he/she hears the sound beam.

The localization adding portion performs filtering processing for localizing a virtual sound source in or in the vicinity of a position where the listener perceives the sound source based on the sound beam. As a result, the speaker apparatus can improve the localization feeling as compared with the case where a sound beam alone is used or the case where a virtual sound source alone is used.

The speaker apparatus of the present invention can improve the localization feeling by adding the localization feeling based on a virtual sound source without impairing the localization feeling of a sound source based on a sound beam.

Besides, the speaker apparatus of the present invention includes a delay processing portion delaying and outputting the audio signals in a stage previous to or following the localization adding portion or the directivity controlling portion.

If a sound for making a virtual sound source perceived and a sound for forming a sound beam are simultaneously output, the sound for forming a sound beam may be shifted in the phase by the sound for making a virtual sound source perceived in some cases. In other words, if the sound for making a virtual sound source perceived is output simultaneously with the sound for forming a sound beam, the formation of the sound beam may be impeded by the sound for making a virtual sound source perceived in some cases. Therefore, in the speaker apparatus of the present invention, the sound for making a virtual sound source perceived is output later than the sound for forming a sound beam. As a result, the sound for making a virtual sound source perceived is difficult to impede the formation of a sound beam. In particular, in a preferred aspect, the delay processing portion is provided in a stage previous to or following the localization adding portion for delaying the audio signals with a delay amount larger than a largest delay amount delayed by the directivity controlling portion and outputting the delayed audio signals.

On the other hand, under an environment where a listening position is away from a wall, under an environment where a wall is made of a material with a low acoustic reflectivity, or if the number of speakers is small, reflection of a sound beam on the wall is so weak that the localization feeling based on a sound beam is weak in some cases. In such a case, the sound for forming a sound beam may impede the sound for making a virtual sound source perceived. In this case, in a preferable aspect, the delay processing portion may be provided in a stage previous to or following the directivity controlling portion for delaying the audio signals and outputting the delayed audio signals so that the audio signals input from the directivity controlling portion to the plurality of speakers may be delayed from audio signals input from the localization adding portion to the plurality of speakers. Thus, the sound for forming a sound beam is delayed so as not to impede the sound for making a virtual sound source perceived for reproducing the sound for forming a sound beam later than the sound for making a virtual sound source perceived.

Furthermore, the speaker apparatus may include a level adjusting portion adjusting levels of the audio signals of the directivity controlling portion and the audio signals of the localization adding portion.

A virtual sound source is perceived by a sound directly reaching a listener, and hence little depends on the environment. On the other hand, a sound beam is formed by using reflection on a wall, and hence depends on the environment, but can provide a localization feeling more than the virtual sound source. In this constitution, the localization feeling can be provided, without depending on the environment, by adjusting a ratio of the level of a sound beam and the level of a sound for making a virtual sound source perceived. For example, if the speaker apparatus is installed in an environment where a sound beam is difficult to reflect, the level of a sound for making a virtual sound source perceived can be increased. Alternatively, if the speaker apparatus is installed in an environment where a sound beam is easily reflected, the level of a sound beam can be increased.

Besides, the audio signals may be audio signals of the multi-channel surround sound.

A sound beam of some channel is perceived by a listener by using the reflection on a wall, and its sound image may be blurred through the reflection in some cases. In particular, a sound beam of an audio signal of a rear channel utilizes the reflection on a wall twice, and therefore, it is difficult to localize as compared with that of a front channel. In the speaker apparatus, however, a virtual sound source is also perceived by using a sound directly reaching a listener, and hence, the localization feeling of the rear channel can be provided to the same extent as that of the front channel.

In another aspect, the plurality of speakers may include a speaker array to which the audio signals of the directivity controlling portion are input, and a stereo speaker to which the audio signals of the localization adding portion are input, a band dividing portion dividing the band of each audio signal having been input to the input portion into a high frequency component and a low frequency component and outputting the resultant components may be provided, the directivity controlling portion may receive, as an input, an audio signal of the high frequency component output from the band dividing portion, and the stereo speaker may receive, as an input, an audio signal of the low frequency component output from the band dividing portion.

In this aspect, the stereo speaker is used both for outputting a sound for making a virtual sound source perceived and outputting a sound of a low frequency component lower than the band of the sound beam. In other words, the low frequency component for which a sound beam is difficult to form is compensated by the stereo speaker.

An audio signal processing apparatus of the present invention includes: an input step of inputting audio signals of a plurality of channels; a directivity controlling step of causing a plurality of speakers to output a plurality of sound beams by delaying the audio signals of the plurality of channels having been input in the input step and distributing the delayed audio signals to the plurality of speakers; and a localization adding step of subjecting at least one of the audio signals of the plurality of channels having been input in the input step to filtering processing based on a head-related transfer function and inputting the processed signal to the plurality of speakers.

For example, it further includes a first level adjusting step of adjusting levels of the audio signals of the respective channels having been subjected to the filtering processing in the localization adding step and the audio signals of the sound beams of the respective channels; and a setting step of setting levels in the first level adjusting step.

For example, the audio signal processing method further includes a detection step of detecting the level of a sound beam of each channel reaching a listening position by a microphone installed in the listening position, and in the detection step, the level at which a test sound beam output from the plurality of speakers on the basis of an input test signal is input to the microphone is measured, and in the setting step, the levels in the first level adjusting step are set on the basis of a measurement result obtained in the detection step.

For example, the audio signal processing method further includes a comparison step of comparing levels of the audio signals of the plurality of channels having been input in the input step, and in the setting step, the levels in the level adjusting step are set on the basis of a comparison result obtained in the comparison step.

In the audio signal processing method, for example, in the comparison step, the level of an audio signal of a front channel is compared with the level of an audio signal of a surround channel, and in the setting step, the levels in the first level adjusting step are set on the basis of a comparison result obtained in the comparison step.

In the audio signal processing method, for example, in the comparison step, the audio signals of the plurality of channels having been input in the input step are divided into prescribed bands, and the levels of the signals of each of the divided bands are compared.

For example, the audio signal processing method further includes a volume setting accepting step of accepting volume setting of the plurality of speakers, and in the setting step, the levels in the first level adjusting step are set on the basis of the volume setting.

In the audio signal processing method, for example, in the localization adding step, a direction of a virtual sound source based on the head-related transfer function is set in the middle, when seen from the listening position, between reaching directions of the plurality of sound beams.

For example, the audio signal processing method further includes a phantom processing step of localizing a phantom sound source by outputting an audio signal of one channel as a plurality of sound beams, and in the localization adding step, the direction of the virtual sound source based on the head-related transfer function is set in a direction corresponding to a localization direction of the phantom sound source.

For example, the audio signal processing method further includes an initial reflected sound adding step of adding a characteristic of an initial reflected sound to an input audio signal; and a rear reverberation sound adding step of adding a characteristic of a rear reverberation sound to an input audio signal, and in the localization adding step, the audio signal having been processed in the rear reverberation sound adding step is processed, and in the directivity controlling step, the audio signal having been processed in the initial reflected sound adding step is processed.

For example, the audio signal processing method further includes a second level adjusting step of adjusting levels of the initial reflected sound processed in the initial reflected sound adding step and the rear reverberation sound processed in the rear reverberation sound adding step.

For example, in the audio signal processing method, a part of the plurality of speakers corresponds to a stereo speaker to which the audio signals having been processed in the localization adding step are input, and the other of the plurality of speakers corresponds to a speaker array to which the audio signals having been processed in the directivity controlling step are input.

For example, the audio signal processing method further includes, before or after the processing performed in the localization adding step or the directivity controlling step, a delay processing step of delaying the audio signals and outputting the delayed signals.

For example, the delay processing step is provided before or after the processing of the localization adding step, and in the delay processing step, the audio signals are delayed by a larger delay amount than a maximum delay amount delayed in the directivity controlling step and the delayed signals are output.

In the audio signal processing method, for example, the delay processing step is provided before or after the processing of the directivity controlling step, and in the delay processing step, the audio signals are delayed and the delayed signals are output so that the audio signals of the plurality of channels having been processed in the directivity controlling step to be input to the plurality of speakers are delayed from the audio signals having been processed in the localization adding step to be input to the plurality of speakers.

For example, the audio signal processing method further includes a band dividing step of dividing the band of each of the audio signals having been input in the input step into a high frequency component and a low frequency component, the plurality of speakers include a speaker array to which the audio signals having been processed in the directivity controlling step are input and a stereo speaker to which the audio signals having been processed in the localization adding step are input, in the directivity controlling step, the high frequency component of the audio signal having been processed in the band dividing step is processed, and the low frequency component of the audio signal having been processed in the band dividing step are input to the stereo speaker.

The present invention has been described in detail so far with reference to specific embodiments, and it will be apparent for those skilled in the art that various changes and modifications can be made without departing from the spirit and scope of the present invention.

This application is based upon the Japanese Patent Application filed on Aug. 19, 2013 (Japanese Patent Application No. 2013-169755), the Japanese Patent Application filed on Dec. 26, 2013 (Japanese Patent Application No. 2013-269162), the Japanese Patent Application filed on Dec. 26, 2013 (Japanese Patent Application No. 2013-269163), the Japanese Patent Application filed on Dec. 27, 2013 (Japanese Patent Application No. 2013-272528) and the Japanese Patent Application filed on Dec. 27, 2013 (Japanese Patent Application No. 2013-272352), the entire contents of which are incorporated herein by reference.

INDUSTRIAL APPLICABILITY

The present invention can provide a speaker apparatus and an audio signal processing method in which a localization feeling is provided based on both a sound beam and a virtual sound source, and a sound source can be distinctively localized by using localization based on a virtual sound source while taking advantages of the characteristic of a sound beam.

REFERENCE SIGNS LIST

1 . . . AV system, 2 . . . array speaker apparatus, 3 . . . subwoofer, 4 . . . television, 7 . . . microphone, 10 . . . decoder, 11 . . . input portion, 14 and 15 . . . filtering processing portion, 18C, 18FL, 18FR, 18SL and 18SR . . . gain adjusting portion, 20 . . . beam forming processing portion, 21A to 21P . . . speaker unit, 32 . . . adding processing portion, 33L and 33R . . . woofer, 35 . . . control portion, 40 . . . virtual processing portion, 42 . . . localization adding portion, 43 . . . level adjusting portion, 43C, 43FL, 43FR, 43SL and 43SR . . . gain adjusting portion, 51 . . . correcting portion

1001 . . . AV system, 1002 . . . array speaker apparatus, 1002A . . . array speaker apparatus, 1002B . . . array speaker apparatus, 1003 . . . subwoofer, 1004 . . . television, 1007 . . . microphone, 1010 . . . decoder, 1011 . . . input portion, 1014 and 1015 . . . filtering processing portion, 1020 . . . beam forming processing portion, 1032 . . . adding processing portion, 1033L and 1033R . . . woofer, 1035 . . . control unit, 1036 . . . user I/F, 1040 . . . virtual processing portion

2001 . . . AV system, 2002 and 2002A . . . array speaker apparatus, 2003 . . . subwoofer, 2004 . . . television, 2010 . . . decoder, 2011 . . . DIR, 2012 . . . ADC, 2013 . . . HDMI receiver, 2014FL, 2014FR, 2014C, 2014SR and 2014SL . . . HPF, 2015FL, 205FR, 2015C, 2015SR and 2015SL . . . LPF, 2016 and 2017 . . . adding portion, 2018 . . . level adjusting portion, 2020 . . . directivity controlling portion, 2021A to 2021P . . . speaker unit, 2021Q, 2021R, 2021S, 2021U and 2021T . . . directional speaker unit, 2022 . . . initial reflected sound processing portion, 2221 . . . gain adjusting portion, 2222 . . . initial reflected sound generating portion, 2223 . . . synthesizing portion, 2030L and 2030R . . . HPF, 2031L and 2031R . . . LPF, 2032L and 2032R . . . adding portion, 2033L and 2033R . . . woofer, 2040FL, 2040FR, 2040C, 2040SR and 2040SL . . . HPF, 2041FL, 2041FR, 2041C, 2041SR and 2041SL . . . LPF, 2042 . . . localization adding portion, 2043 . . . level adjusting portion, 2044 . . . rear reflected sound processing portion, 2441 . . . gain adjusting portion, 2442 . . . rear reverberation sound generating portion, 2443 . . . synthesizing portion, 2050 . . . crosstalk cancelation processing portion, 2051 . . . correcting portion, 2052L and 2052R . . . synthesizing portion, 2060L and 2060R . . . delay processing portion, 2061L and 2061R . . . level adjusting portion, 2070A to 2070E, 2070F and 2070G . . . level adjusting portion, 2071 . . . adding portion, 2072 . . . subwoofer unit

3001 . . . AV system, 3002 . . . array speaker apparatus, 3002 and 3002A . . . speaker apparatus, 3002B . . . speaker set, 3003 . . . subwoofer, 3004 . . . television, 3010 . . . decoder, 3011 . . . DIR, 3012 . . . ADC, 3013 . . . HDMI receiver, 3014FL, 3014FR, 3014C, 3014SR and 3014SL . . . HPF, 3015FL, 3015FR, 3015C, 3015SR and 3015SL . . . LPF, 3016 and 3017 . . . adding portion, 3018 . . . level adjusting portion, 3020 . . . directivity controlling portion, 3021A to 3021P . . . speaker unit, 3030L and 3030R . . . HPF, 3031L and 3031R . . . LPF, 3032L and 3032R . . . adding portion, 3033L and 3033R . . . woofer, 3040FL, 3040FR, 3040C, 3040SR and 3040SL . . . HPF,

3041FL, 3041FR, 3041C, 3041SR and 3041SL . . . LPF, 3042 . . . localization adding portion, 3043 . . . level adjusting portion, 3050 . . . crosstalk cancellation processing portion, 3051 . . . correcting portion, 3052L and 3052R . . . synthesizing portion, 3060L and 3060R . . . delay processing portion, 3061L and 3061R . . . level adjusting portion, 3070A to 3070E, 3070F and 3070G . . . level adjusting portion, 3071 . . . adding portion, 3072 . . . subwoofer unit

The invention claimed is:

1. A speaker apparatus comprising:

an input portion to which audio signals of a plurality of channels are input;

a plurality of speakers;

at least one processor for executing stored instructions to:

delay the audio signals of the plurality of channels input to the input portion and distribute the delayed audio signals to the plurality of speakers so that the plurality of speakers output a plurality of sound beams, wherein the plurality of sound beams are directed toward at least one focus position; and apply a filtering processing based on a head-related transfer function to at least one of the audio signals of the plurality of channels input to the input portion and inputs the processed audio signal to the plurality of speakers, and wherein at least a part of a virtual sound source, localized by the at least one of the audio signals of the plurality of channels to which the filtering processing based on the head-related transfer function is applied, overlaps at least a portion of the at least one focus position of the plurality of sound beams.

2. The speaker apparatus according to claim 1, wherein the at least one processor further adjusts and sets levels of the processed audio signals of the respective channels and levels of the audio signals of the sound beams of the respective channels.

3. The speaker apparatus according to claim 2, further comprising:

a microphone installed in a listening position; and wherein the at least one processor further:

detects a level of the sound beam of each channel reaching the listening position, inputs a test signal to cause the plurality of speakers to output a test sound beam, measures a level of the test sound beam input to the microphone; and sets the levels of the processed audio signals of the respective channels and levels of the audio signals of the sound beams of the respective channels a result of the measurement.

4. The speaker apparatus according to claim 3, wherein the at least on processor further:

compares levels of the audio signals of the plurality of channels input to the input portion, and sets the levels of the processed audio signals of the respective channels and levels of the audio signals of the sound beams of the respective channels a result of the comparison.

5. The speaker apparatus according to claim 4, wherein the at least one processor further:

compares levels of an audio signal of a front channel and an audio signal of a surround channel; and sets the levels based on the result of the comparison.

6. The speaker apparatus according to claim 4, wherein at least one processor further divides each of the audio signals of the plurality of channels input to the input portion into predefined bands for comparing the levels of the signals of each of the divided bands.

7. The speaker apparatus according to claim 3, further comprising:

a volume setting receiver that accepts volume setting of the plurality of speakers, wherein at least the one processor further sets the levels on the basis of the volume accepted.

8. The speaker apparatus according to claim 1, wherein at least one processor further sets a direction of the virtual sound source based on the head-related transfer function in a direction between reaching directions of the plurality of sound beams when seen from a listening position.

9. The speaker apparatus according to claim 1, wherein at least one processor further:

outputs an audio signal of one channel as a plurality of sound beams for localizing a phantom sound source, and sets the direction of the virtual sound source based on the head-related transfer function in a direction corresponding to a localization direction of the phantom sound source.

10. The speaker apparatus according to claim 1, wherein at least one processor further:

adds a characteristic of an initial reflected sound to an audio signal input thereto; and adds a characteristic of a rear reverberation sound to an audio signal input thereto, receives, as an input, an audio signal output from the sound with the added rear reverberation sound; and receives, as an input, an audio signal output from the sound with the added initial reflected sound.

11. The speaker apparatus according to claim 10, wherein at least one processor further:

adjusts levels of the sound added the initial reflected sound and the sound with the added rear reverberation sound.

12. The speaker apparatus according to claim 10, wherein a part of the plurality of speakers corresponds to a stereo speaker to which the audio signals from the processed audio signals are input, and the other of the plurality of speakers corresponds to a speaker array to which the audio signals from the delayed and distributed sound are input.

13. The speaker apparatus according to claim 1, wherein at least one processor further divides each of the audio signals input to the input portion into a high frequency component and a low frequency component, and output the divided signals, wherein the plurality of speakers include a speaker array to which the audio signals from the delayed and distributed sound are input, and a stereo speaker to which the audio signals from the filter processed sound are input;

wherein the high frequency component of the audio signal output from the divided signals is input for delay and distribution; and wherein the low frequency component of the audio signal output from the divided signals is input to the stereo speaker.

14. An audio signal processing method comprising:

an input step of inputting audio signals of a plurality of channels;

a directivity controlling step of delaying the audio signals of the plurality of channels input in the input step and distributing the delayed audio signals to the plurality of speakers so that a plurality of speakers output a plurality of sound beams, wherein the plurality of sound beams are directed toward at least one focus position; and a localization adding step of applying a filtering processing based on a head-related transfer function to at least one of the audio signals of the plurality of channels input in the input step and inputting the processed signal to the plurality of speakers, wherein at least a portion of a virtual sound source localized by the at least one of the audio signals of the plurality of channels to which the filtering processing based on the head-related transfer function is applied, overlaps at least a portion of the at least one focus position of the plurality of sound beams.

15. The audio signal processing method according to claim 14, further comprising:

a first level adjusting step of adjusting levels of the audio signals of the respective channels in which the filtering processing is applied in the localization adding step and levels of the audio signals of the sound beams of the respective channels; and a setting step of setting levels in the first level adjusting step.

16. The audio signal processing method according to claim 15, further comprising:

a detection step of detecting a level of a sound beam of each channel reaching a listening position by a microphone installed in the listening position, wherein in the detection step, a level at which a test sound beam output from the plurality of speakers on the basis of an input test signal is input to the microphone is measured; and wherein in the setting step, the levels in the first level adjusting step are set on the basis of a measurement result obtained in the detection step.

17. The audio signal processing method according to claim 16, further comprising:

a comparison step of comparing levels of the audio signals of the plurality of channels input in the input step, wherein in the setting step, the levels in the level adjusting step are set on the basis of a comparison result obtained in the comparison step.

18. The audio signal processing method according to claim 17, wherein in the comparison step, a level of an audio signal of a front channel is compared with a level of an audio signal of a surround channel; and wherein in the setting step, the levels in the first level adjusting step are set on the basis of the comparison result obtained in the comparison step.

19. The audio signal processing method according to claim 17, wherein in the comparison step, each of the audio signals of the plurality of channels input in the input step is divided into prescribed bands, and the levels of the signals of each of the divided bands are compared.

20. The audio signal processing method according to claim 16, further comprising:

a volume setting accepting step of accepting volume setting of the plurality of speakers, wherein in the setting step, the levels in the first level adjusting step are set on the basis of the volume setting.

21. The audio signal processing method according to claim 14, wherein in the localization adding step, a direction of the virtual sound source based on the head-related transfer function is set in a direction between reaching directions of the plurality of sound beams when seen from a listening position.

22. The audio signal processing method according to claim 14, further comprising:

a phantom processing step of outputting an audio signal of one channel as a plurality of sound beams for localizing a phantom sound source, wherein in the localization adding step, the direction of the virtual sound source based on the head-related transfer function is set in a direction corresponding to a localization direction of the phantom sound source.

23. The audio signal processing method according to claim 14, further comprising:

an initial reflected sound adding step of adding a characteristic of an initial reflected sound to an input audio signal; and a rear reverberation sound adding step of adding a characteristic of a rear reverberation sound to an input audio signal, wherein in the localization adding step, the audio signal having been processed in the rear reverberation sound adding step is processed, and wherein in the directivity controlling step, the audio signal having been processed in the initial reflected sound adding step is processed.

24. The audio signal processing method according to claim 23, further comprising:

a second level adjusting step of adjusting levels of the initial reflected sound processed in the initial reflected sound adding step and the rear reverberation sound processed in the rear reverberation sound adding step.

25. The audio signal processing method according to claim 23, wherein a part of the plurality of speakers corresponds to a stereo speaker to which the audio signals having been processed in the localization adding step are input, and the other of the plurality of speakers corresponds to a speaker array to which the audio signals having been processed in the directivity controlling step are input.

26. The audio signal processing method according to claim 14, further comprising:

a delay processing step of delaying the audio signals and outputting the delayed signals, the delay processing step being conducted before or after processing of the localization adding step or the directivity controlling step.

27. The audio signal processing method according to claim 26, wherein the delay processing step is provided before or after the processing of the localization adding step; and wherein in the delay processing step, the audio signals are delayed by a larger delay amount than a maximum delay amount caused in the directivity controlling step and the delayed signals are output.

28. The audio signal processing method according to claim 26, wherein the delay processing step is provided before or after the processing of the directivity controlling step; and wherein in the delay processing step, the audio signals are delayed and the delayed signals are output in such a manner that the audio signals of the plurality of channels having been processed in the directivity controlling step to be input to the plurality of speakers are delayed from the audio signals having been processed in the localization adding step to be input to the plurality of speakers.

29. The audio signal processing method according to claim 14, further comprising:

a band dividing step of dividing a band of each of the audio signals input in the input step into a high frequency component and a low frequency component, wherein the plurality of speakers include a speaker array to which the audio signals having been processed in the directivity controlling step are input and a stereo speaker to which the audio signals having been processed in the localization adding step are input;

wherein in the directivity controlling step, the high frequency component of the audio signal having been processed in the band dividing step is processed; and wherein the low frequency component of the audio signal having been processed in the band dividing step is input to the stereo speaker.

* * * * *